US012540540B2

(12) United States Patent
Olorode

(10) Patent No.: US 12,540,540 B2
(45) Date of Patent: Feb. 3, 2026

(54) SLOT-DRILL ENHANCED OIL RECOVERY METHOD

(71) Applicant: Board of Supervisors of Louisiana State University and Agricultural and Mechanical College, Baton Rouge, LA (US)

(72) Inventor: Olufemi Morounfopefoluwa Olorode, Baton Rouge, LA (US)

(73) Assignee: BOARD OF SUPERVISORS OF LOUISIANA STATE UNIVERSITY AND AGRICULTURAL AND MECHANICAL COLLEGE, Baton Rouge, LA (US)

( * ) Notice: Subject to any disclaimer, the term of this patent is extended or adjusted under 35 U.S.C. 154(b) by 0 days.

(21) Appl. No.: 18/690,639

(22) PCT Filed: Sep. 30, 2022

(86) PCT No.: PCT/US2022/077398
§ 371 (c)(1),
(2) Date: Mar. 8, 2024

(87) PCT Pub. No.: WO2023/056453
PCT Pub. Date: Apr. 6, 2023

(65) Prior Publication Data

US 2024/0376811 A1 Nov. 14, 2024

Related U.S. Application Data

(60) Provisional application No. 63/251,326, filed on Oct. 1, 2021.

(51) Int. Cl.
*E21B 43/17* (2006.01)
*E21B 11/06* (2006.01)
(Continued)

(52) U.S. Cl.
CPC ..... *E21B 43/305* (2013.01); *E21B 43/26* (2013.01)

(58) Field of Classification Search
CPC ..... E21B 43/305; E21B 43/17; E21B 11/06; E21B 7/046
See application file for complete search history.

(56) References Cited

U.S. PATENT DOCUMENTS 2,653,794 A * 9/1953 Straitiff ..... E21B 11/06 173/59
4,232,904 A 11/1980 Hurd
(Continued)

OTHER PUBLICATIONS

Alfarge et al., "Factors Affecting CO2-EOR in Shale-Oil Reservoirs: Numerical Simulation Study and Pilot Tests", Energy & Fuels, (2017), vol. 31, pp. 8462-8480.
(Continued)

*Primary Examiner* — Kenneth L Thompson
(74) *Attorney, Agent, or Firm* — Venable LLP; Keith G Haddaway

(57) ABSTRACT

A method for slot-drill enhanced oil recovery in a formation includes providing a wellbore in a reservoir of the formation, the reservoir having a top and a bottom, cutting a first horizontal slot-drill fracture at the top of the reservoir, cutting a second horizontal slot-drill fracture at the bottom of the reservoir, injecting a fluid into the reservoir via the first horizontal slot-drill fracture at the top of the reservoir, and producing oil from the second horizontal slot-drill fracture at the bottom of the reservoir. The first horizontal slot-drill fracture is parallel to the second horizontal slot-drill fracture.

14 Claims, 29 Drawing Sheets

(51) Int. Cl.
*E21B 43/26* (2006.01)
*E21B 43/30* (2006.01)

(56) References Cited

U.S. PATENT DOCUMENTS

| | | | | |
|---|---|---|---|---|
| 4,550,779 | A * | 11/1985 | Zakiewicz | E21B 43/2401 166/266 |
| 4,676,313 | A * | 6/1987 | Rinaldi | E21B 43/305 166/250.15 |
| 5,033,795 | A | 7/1991 | Farrar et al. | |
| 5,318,124 | A * | 6/1994 | Ong | E21B 43/305 166/50 |
| 5,868,202 | A | 2/1999 | Hsu | |
| 6,095,244 | A | 8/2000 | Graham et al. | |
| 7,647,967 | B2 | 1/2010 | Coleman, II et al. | |
| 7,814,968 | B2 * | 10/2010 | Bizon | E21B 43/16 166/57 |
| 8,261,820 | B2 * | 9/2012 | Coleman, II | E21B 43/305 166/50 |
| 8,905,132 | B2 * | 12/2014 | Abbate | E21B 43/24 166/250.1 |
| 8,960,317 | B2 * | 2/2015 | Ayasse | E21B 43/243 166/266 |
| 9,388,676 | B2 * | 7/2016 | Jorshari | E21B 43/2406 |
| 9,726,157 | B2 * | 8/2017 | Sweatman | E21B 43/25 |
| 10,590,749 | B2 * | 3/2020 | Sanders | C09K 8/584 |
| 10,947,828 | B2 * | 3/2021 | Roy | E21B 47/14 |
| 11,125,063 | B2 * | 9/2021 | Filatyev | E21B 43/2401 |
| 11,261,725 | B2 * | 3/2022 | Gupta | E21B 47/107 |
| 2011/0247810 | A1 | 10/2011 | Ocampos et al. | |
| 2011/0247816 | A1 | 10/2011 | Carter, Jr. | |
| 2012/0241150 | A1 * | 9/2012 | Al Yahyai | E21B 43/162 166/270 |
| 2016/0230526 | A1 | 8/2016 | Crews et al. | |
| 2017/0074043 | A1 | 3/2017 | Carter et al. | |

OTHER PUBLICATIONS

Alghalandis, Y. F. (2017). Adfne: open source software for discrete fracture network engineering, two and three dimensional applications. Computers & Geosciences, 102:1-11.

Apiwathanasorn et al., "Evidence of reopened microfractures in production data analysis of hydraulically fractured shale gas wells", In SPE Canadian Unconventional Resources Conference. Society of Petroleum Engineers, (2012), (21 pages).

Coats, "An Equation of State Compositional Model", spe8284. In 54th Annual Fall Technology Conference and Exhibition of the Society of Petroleum Engineers, Las Vegas, Nevada, US, (Oct. 1980), (pp. 363-376).

Du et al., "A review of Gas Injection in Shale Reservoirs: Enhanced Oil/Gas Recovery Approaches and Greenhouse Gas Control", Energies, (2019), vol. 12, (33 pages).

Eshkalak et al., "Enhanced Gas Recovery by CO2 Sequestration versus Re-fracturing Treatment in Unconventional Shale Gas Reservoirs", In Abu Dhabi International Petroleum Exhibition and Conference. Society of Petroleum Engineers, (2014), (18 pages).

Ganjdanesh, R., Yu, W., Fiallos Torres, M. X., Sepehrnoori, K., Kerr, E., Ambrose, R., et al. (2019). Huff-n-puff gas injection for enhanced condensate recovery in eagle ford. In SPE Annual Technical Conference and Exhibition. Society of Petroleum Engineers.

Grinestaff et al., "Evaluation of Eagle Ford Cyclic Gas Injection EOR: Field Results and Economics", In SPE Improved Oil Recovery Conference. Society of Petroleum Engineers, (2020), (23 pages).

Hao et al., "Performance Optimization of CO2 Huff-n-Puff for Multifractured Horizontal Wells in Tight Oil Reservoirs", Geofluids, (2020), (13 pages).

Haridy et al., Comprehensive study of the Oda corrected Permeability Upscaling Method. In SPE/IATMI Asia Pacific Oil & Gas Conference and Exhibition. Society of Petroleum Engineers, (2019), (19 pages).

Hoffman, "Huff-n-Puff Gas Injection Pilot Projects in the Eagle Ford", In SPE Canada Unconventional Resources Conference. OnePetro, (2018), (18 pages).

Jacobs et al., "Shale EOR Delivers, So Why Won't the Sector Go Big?", Journal of Petroleum Technology, (May 2019), pp. 37-41.

Karimi-Fard et al., "Numerical Simulation of Water Injection in 2D Fractured Media Using Discrete-Fracture Model", In SPE Annual Technical Conference and Exhibition, New Orleans, Louisiana, USA. Society of Petroleum Engineers, (2001), (16 pages).

Kalantari-Dahaghi et al., Numerical Simulation and Modeling of Enhanced Gas Recovery and CO2 Sequestration in Shale Gas Reservoirs: A Feasibility Study. In SPE international conference on CO2 capture, storage, and utilization. Society of Petroleum Engineers, (2010), (18 pages).

Kim et al., "Finite Element, Discrete-Fracture Model for Multiphase Flow in Porous Media", AlChE J., (Jun. 2000), vol. 46, No. 6, pp. 1120-1130.

Kim et al., "Modeling of CO2 Injection Considering Multi-Component Transport and Geomechanical Effect in Shale Gas Reservoirs", In SPE/IATMI Asia Pacific Oil & Gas Conference and Exhibition. Society of Petroleum Engineers, (2015), (17 pages).

Kuuskraa et al., "Increasing shale oil recovery and co2 storage with cyclic co2 enhanced oil recovery", Located at https://bit.ly/3414flu. USEA/DOE-002415-20-01, (2020), (191 pages).

Li et al., "Efficient Field-Scale Simulation of Black Oil in a Naturally Fractured Reservoir Through Discrete Fracture Networks and Homogenized Media", SPE Reserv. Evaluation Eng., (Aug. 2008), pp. 750-758.

Lohrenz et al., "Calculating Viscosities of Reservoir Fluids From Their Compositions" Journal of Petroleum Technology, (Oct. 1964), pp. 1171-1176.

Moinfar et al., "Development of an Efficient Embedded Discrete Fracture Model for 3D Compositional Reservoir Simulation in Fractured Reservoirs", SPE Journal, 1(2014), 9(02): pp. 289-303.

Moridis et al., "Evaluation of the Effectiveness of Continuous Gas Displacement for EOR in Hydraulically Fractured Shale Reservoirs", In SPE Latin American and Caribbean Petroleum Engineering Conference. Society of Petroleum Engineers, (Aug. 2021), pp. 2068-2091.

Moyner et al., A Multiscale Restriction-Smoothed Basis Method for Compositional Models. In SPE Reservoir Simulation Conference. Society of Petroleum Engineers, (2017), (13 pages).

Niven et al., "Relating Different Measures of Fracture Intensity", CCG Annual Report-Paper 103, Centre for Computational Geostatistics, (2010), (4 pages).

Odunowo et al., "Evaluation of Well Performance for the Slot-Drill Completion in Low-and Ultra-Low-Permeability Oil and Gas Reservoirs", SPE Journal, (2014), (40 pages).

Olorode et al., "Three-Dimensional Projection-Based Embedded Discrete-Fracture Model for Compositional Simulation of Fractured Reservoirs", SPE Journal, (Aug. 2020), pp. 2143-2161.

Peng et al., "A New Two-Constant Equation of State", Industrial & Engineering Chemistry Fundamentals, (1976), vol. 15, No. 1, pp. 59-64.

Pospisil et al., "Report on the First Rich Gas EOR Cyclic Multiwell Huff N Puff Pilot in the Bakken Tight Oil Play", In SPE Annual Technical Conference and Exhibition. Society of Petroleum Engineers, (2020), (40 pages).

Pruess et al., "A Practical Method for Modeling Fluid and Heat Flow in Fractured Porous Media", SPE J., (Feb. 1985), pp. 14-26.

Rassenfoss et al., Shale EOR Works, But Will It Make a Difference? Journal of Petroleum Technology, (Oct. 2017), pp. 34-40.

Raterman et al., "Sampling a Stimulated Rock Volume: An Eagle Ford Example", SPE Reservoir Evaluation & Engineering, (Nov. 2018), pp. 927-941.

Shafiei et al., "Natural Fractures Characterization and In Situ Stresses Inference in a Carbonate Reservoir—An Integrated Approach", Energies, (2018), vol. 11, (27 pages).

Sturm et al., "Role of Natural Fracturing in Production from the Bakken Formation, Williston Basin, North Dakota", In AAPG Annual Convention and Exhibition, (2009), (7 pages).

Sun et al., "Experimental and Numerical Studies of CO2 EOR in Unconventional Liquid Reservoirs with Complex Fracture Net-

(56) References Cited

OTHER PUBLICATIONS works", In SPE Improved Oil Recovery Conference. Society of Petroleum Engineers, (2016), (28 pages).
Sun et al., "Compositional simulation of CO2 Huff-n-Puff process in Middle Bakken tight oil reservoirs with hydraulic fractures", Fuel, (2019), vol. 236, 1446-1457.
Tene et al., "Projection-based Embedded Discrete Fracture Model (pEDFM)", Advances in Water Resources, (2017), vol. 105, pp. 205-216.
Tene, "Algebraic Multiscale Framework for Fractured Reservoir Simulation", PhD thesis, Delft University of Technology, (2018), (165 pages).
Warren et al., "The Behavior of Naturally Fractured Reservoirs", SPE J., (Sep. 1963), pp. 245-255.
Yu et al., "A Sensitivity Study of Potential CO2 Injection for Enhanced Gas Recovery in Barnett Shale Reservoirs", In SPE unconventional resources conference. Society ofPetroleum Engineers, (2014a), (16 pages).
Yu et al., "Simulation Study of CO2 Huff-n-Puff Process in Bakken Tight Oil Reservoirs", In SPE Western North American and Rocky Mountain Joint Meeting. Society ofPetroleum Engineers, (2014b), (16 pages).
Yu et al., "Co2 injection for enhanced oil recovery inbakken tight oil reservoirs", Fuel, (2015), vol. 159, pp. 354-363.
Yu et al., "Compositional Simulation of CO2 Huff'n'Puff in Eagle Ford Tight Oil Reservoirs With Co2 Molecular Diffusion, Nanopore Confinement, and Complex Natural Fractures", SPE Reservoir Evaluation & Engineering, (May 2019), pp. 492-508.
Zhu et al., "Compositional modeling of fracture-to-fracture miscible gas injection in an oil-rich shale", Journal of Petroleum Science and Engineering, (2017), vol. 152, pp. 628-638.
Zou et al., "Investigation of the Oil Recovery Mechanism During Laboratory CO2 Eor Experiment with Unconventional Shale Cores through Compositional Simulation", In Carbon Management Technology Conference. Carbon Management Technology Conference, (2017), (20 pages).
Zuloaga-Molero et al., "Simulation Study of CO2-EOR in Tight Oil Reservoirs with Complex Fracture Geometries", Sci. Rep., (2016), vol. 6, (11 pages).
Zuloaga et al., "Performance evaluation of co2 huff-n-puff and continuous co2 injection in tight oil reservoirs", Energy, (2017), vol. 134, pp. 181-192.
Hoffman et al., "Improved Oil Recovery IOR Pilot Projects in the Bakken Formation", In SPE low perm symposium. Society of Petroleum Engineers, (2016), (22 pages).

* cited by examiner

16 NFs

64 NFs

256 NFs

1024 NFs

8 Years

15 Years

30 Years

60 Years

8 Years

15 Years

30 Years

0 Years

30 Years

SD-EOR (Base)

1024 Conductive NFs

1024 Non-Conductive NFs

SLOT-DRILL ENHANCED OIL RECOVERY METHOD

CROSS-REFERENCE TO RELATED APPLICATIONS

The application is a U.S. National Stage Application of PCT/US2022/077398, filed Sep. 30, 2022, which claims priority to U.S. Provisional Application No. 63/251,326, filed Oct. 1, 2021, the entire contents of each of which are hereby incorporated by reference in their entirety.

TECHNICAL FIELD

The present disclosure relates to an enhanced oil recovery method. In particular, the present disclosure relates to an enhanced oil recovery method employing slot-drilling.

BACKGROUND

The combination of horizontal drilling and multistage hydraulic fracturing has resulted in the commercial development of tight formations and shale oil resources. The advancements in drilling and completion technologies have enabled drilling wells with longer lateral lengths and creation of several fracture clusters at several stages in the well. However, the primary recovery in these low-matrix permeability reservoirs is still typically less than 10% of the oil initially in the reservoir. In some examples, shale-oil wells decline 75%-90% within the first three years of production, producing only 5%-9% of the amount of oil initially in the reservoir. Currently, shale EOR systems and methods involve injecting fluids (mostly CO2 or hydrocarbon gas) through multistage hydraulic fractures. The injection can either be continuous (through an injection well) or cyclic (in huff-n-puff mode), also referred to as cyclic gas injection EOR (CGEOR).

Considering the significant costs of injecting fluids into shale-oil reservoirs, petroleum engineers typically perform numerical simulation to identify the optimum EOR mechanism, injection mode, and optimize the operating constraints for the injection and production wells. However, these numerical studies are complicated by the common occurrence of natural fractures in unconventional oil and gas reservoirs. Some current EOR systems and methods include effective matrix/fracture models (such as dual porosity, dual permeability, and continuum models) to address natural fractures or simply neglect the presence of natural fractures. Unlike the effective medium models, discrete models (such as discrete fracture models, embedded discrete fracture model (EDFM), projection-based embedded discrete fracture model (pEDFM)) may account for each individual fracture in a naturally-fractured reservoir.

Regardless of the fracture model employed, the increase in recovery from CGEOR methods is still below a desired recovery. Accordingly, a need exists for an improved enhanced oil recovery system and method.

BRIEF SUMMARY

According to an embodiment of the present disclosure, a method for slot-drill enhanced oil recovery in a formation includes providing a wellbore in a reservoir of the formation, the reservoir having a top and a bottom: cutting a first horizontal slot-drill fracture at the top of the reservoir; cutting a second horizontal slot-drill fracture at the bottom of the reservoir: injecting a fluid into the reservoir via the first horizontal slot-drill fracture at the top of the reservoir; and producing oil from the second horizontal slot-drill fracture at the bottom of the reservoir, wherein the first horizontal slot-drill fracture is parallel to the second horizontal slot-drill fracture.

According to an embodiment of the present disclosure, a method for improving hydrocarbon recovery in an ultra-low permeability reservoir includes injecting a fluid into a first wellbore: producing a hydrocarbon from a second wellbore, wherein the first wellbore and the second wellbore are connected at distal ends thereof with one or more horizontal slot-drilled fractures, and wherein the hydrocarbon is produced from the one or more horizontal slot-drilled fractures.

According to an embodiment of the present disclosure, a method for slot-drill enhanced oil recovery in a formation includes providing a first wellbore having a first distal end and a second wellbore having a second distal end: cutting a horizontal slot-drill fracture in the formation between the first wellbore and the second wellbore; injecting a fluid into the first wellbore; and producing oil from the horizontal slot-drill fracture through the second wellbore, wherein the horizontal slot-drill fracture connects the first distal end of the second distal end.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1A:
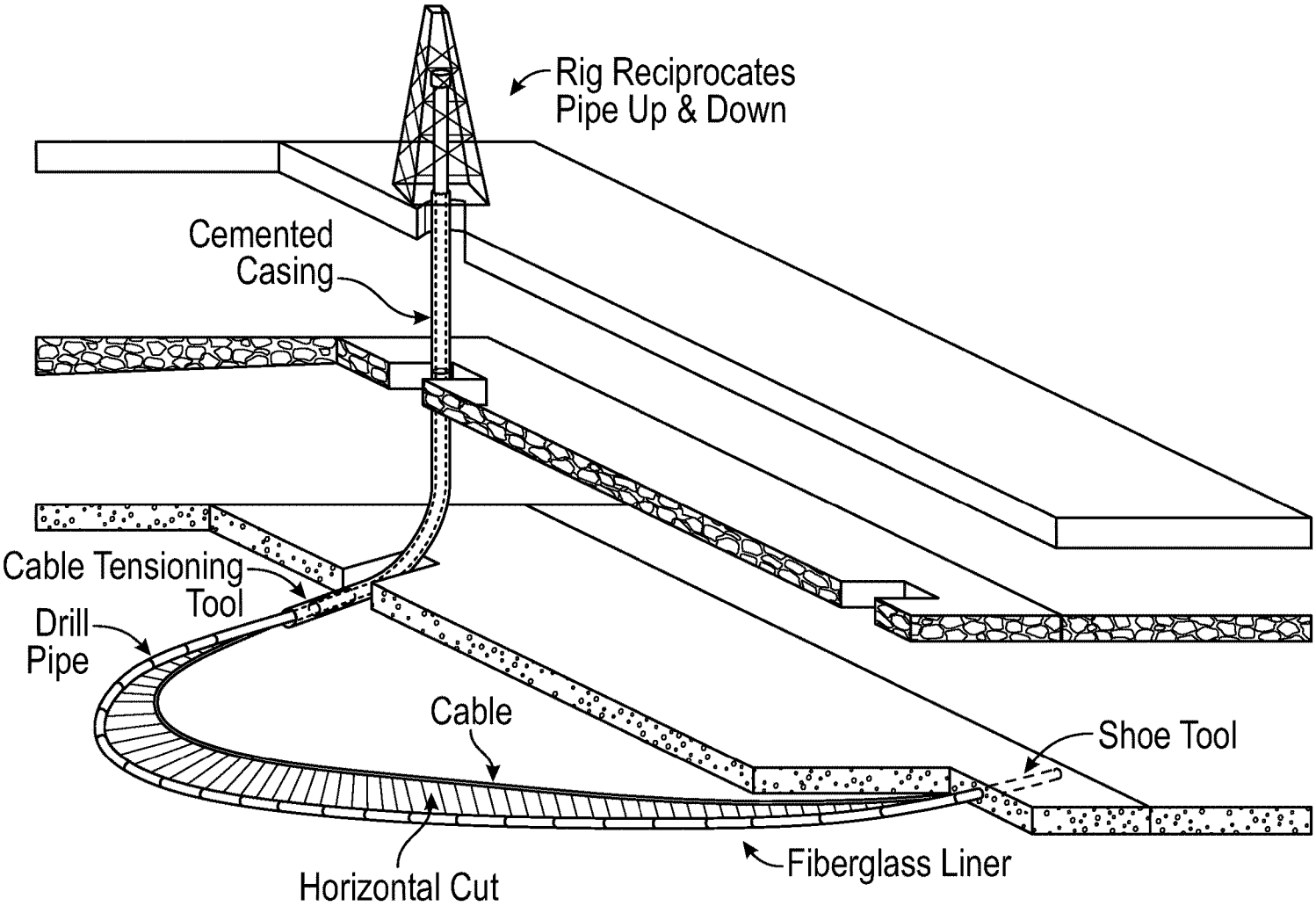
FIG. 1A (Prior Art)
FIG. 1A shows a schematic of a prior art slot-drilling completion system to create a horizontal fracture in a wellbore, employable by an embodiment of the present disclosure.

Features, advantages, and embodiments of the present disclosure are set forth or apparent from a consideration of the following detailed description, drawings, and claims. Moreover, it is to be understood that the following detailed description are exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

Enhanced oil recovery (EOR) is essential in shale/tight formations because primary recovery typically produces less than 10% of the original hydrocarbon in-place (OHIP). The system of the present disclosure provides a Slot-Drill EOR technology (SDEOR). The system of the present disclosure may involve injecting gas through a horizontal fracture that is cut into the formation near the top of the reservoir (for example, with a tensioned abrasive cable mounted to the drill string), and producing oil from a second slot-drilled horizontal fracture near the bottom of the reservoir. The reservoirs may be oil reservoirs.

A model, such as, for example, a robust three-dimensional (3D) projection-based embedded discrete fracture model is used to model the natural fractures in the slot-drilled reservoirs accurately and efficiently. Connectivity and uncertainty analyses may be performed to determine a percolation threshold, that is, where natural fractures influence hydrocarbon production appreciably. The system of the present disclosure may yield over a three-fold increase in oil recovery relative to a conventional Cyclic Gas EOR (CGEOR) method. The simulated recovery of the model is high regardless of the presence of natural fractures and/or the type of treatment injected. The treatment may be, for example, a gas and/or a solvent, or other treatments. The gas and/or solvent may be, for example, but not limited to $CH_4$, $N_2$, $CO_2$, flue gas, or combinations thereof. The simulation results indicate that, for example, the continuous gas injection, higher relative oil permeability and the role of gravity-drainage all the oil recovery from the SDEOR to be three times the oil recovery from the CGEOR method.

The system of the present disclosure may provide pairs of parallel slot-drilled fractures to enhance the recovery from challenging and/or unconventional reservoirs, such as the Bakken shale, which has not been successfully enhanced using the CGEOR method. There is a four-fold to eleven-fold improved recovery from the SDEOR relative to primary recovery of the reservoir.

As discussed, numerical simulation is performed to identify the optimum EOR mechanism and injection mode, and to optimize the operating constraints for the injection and production wells. Regardless of the fracture model employed (discussed above), the increase in recovery from CGEOR methods appear to be much less than the SDEOR system and method of the present disclosure. For instance, Moridis et al. (2020) employed a single-porosity effective matrix/fracture model, and showed that the injection of methane gas using the conventional shale EOR method did not result in an appreciable increase in oil recovery (relative to primary production). Various authors (Dahaghi et al., 2010; Eshkalak et al., 2014; Kim et al., 2015; Yu et al., 2014a) have also used the dual continuum models to evaluate $CO_2$ continuous and cyclic injection shale-oil reservoirs. Although these methods are computationally faster, they are unable to account for the heterogeneity in the individual fracture sizes, orientation, distribution, etc. Accordingly, the SDEOR system and method of the present disclosure employs the numerical simulation studies of the conventional shale EOR methods using EDFM. Table 1 summarizes some of these EDFM simulation results, and provides the corresponding references. These tabulated results as well as the other numerical and experimental studies summarized in Tables 1 and 2 of Du and Nojabaei (2019) indicate a wide range in the increased oil recovery factor reported by various authors. In line with previous shale EOR studies, the increase in oil recovery is quantified using the Improved Oil Recovery (IOR) ratio, which is the ratio of the expected ultimate recovery (EUR) from EOR to the EUR from primary recovery.

Considering that EDFM is unable to account for low-conductivity fractures accurately (Tene et al., 2017), the EDFM studies in Table 1 implicitly assume that all the natural fractures are conductive, which is very unlikely in reality. This is because the orientation of each fracture depends on the prevailing stress state when it was created (Shafiei et al., 2018), after which fine-grained/cementing materials could accumulate in these fractures and make them sealing in the prevailing stress state today. In this work, we use the pEDFM in order to evaluate the performance of the proposed technology of the present disclosure in naturally fractured reservoirs with any arbitrary fracture conductivity.

The application of CGEOR in field and pilot studies has yielded mixed results. Several authors agree that CGEOR has been successful in the Eagle Ford shale, with IOR ratios ranging from 1.3 to 1.7 (Grinestaff et al., 2020; Hoffman, 2018). Conversely, several authors also agree (Hoffman et al., 2016) that the application of CGEOR has been unsuccessful in the Bakken shale play. Although Rassenfoss et al. (2017) attributed the lack of an incremental oil recovery to the lower matrix permeability of the Bakken, Hoffman et al. (2016) concluded (from his analysis of several EOR field/pilot tests) that early gas breakthrough (or connectivity of the fracture networks with those from offset wells) rather than poor injectivity was the cause of the negligible increment in recovery. Although field and pilot studies of the CGEOR in the Eagle Ford play indicate an IOR ratio of up to 1.7 if hydrocarbon gases are injected at high rates, Jacobs et al. (2019) pointed out that the success of CGEOR in a shale play depends on its fluid and fracture network properties.

Although SDEOR outperforms CGEOR for all the cases simulated with representative Bakken and Eagle Ford shale parameters, SDEOR has not been validated by field experiments and does not apply to thin shales. This is because the pair of slot-drilled horizontal fractures will be too close to be commercially viable.

Therefore, the present disclosure provides an EOR approach that is applicable in various tight rocks. The SDEOR system and method of the present disclosure may give IOR ratios of up to 4.17 within 8 years of production, even with fluid, matrix, and fracture properties that are representative of the Bakken shale. Accordingly, the SDEOR system and method of the present disclosure can be applied to any shale play, regardless of the rocks brittleness, prevailing stress states, presence or absence of natural fractures, etc. The present disclosure also provides equations for compositional simulation, summarization of how it is discretized and solved using the MATLAB Reservoir Simulation Toolbox (MRST) (Lie, 2019), and summarization of modeling natural fractures using 3D pEDFM and using the Alghalandis Discrete Fracture Network Engineering (ADFNE) code (Alghalandis, 2017) to generate several realizations of natural fracture networks, and perform fracture network connectivity analysis to understand the role of natural fractures in primary and enhanced oil recovery. The present disclosure evaluates the sensitivity of the SDEOR method to the uncertainty in fracture conductivity by simulating several realizations with extreme and stochastic val-

TABLE 1

A summary of simulation results for EOR gas injection into different shale oil formations

| Formation | $k_m$ (μd) | Injected Gas | Injection Mode | Production Period (yrs) | Increased Oil RF (%) | Reference |
|---|---|---|---|---|---|---|
| Middle Bakken | 1 | $CO_2$ | Huff 'n' puff | 18 | +2.56 | Zuloaga et al. (2017) |
| Middle Bakken | 1 | $CO_2$ | Continuous flooding | 18 | −1.79 | Zuloaga et al. (2017) |
| Middle Bakken | 20 | $CO_2$ | Huff 'n' puff | 20 | +5.9 (3 cycles) | Sun et al. (2019) |
| Eagle Ford | 0.9 | $CO_2$ | Huff 'n' puff | 20 | +8 ($D_2CO_2$ = 0.01 cm2/s) | Yu et al. (2019) |
| Eagle Ford | 0.334 | Field Gas | Huff 'n' puff | 5 | +8.75 (single well and 10 cycles) | Ganjdanesh et al. (2019) |

ues of fracture conductivity. The present disclosure evaluates the performance of the SDEOR when different gases are injected into a representative Bakken shale play, and systematically studies the controlling EOR mechanisms.

Figure 1B:
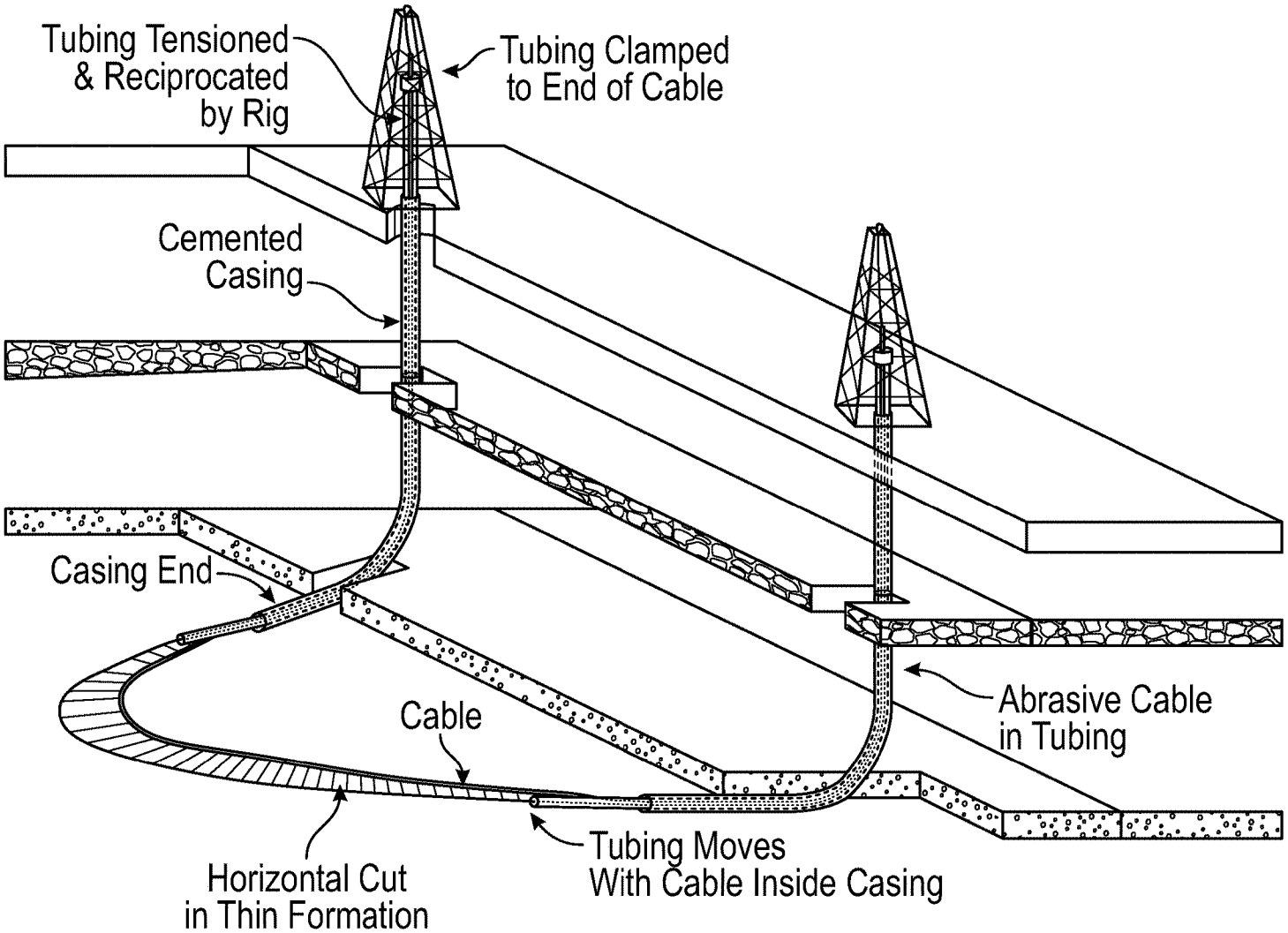
FIG. 1B (Prior Art)
FIG. 1B shows a schematic of a prior art slot-drilling completion system to create a horizontal fracture in a wellbore, employable by an embodiment of the present disclosure.

The slot-drill (SD) technology of the present disclosure includes a chain cutter that is pulled through massive rock outcrops. The proposed application of this concept to cut fractures in the subsurface involves the use of one or more wells. FIG. 1A illustrates an exemplary system with one wellbore employed by Carter and FIG. 1B illustrates an exemplary system with two wellbores. The exemplary wellbores of FIGS. 1A and 1B may be employed with the system and method of the present disclosure. The two wellbores are drilled either from two different wellheads or side-tracked from one well. The two wellbores may be connected at the toe (or end) using a hook and a ring-like steel tools. A flexible and tensioned cutting cable (for example, a wire saw) is then passed through one of the wellbore's ring-like structures and fished out from the other wellbore with the steel hook. The cable is then pulled back and forth from the wellhead to cut a slot-drilled fracture in the rock mass between the two wellbores. A single well may be employed to cut fractures in the horizontal direction, as shown in FIG. 1A.

In the SDEOR system and method of the present disclosure, gas is injected into horizontal fractures created close to the top of the reservoir, while oil is produced from parallel horizontal fractures created close to the bottom of the reservoir. To create these horizontal fractures regardless of the prevailing stress states in the reservoir, the present SDEOR system and method employs the use of the slot-drilling completion technique of FIG. 1A where the subsurface rock can be cut using tensioned abrasive cables attached to the drill pipe. Although two wells are required to create a slot-drill completion (as shown in FIG. 1B), only one of the wells is needed for primary production (as shown in FIG. 1A).

Figure 2:
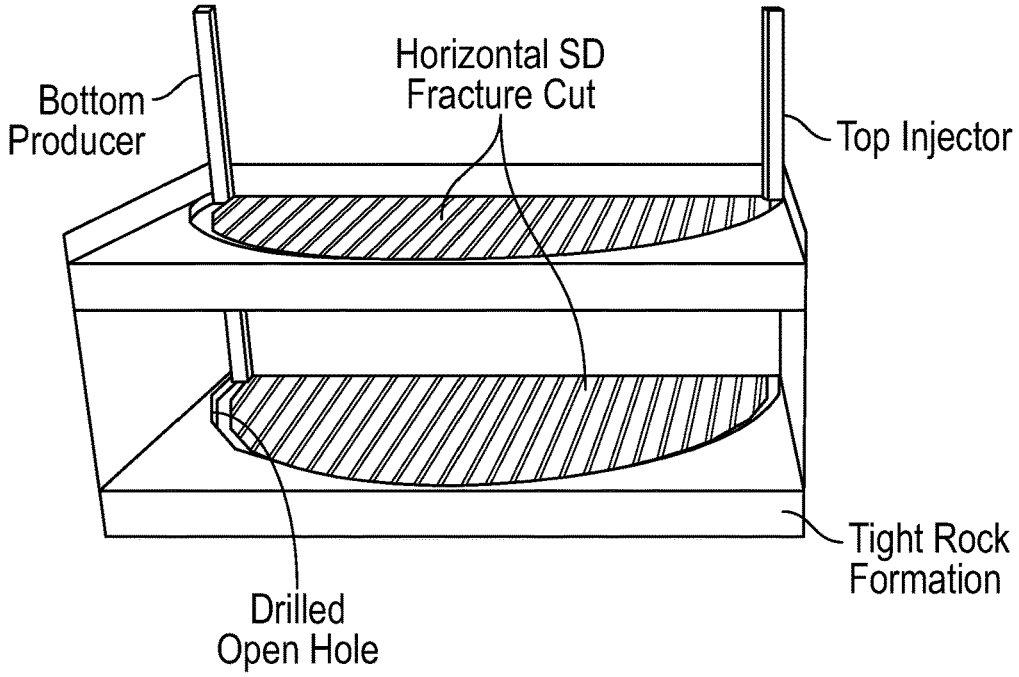
FIG. 2 shows a schematic of a slot-drilling enhanced oil recovery system, according to an embodiment of the present disclosure.

In another exemplary SDEOR system and method, both wells may be employed to create two parallel horizontal fractures, as shown in FIG. 2. After the two fractures are created, one of the wells get plugged at the bottom, and is only allowed to inject fluids at the top, while the other is open to flow from the bottom fracture. Although this work focuses on the injection of gases at the top while oil is produced from the bottom, it can also be set up to inject water at the bottom while oil is produced from the top. FIG. 2 illustrates the proposed SDEOR technology, where the gas/solvent is injected into the top injector (which is completed in the top fracture) and oil is produced from the bottom producer (which is completed in the bottom fracture).

Figure 3:
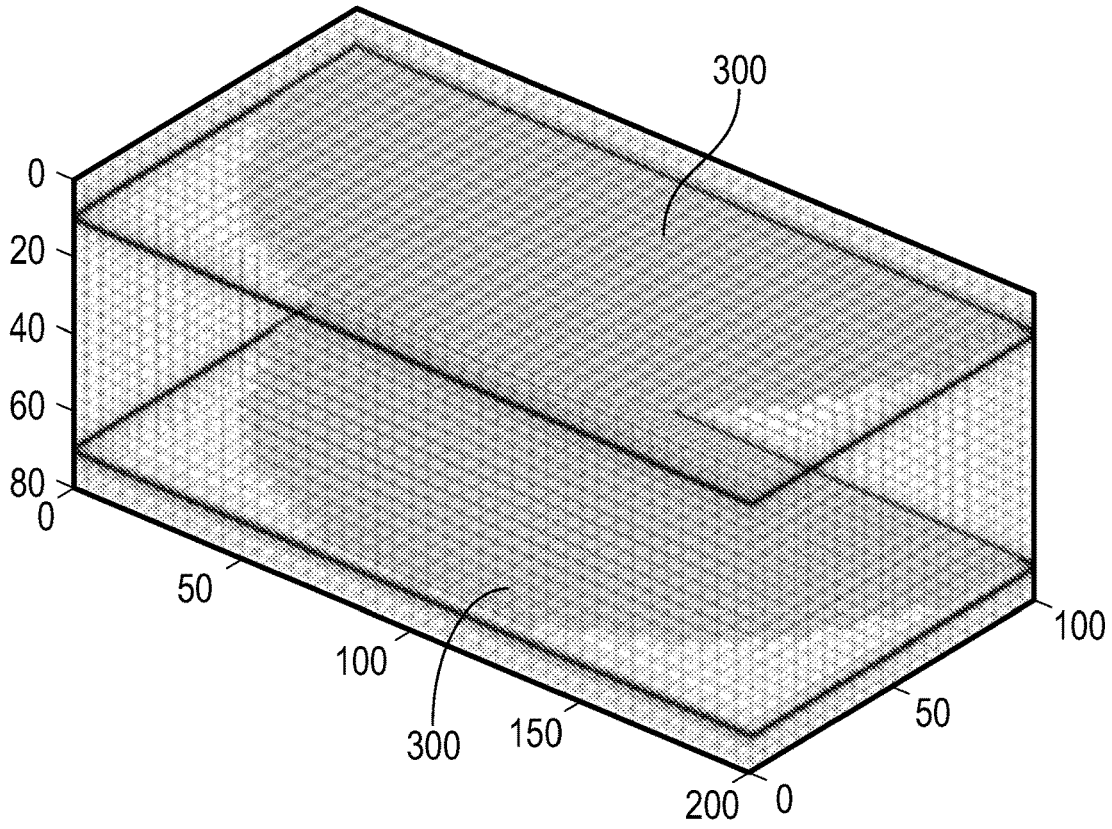
FIG. 3 shows a mesh of a simulation of a slot-drilling enhanced oil recovery system, according to an embodiment of the present disclosure.

FIG. 3 shows the mesh generated to model the simulation domain described in FIG. 2. FIG. 3 shows the meshing of the simulation domain for the proposed SDEOR technology of the present disclosure. The cell sizes are increased geometrically away from the fracture surfaces 300, located at 10 and 70 meters from the top of the reservoir. The two slot-drilled fractures are meshed explicitly, as shown at 300, and the size of the cells are increased geometrically away from fracture. This is to capture the expected transient behavior near the fracture surfaces. Considering that there is currently no technology available to find the location, size, orientation, and properties of all fractures in the subsurface, the SDEOR system and method of the present disclosure also involve the simulation of several realizations of natural fracture networks (in addition to the slot-drilled fractures). This will enable the quantification of the effect of these uncertainties on the effectiveness of the SDEOR method of the present disclosure.

To evaluate the performance of the SDEOR technology in shale oil reservoirs with realistic fracture networks, a compositional simulation may implement the 3D pEDFM presented in Olorode et al. (2020) and allows models several realizations of stochastic fracture networks created using ADFNE. The next section introduces the governing equations and the fracture model used to simulate these unconventional reservoirs with realistic natural fractures.

Natural Fracture Modeling: 3D-pEDFM

Although several models have been proposed to model fluid flow in naturally fractured reservoirs, the present disclosure employs embedded discrete fracture models (EDFM) because they are able to account for the properties and orientation of each individual fracture in a reservoir. The following description includes an introduction of EDFM proceeding to a discussion of its extension to a projection-based EDFM, which unlike EDFM, is able to model low-conductivity fractures accurately. EDFM uses the concept of non-neighboring connections (NNCs) to couple the flow of fluids in a fracture cell to that of its host (or embedding) matrix cell. The coupling occurs by adding a $q_i^{nnc}$ term to the semi-discrete form of the governing equation for compositional simulation, as follows:

$$\frac{V}{\Delta t}\left[\left(\phi\rho^l S^l X_i^l + \phi\rho^v S^v X_i^g\right)^{n+1} - \left(\phi\rho^l S^l X_i^l + \phi\rho^v S^v X_i^g\right)^n\right] + div\left(\rho^l X_i^l \vec{v}_l + \rho^v X_i^g \vec{v}\right)^{n+1} - \left(\rho^l X_i^l q^l + \rho^v X_i^g q^v\right)^{n+1} + q_i^{nnc} = R_i^{n+1}, \tag{1}$$

where $q_i^{nnc}$ is the mass rate of component i that is exchanged through the NNC (in units of mass per time). It is given as:

$$q_i^{nnc} = \sum_{m=1}^{N_{nnc}} A_m^{nnc} \sum_{\alpha=1}^{n_p} \frac{k_m^{nnc} k_{r\alpha}}{\mu^\alpha} \rho^\alpha X_i^\alpha \left[\frac{(p^\alpha - \rho^\alpha gz) - (p^\alpha - \rho^\alpha gz)_m^{nnc}}{d_m^{nnc}}\right], \tag{2}$$

where subscript m is an index from 1 to the total number of non-neighboring connections for each cell ($N_{nnc}$). The flow potentials of a cell and its non-neighboring cell are written as $(p^\alpha - \rho^\alpha gz)$ and $(p^\alpha - \rho^\alpha gz)^{nnc}$, respectively. To determine the transmissibility factor ($T^{nnc}$) between any pair of cells that are connected via non-neighboring connections, the present disclosure estimates the area ($A^{nnc}$), permeability ($k^{nnc}$), and distance ($d^{nnc}$) of the non-neighboring connections. This transmissibility factor is given as:

$$T^{nnc} = \frac{k^{nnc} A^{nnc}}{d^{nnc}}. \tag{3}$$

Figure 4A:
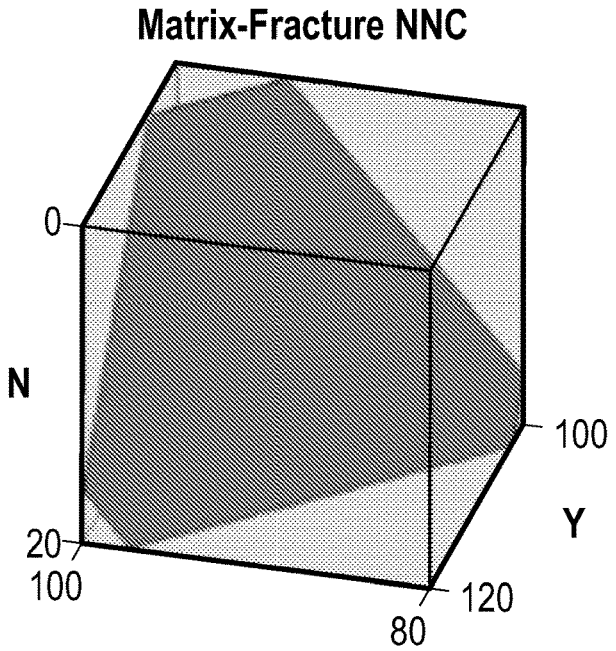
FIG. 4A (Prior Art)
FIG. 4A shows a schematic of non-neighboring connections in a known embedded discrete fracture model, according to employable by an embodiment of the present disclosure.
Figure 4B:
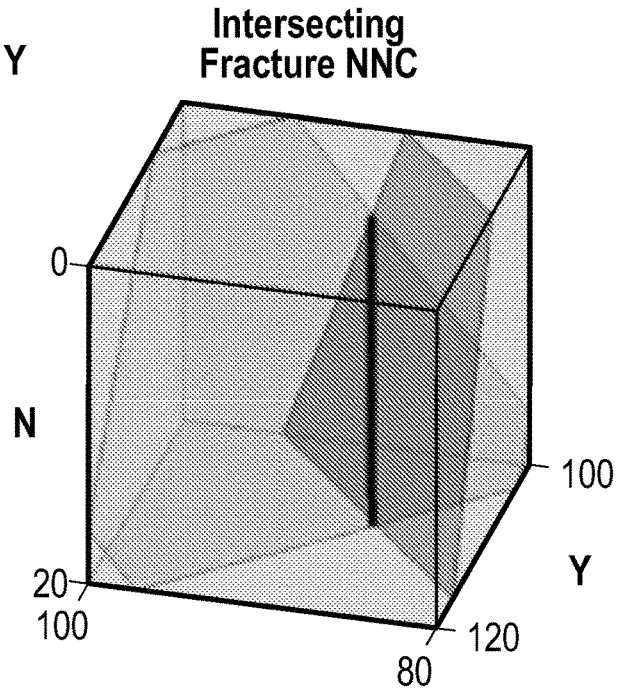
FIG. 4B (Prior Art)
FIG. 4B shows a schematic of non-neighboring connections in a known embedded discrete fracture model, employable by an embodiment of the present disclosure.
Figure 4C:
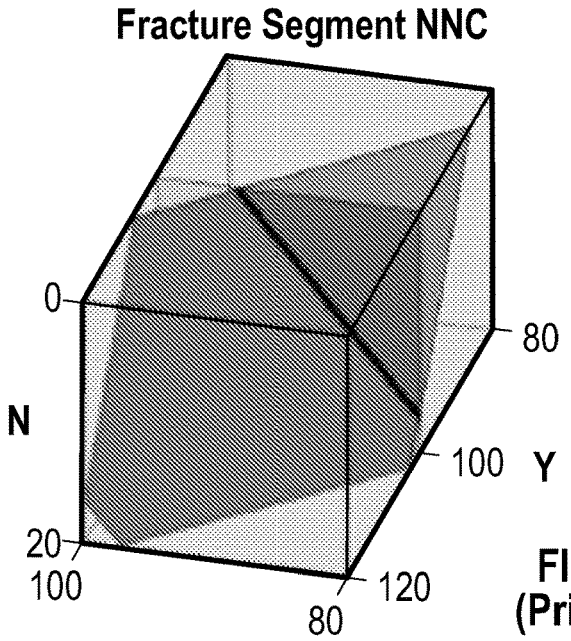
FIG. 4C (Prior Art)
FIG. 4C shows a schematic of non-neighboring connections in a known embedded discrete fracture model, employable by an embodiment of the present disclosure.

The equations to estimate $A^{nnc}$, $k^{nnc}$, and $d^{nnc}$ are different for different types of NNC. Moinfar et al. (2014) provides more details on these equations, as well as the expressions for the three types of NNCs in EDFM, which are shown in FIGS. 4A to 4C. FIG. 4A illustrates the NNC between a matrix and a fracture shell. FIG. 4B illustrates two fracture cells that belong to different fracture planes. FIG. 4C illustrates two fracture cells that are part of the same fracture plane. The projection-based EDFM (Tene, 2018) is based on an identification of neighboring projection matrix cells onto which each fracture cell is projected, in addition to the host matrix cell that contains the fracture cell. The selected neighboring cells are referred to as "projection matrix cells" and are selected based on a 3D projection algorithm. The pEDFM extends the EDFM by adding two more NNC transmissibilities, which enables it to capture the effects of low-conductivity fractures. The first of these is the projection-matrix/fracture transmissibility ($T_{pMF}$), which is given as:

$$T_{pMF} = \frac{A_{\perp x} K_{pMF}}{d_{pMF}}, \tag{4}$$

where the harmonic average of the projection matrix and fracture cell permeabilities ($K_{pMF}$) is given as:

$$K_{pMF} = \frac{K_{pM} K_f}{K_{pM} + K_f}. \tag{5}$$

Here, $d_{pMF}$ represents the distance between the centroid of the fracture and that of the projection cell, while $A_{\perp x}$ is the area of the fracture projection along each spatial dimension.

The projection-matrix/host-matrix transmissibility ($T_{pMM}$) is the second modification of the pEDFM, as is given as:

$$T_{pMM} = K \frac{A - A_{\perp x}}{\Delta \vec{x}_e}, \tag{6}$$

where $\Delta \vec{x}_e$ represents the cell size in all three spatial directions (for 3D systems), A is the area of the face between the projection and the host matrix cells, while $A_x$ is the projection area. Olorode et al. (2020) presents a 3D pEDFM algorithm, and provides further details on its implementation for compositional reservoir simulation.

Fracture Network Connectivity Analysis

Considering the significant role natural fractures play in the flow of fluids in tight rocks, a study is performed of fracture network connectivity based on the dimensionless connectivity indices given in Haridy et al. (2019). The main objective of this study is to ensure an unbiased evaluation of the SDEOR method of the present disclosure, regardless of the number, size, and other properties of the natural fractures simulated. Although Haridy et al. (2019) computed the different fracture indices for each cell in the reservoir, the present disclosure extends this approach to compute the connectivity, crossing, and extended connectivity indices for the entire simulation domain as follows:

$$CI = \frac{\text{Total number of fracture} - \text{fracture intersections in the reservoir domain}}{\text{Total number of fractures in the reservoir}}, \tag{7}$$

$$CR_{i,j,k} = \frac{\text{Total number of matrix face} - \text{fracture intersections in } x, y, \text{ and } z \text{ directions}}{\text{Total number of fractures in the reservoir}}, \tag{8}$$

$$\text{and } eCI_{i,j,k} = CR_{i,j,k} + CI. \tag{9}$$

In these equations, CI, $CR_{i,j,k}$, and $eCI_{i,j,k}$ are the connectivity, crossing, and extended connectivity indices, respectively. The subscripts i, j, and k are used to indicate that the crossing and extended connectivity indices are computed for the x, y, and z-directions. The connectivity index is computed by looping through all the fracture planes in the domain, counting the number of fracture-fracture intersections, and dividing that by the total number of fracture planes in the reservoir. The crossing index in the x direction ($CR_i$) is computed by looping through all the cell faces in the x-direction, counting the total number of fractures that these faces, and dividing this by the total number of natural fractures in the reservoir simulation domain. The same procedure is repeated for $CR_j$ and $CR_k$, except that we only use the y and z faces in these cases, respectively. The extended connectivity index ($eCI_{i,j,k}$) is computed as the summation of CI and $CR_{i,j,k}$.

The density of a fracture network can be represented by fracture intensity, which can be characterized using different measures, as in Niven and Deutsch (2010). In this work, fracture intensity (in units of 1/ft) is calculated by summing the areas of all the natural fractures in the reservoir ($A_i$), and dividing that by the bulk volume of the reservoir (V), as follows:

$$\text{Fracture Intensity} = \frac{\sum_{i=1}^{n} A_i}{V}. \tag{10}$$

The level of connectivity of a fracture network can be assessed by computing its "percolation threshold", which is the interval above which the fracture network begins to contribute significantly towards the production from the fractured reservoir.

Figure 5A:
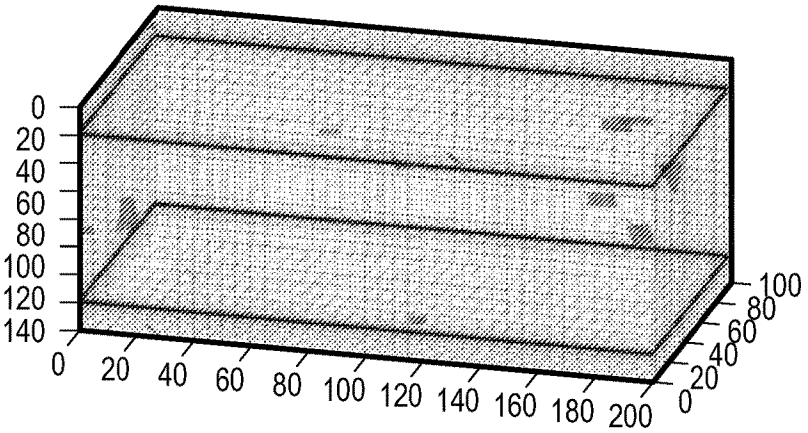
FIGS. 5A to 5D show schematics of stochastic fracture networks, according to an embodiment of the present disclosure.
Figure 5B:
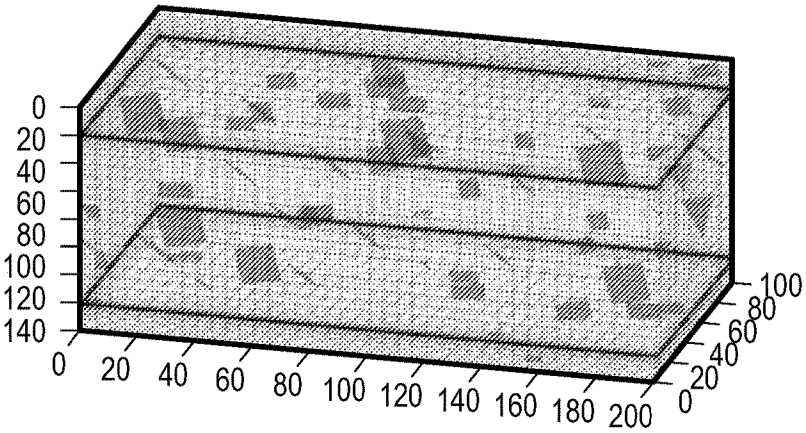
Figure 5C:
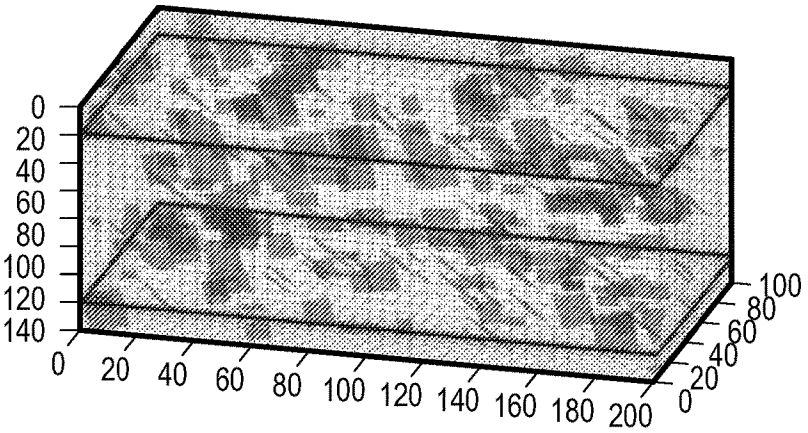
Figure 5D:
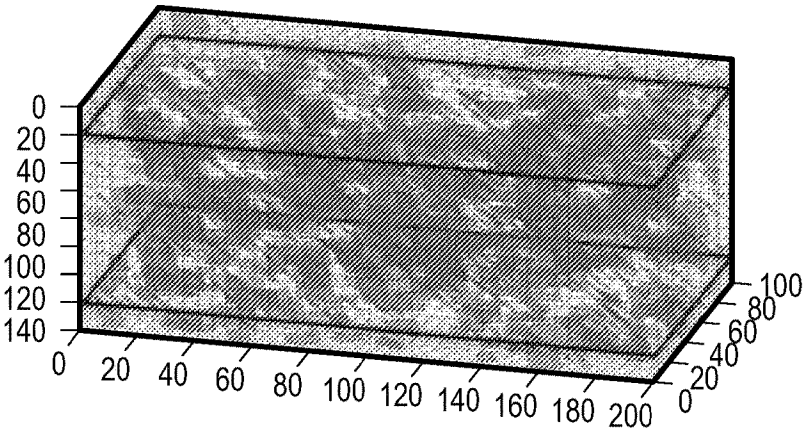
Figure 6:
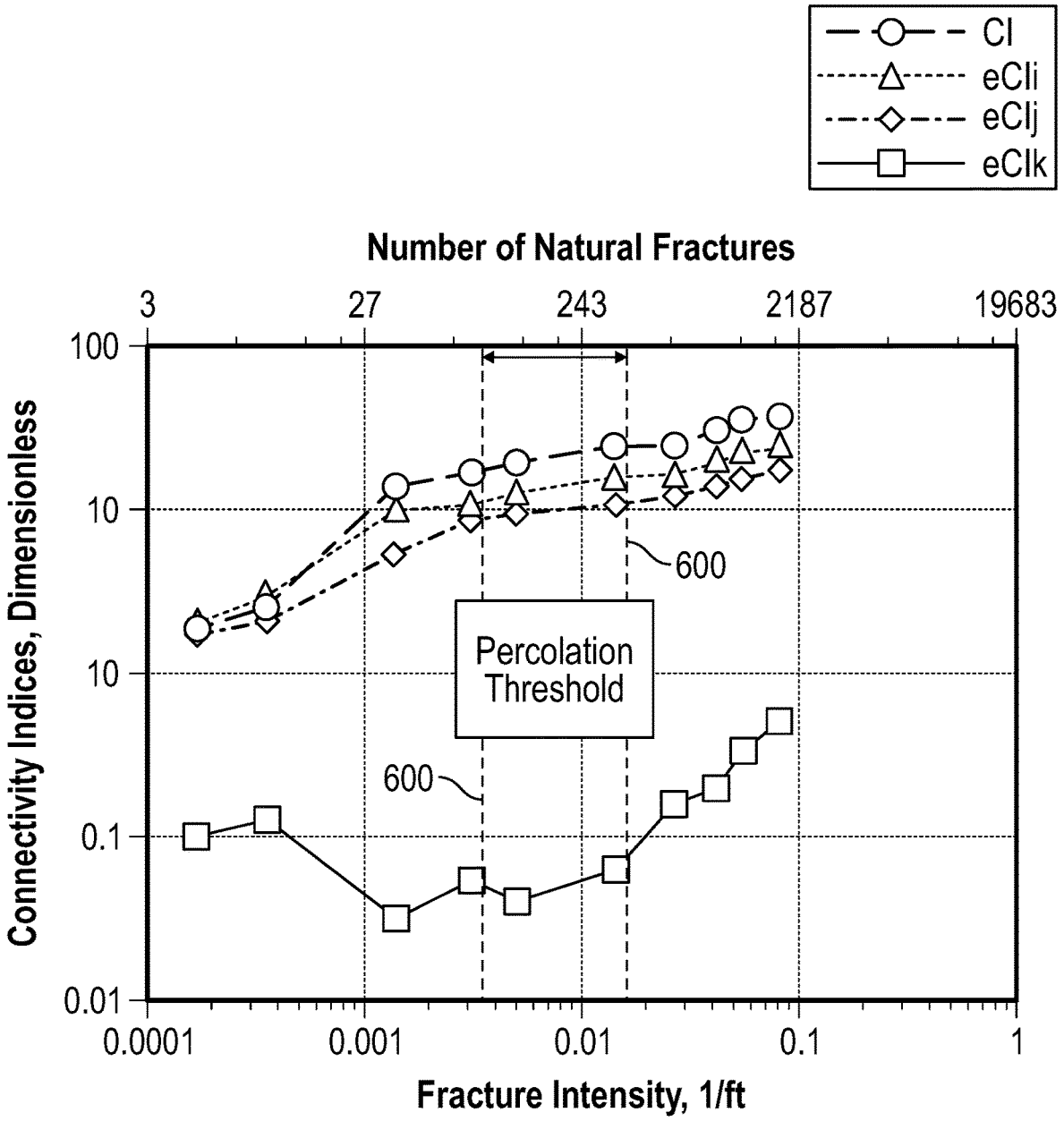
FIG. 6 shows a graph of connectivity indices as a function of fracture intensity, according to an embodiment of the present disclosure.

The steps required to determine the percolation threshold for a fractured reservoir stimulated using the SDEOR method of the present disclosure are as follows:

1. Set up a reservoir model such that each matrix cell has dimensions exceeding the average length of any given natural facture (NF) plane. Tables 2, B-1, and B-2 list the reservoir, binary interaction coefficients, and compositional data used in the model.
2. Increase the number of NFs in the reservoir, ranging from 8, 16, 32, 64, 128, 256, 512, 750, 1024, to 1500. A few of these realizations are shown in FIGS. 5A to 5C. The images of FIGS. 5A to 5C show stochastic fracture networks with 16, 64, 256, and 1024 natural fractures. Each image corresponds to one realization from a probabilistic distribution of the location, orientation, and size of the individual fractures that make up the fracture network with the specified number of fractures.
3. Compute CI, eCli,j,k and fracture intensity (as in Equations [7], [9], and [10]) for each realization.
4. Create a log-log plot of CI and eCIi,j,k against fracture intensity as shown in FIG. 6. FIG. 6 shows a log-log plot of CI and $eCI_{i,j,k}$ against fracture intensities. Each point in FIG. 6 corresponds to the natural fracture networks shown in FIGS. 5A to 5C. The dashed lines 600 indicate the fracture intensity range that defines the percolation threshold.
5. Determine the percolation threshold at the fracture intensity range, where CI transitions from a non-linear to a linear relationship (Haridy et al., 2019) that increases monotonically. This range is delineated by the two dashed lines 600 in FIG. 6.

Following the enumerated steps, the percolation threshold was determined to be at a fracture intensity between 0.005 and 0.014 $ft^{-1}$. This corresponds to having 70 to 260 natural fractures in the domain. At fracture intensity values above the percolation threshold, adding more stochastic fractures to the reservoir results in a significant change in oil production based on the increased fracture-fracture and fracture-matrix intersections. This change could be positive or negative, depending on value of the fracture conductivity, as demonstrated in the subsequent subsections.

Evaluation of Primary Recovery from Single Slot-Drilled Fracture.

To obtain useful insights on the role of gas injection in SDEOR technology in fractured tight rocks, a simulation is performed of eight years of primary oil production from a producing well that is completed using a slot-drill fracture near the bottom of the reservoir domain. These results provide a reference for the computation of the improved recovery obtained when gas is injected as proposed in SDEOR. Table 2 summarizes the input parameters for the shale-oil reservoir simulated in this section, while Tables B-1 and B-2 summarize the compositional fluid data for the simple three-component mixture simulated in all but the last section of the present disclosure. Although this mixture facilitates the computationally expensive studies in this work, the final section provides a study of the applicability of the SDEOR technology using representative data for a Bakken shale-oil reservoir.

Figure 7A:
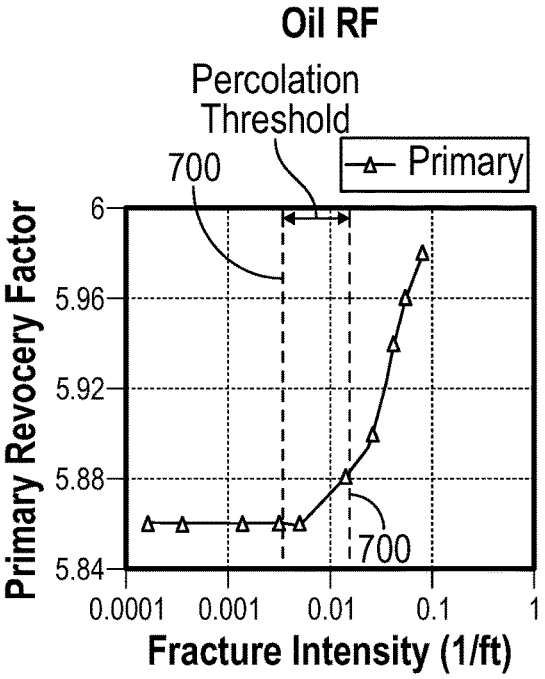
FIGS. 7A and 7B show a graph of oil recovery factor, according to an embodiment of the present disclosure.
Figure 7B:
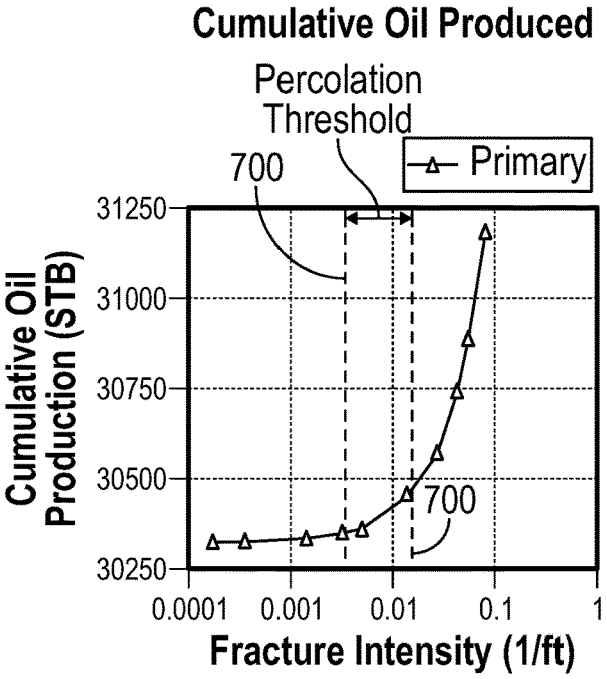

FIGS. 7A and 7B present the simulated oil recovery factor (RF) and cumulative oil production (Np) against fracture intensity. In FIGS. 7A and 7B, the oil recovery factor and cumulative oil production plots show increased production when the fracture intensity exceeds the percolation threshold. The dashed lines 700 indicate the percolation threshold. The results shown an exponential increase in Np when the fracture intensity exceeds the percolation threshold. The results are only illustrated up to 0.1 $ft^{-1}$ due to computational limitations, but the exponential trend indicates that the cumulative production will increase considerably at higher values of fracture intensity. These results show that fractures contribute to an increase in production (when their number exceeds the percolation threshold) because the connected fractures provide a preferential path for the flow of fluids towards the production well. Below the percolation threshold, the contribution of the fractures to oil production is negligible because the fractures are scanty and disconnected from one another, as shown in FIG. 5A and FIG. 5B.

TABLE 2

Reservoir input parameters

| Parameters | SI Unit | Field Unit |
|---|---|---|
| Reservoir model dimensions | 200 × 100 × 80 m | 656.2 × 492.1 × 393.7 ft |
| Mesh size | 5 × 5 × (0.01 – 4) m | 16.4 × 16.4 × (0.016 – 13.1) ft |
| Initial reservoir pressure, $p_i$ | 3.93e+7 Pa | 5,700 psia |
| Wellbore flowing pressure, $p_{wf}$ | 1.7237e+7 Pa | 2,500 psi1 |
| Reservoir temperature | 353 K | 175° F. |
| Matric permeability, $k_m$ | 9.87e−18 $m^2$ | 1e−2 md |
| Matrix porosity, $\phi$ | 0.07 | 0.07 |
| Injection rate, $q_{inj}$ | 0.00615 $m^3/s$ | 18,800 scf/D |
| Well radius, $r_w$ | 0.1 m | 0.33 ft |
| # NFs (base case) | 300 | 300 |
| NF porosity, $\varphi_{NF}$ | 0.5 | 0.5 |
| NF permeability, $k_{NF}$ | 9.87e−16 $m^2$ | 1 md |
| NF aperture, $w_{NF}$ | 3.05e−3 m | 0.01 ft |
| # SD fractures | 2 | 2 |
| # SD fracture porosity, $\varphi_{SD}$ | 0.33 | 0.33 |
| SD fracture permeability, $k_{SD}$ | 9.87e−12 $m^2$ | 10 D |
| SD fracture aperture, $w_{SD}$ | 0.01 m | 0.033 ft |
| SD fracture spacing | 60 m | 196.85 ft |

Figure 8A:
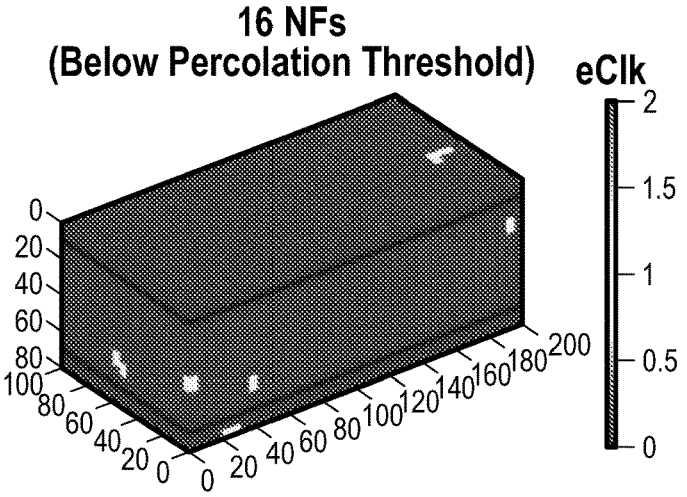
FIGS. 8A and 8B show a plot of connectivity indices, according to an embodiment of the present disclosure.
Figure 8B:
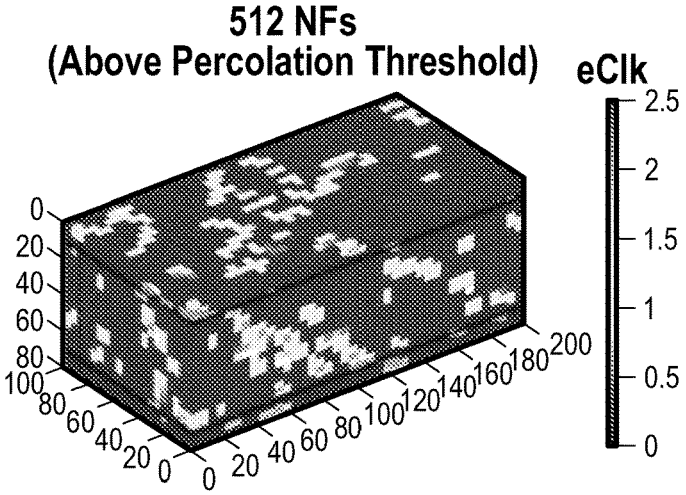

To explain why natural fractures do not contribute appreciably to production when the fracture connectivity is below the percolation threshold, the connectivity indices are computed in Equations [23], [24], and for each cell, as in Haridy et al. (2019). FIGS. 8A and 8B presents the $eCI_{k_{cell}}$ values for 16 and 512 natural fractures, which are respectively below and above the percolation threshold. The plots of $eCI_k$ for each matrix cell show the poor and high fracture connectivities at (left) 16 and (right) 512 natural fractures, respectively. The focus on the extended connectivity index in the z-direction is because the gravity drainage mechanism which dominates the SDEOR process acts in this direction. FIG. 8A indicates that the system with 16 natural fractures has limited fracture connectivity because of the zero values of $eCI_k$ in most of the matrix cells. In contrast, FIG. 8B shows a system of 512 natural fractures, where the $eCI_k$ values are greater than zero in several matrix cells. Therefore, the $eCI_k$ profile provides a visual evidence for the significant connectivity of the fractures in reservoirs that have fracture intensities above the percolation threshold. It is also in agreement with the results presented previously in FIGS. 7A and 7B.

The next two sections focus on the evaluation of the near-term (8 years) and long-term (60 years) performance of SDEOR technology. The objective is to understand the physical mechanisms that control the short- and long-term performance of SDEOR in fractured tight rocks.

Short-term Simulation Studies of the Application of SDEOR in Fractured Shale Oil Reservoirs This subsection presents the results of the simulation of 8 years of methane gas injection into a slot-drilled fracture close to the top of the fractured reservoir while simultaneously producing oil from the slot-drilled fracture close to the bottom of the reservoir. To evaluate the robustness of the SDEOR technology in naturally fractured reservoirs, we simulated several realizations of the natural fracture network. This work also accounts for the fact that the permeability/conductivity of natural fractures could vary widely, ranging from sealing to highly conductive fractures, as shown in Table 3.

TABLE 3

Different NF network conductivities for $k_m$ = 1e−2 mD.

| NF Network Type | NF Permeability (md) | NF Conductivity (md · ft) |
|---|---|---|
| Conductive | 10 | 1 |
| Sealing | 1e−5 | 1e−6 |

Study of SDEOR Performance in Reservoirs with Only High-Conductivity Natural Fractures.

Figure 9:
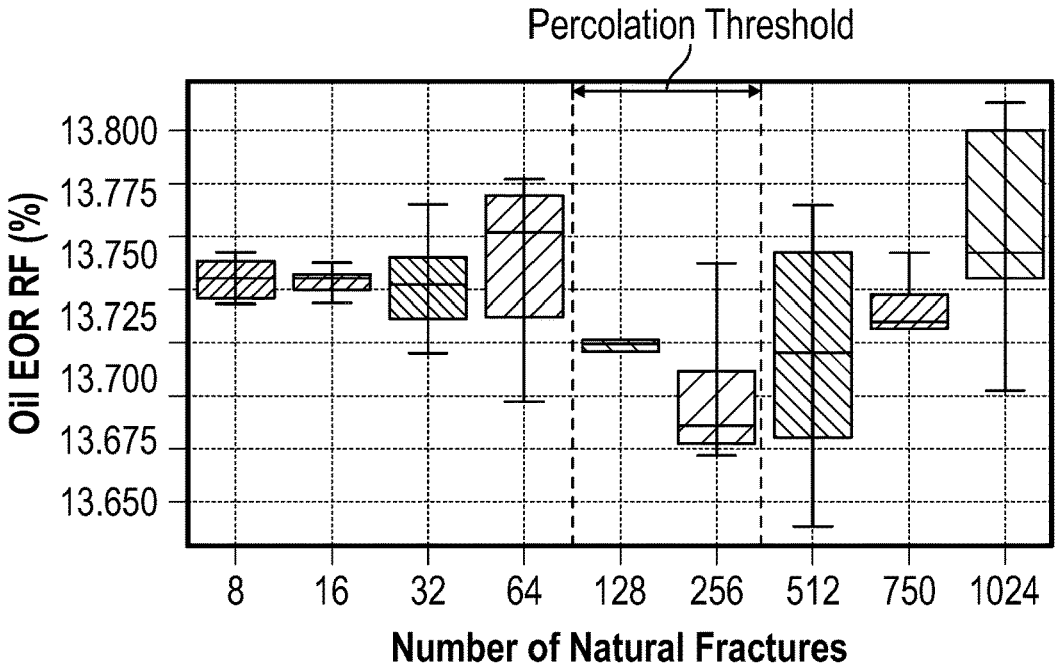
FIG. 9 shows a box plot of percolation threshold, according to an embodiment of the present disclosure.

FIG. 9 provides a box-plot that quantifies the uncertainty in the recovery factor from SDEOR in a reservoir model with several realizations of only highly conductive natural fractures with a permeability of 10 mD, as shown in Table 3. It shows that within the 8 years of simulated production, the recovery factor remains above 13.64%, regardless of the number of fractures simulated. This indicates that the proposed SDEOR method is applicable regardless of the amount of conductive natural fractures in the reservoir. As the number of conductive fractures increases above the percolation threshold, the recovery factor actually increases slightly. This is in agreement with the role of fractures in enhancing oil recovery in a gravity drainage process. Comparing the SDEOR recovery factor to its corresponding value during primary recovery (which is 5.9% from FIG. 7A), it is clear that methane gas injection through the proposed technology of the present disclosure results in a twofold increase in production over only 8 years of production.

The box plots of FIG. 9 indicate a small variation in the oil recovery factor as the number of high-conductivity fractures increases from 8 to 1024. Several realizations are simulated to quantify the uncertainty associated with different realizations of these conductive natural fracture networks.

Figure 10A:
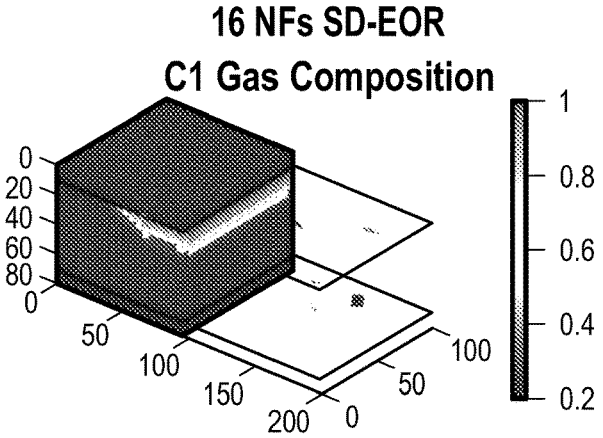
FIGS. 10A and 10B show a reservoir grid visualization, according to an embodiment of the present disclosure.
Figure 10B:
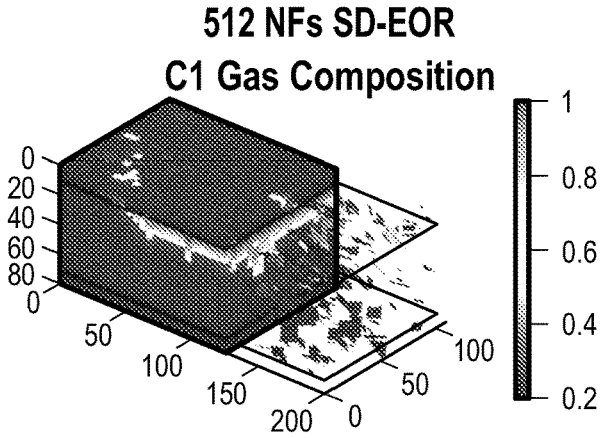

To provide further insight into the SDEOR process in fractured shale-oil reservoirs, a profile of methane gas mole fraction is shown in FIGS. 10A and 10B. FIG. 10A shows an almost piston-like displacement when the number of fractures in the domain are negligible (16 NFs in this case). However, when the number of natural fractures exceeds the percolation threshold, as in the image of FIG. 10B, the injected methane gets diverted to various parts of the reservoir. Here, the network of 512 NFs transports the methane gas towards the top of the formation due to buoyancy. This could lead to the formation of a secondary gas cap if the process is simulated for a much longer duration than the 8-year period simulated in this case. Subsequent sections involve simulating injection and production for 60 years, in order to study the long-term performance of the SDEOR technology of the present disclosure. FIGS. 10A and 10B show a reservoir grid visualization for $C_1$ gas composition by the end of 8 years SDEOR simulation for conductive fracture networks: 16 NFs case (a) and 512 NFs case (b). Adding more NFs beyond the percolation threshold affects oil recovery under the SDEOR technology.

Study of SDEOR Performance in Reservoirs with Only Low-Conductivity Natural Fractures.

Figure 11:
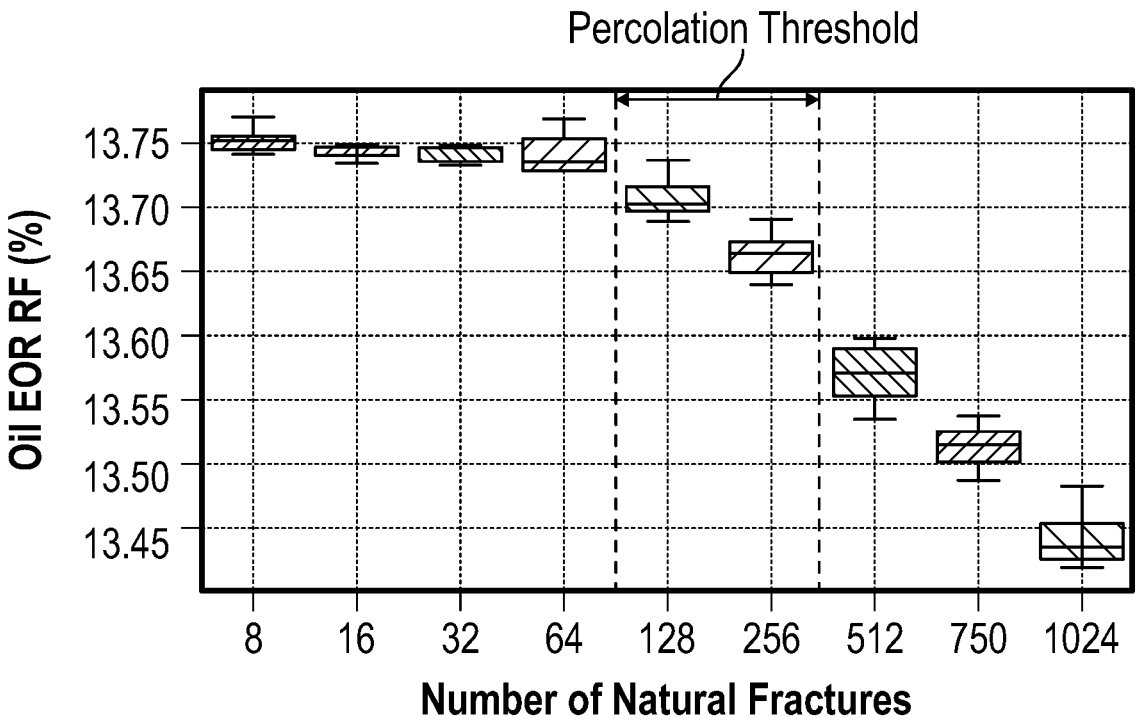
FIG. 11 shows a box plot of percolation threshold, according to an embodiment of the present disclosure.

In some examples, a simulation of several realizations of sealing fractures only with a permeability of 1e-5 mD, as shown in Table 3, is performed. FIG. 11 provides a box-plot that shows how the oil recovery factor for the SDEOR changes as the number of these sealing fractures increases. The results show that although the oil recovery factor decreases slightly as the number of fractures increases, the SDEOR technique of the present disclosure provides a two-fold increase in recovery (in comparison to the primary recovery factor of 5.9%) even with up to 1024 sealing fractures. These box plots of FIG. 11 quantify the effect of the uncertainty associated with different realizations of low-conductivity natural fracture networks. It shows a negligible decline in the recovery factor as the number of sealing fractures increase.

Study of SDEOR Performance in Fractured Reservoirs.

Figure 12:
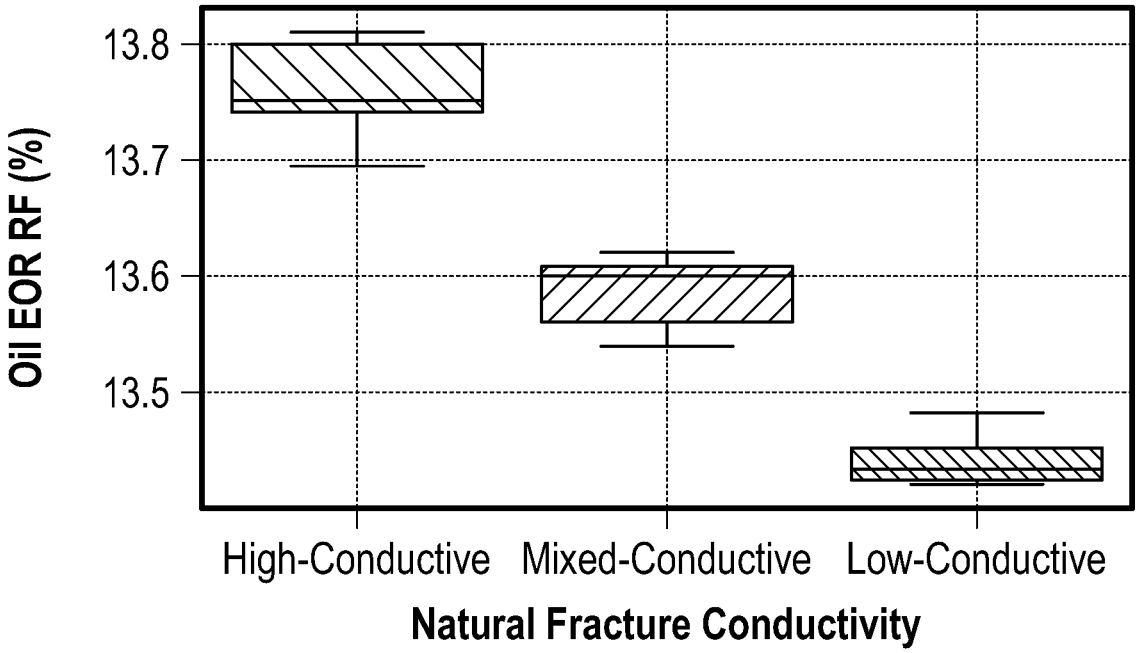
FIG. 12 shows a box plot of oil enhanced oil recovery RF percentage and natural fracture conductivity, according to an embodiment of the present disclosure.
Figure 13:
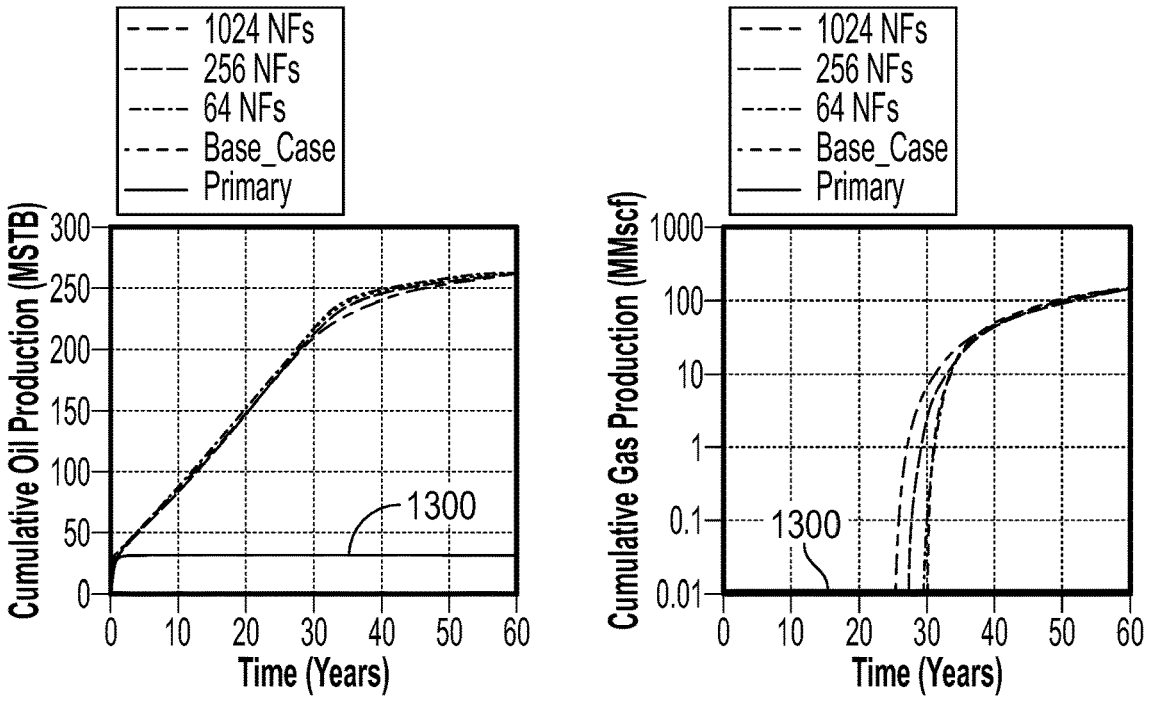
FIG. 13 shows graphs of cumulative gas production, according to an embodiment of the present disclosure.

Considering that the fractures in shale-oil reservoirs were formed under different prevailing stress states and at different points in its geologic history, fracture conductivity can vary over a wide range. Some fractures are conductive under the current stress state while others (that were previously active when formed) could be inactive or sealing in the prevailing stress state today. To account for this uncertainty in fracture conductivity, a simulation is performed of a well with 1024 fractures, which have a mix of high- and low-conductivity fractures. The high-conductivity fractures have permeability values that are sampled from a normal distribution with a mean of 82 mD and standard deviation of 52 mD, while the low-conductivity fractures have a mean and standard deviation of 9 nD and 6 nD, respectively. The aperture ($w_f$) of each fracture in the network is computed from the cubic law for fracture permeability ($K_f$) as follows:

FIG. 12 provides a box-plot that shows the oil recovery factor for this case with mixed-conductivity fractures, in addition to the high- and low-conductivity fracture cases from the previous two subsections. In all three cases, the change in the recovery factor for the SDEOR is minimal, indicating the robustness of this technology, regardless of the uncertainty in the fracture network. The next section focuses on the long-term performance of the SDEOR technology, and shows simulation results for up to 60 years of production. These box plots of FIG. 12 indicate the robustness of the SDEOR technology of the present disclosure in tight rocks with 1024 fractures of high, low, and mixed conductivity values. For this extreme case of 1024 NFs, the EOR recovery factor only varies from 13.42% to 13.81% after 8 years of simulation Long-Term Simulation Studies of the Application of SDEOR The long-term performance of the proposed SDEOR technology in fractured shale-oil reservoirs by simulating up to 60 years of production was also assessed. FIG. 13 presents the plots of the cumulative oil and gas production for a base-case simulation with no natural fractures, a primary recovery case, as well as a case with 64 natural fractures (which is below the percolation threshold), an intermediate case of 256 natural fractures, and another with 1024 fractures, which is well above the percolation threshold determined from the previous subsection. Compared to the primary recovery line 1300, FIG. 13 shows that the SDEOR method of the present disclosure results in a drastic increase in cumulative oil production, regardless of the number of natural fractures in the reservoir. Performing the simulation for up to 60 years shows the long-term effectiveness of the proposed technology because the cumulative oil production increases at a constant rate for 30 years. It is worth noting that the injected gas does not break through before approximately 25 years of production (even with as many as 1024 conductive natural fractures) and the cumulative gas production is the same in all SDEOR cases after 40 years of production. This is because of the role gravity plays in stabilizing the gas front and preventing early gas breakthrough through the fracture network. Unlike primary recovery from fractured rocks, where a higher number of conductive fractures typically yields more oil production, enhanced oil recovery from fractured rocks could result in lower oil production due to earlier gas breakthrough. The highly conductive fractures create increases in the anisotropy and heterogeneity of the system, resulting in a less piston-like displacement. This reduced sweep efficiency of the injected gas consequently yields earlier gas breakthrough at higher numbers of conductive fractures, as shown in FIG. 13. The very small differences between the cumulative oil production results are inconclusive because of the uncertainties associated with the stochastic nature of the fracture networks. These performance plots of FIG. 13 show the long-term effectiveness of the SDEOR technology, regardless of the presence of natural fractures. The results show that the oil production does not decline until after 30 years, and gas does not break through until after 25 years.

Figure 14:
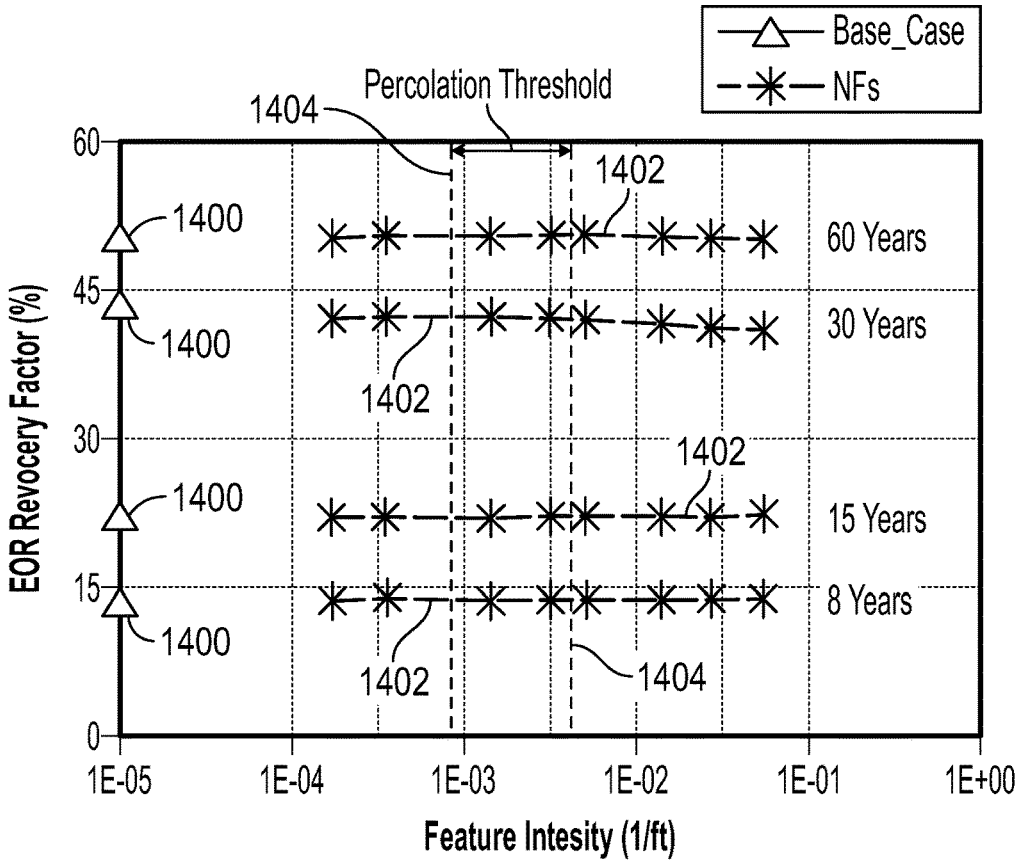
FIG. 14 shows a graph percolation threshold, according to an embodiment of the present disclosure.
Figure 15A:
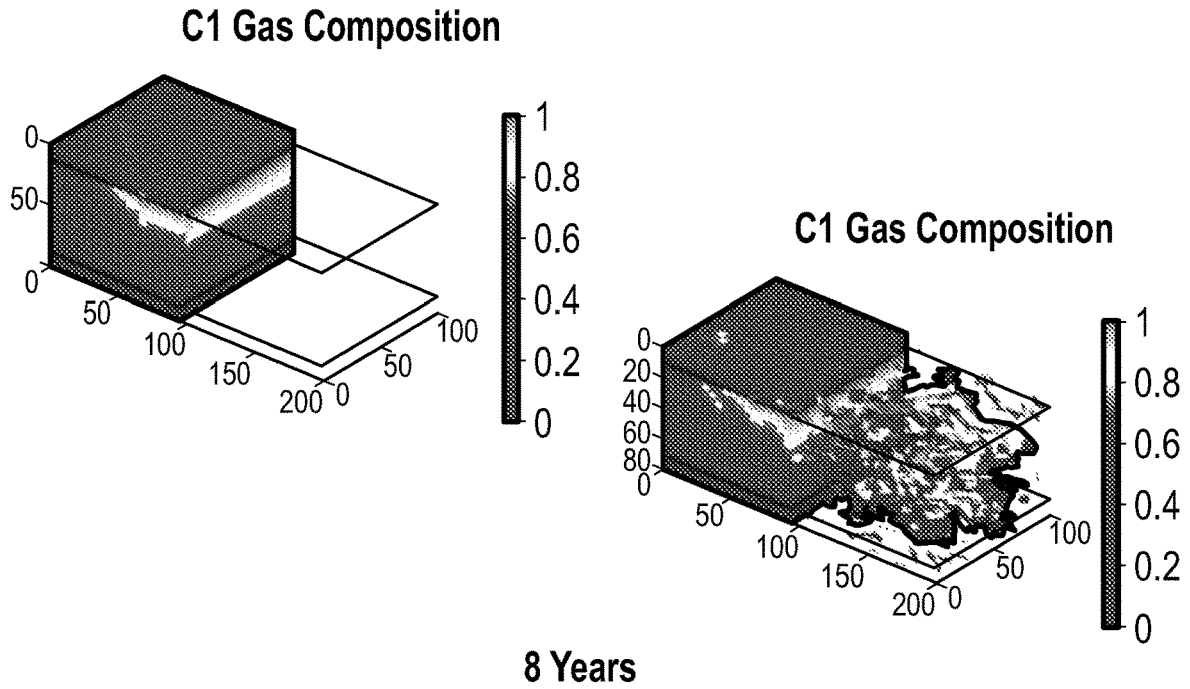
FIGS. 15A to 15D show profiles of methane gas composition, according to an embodiment of the present disclosure.
Figure 15B:
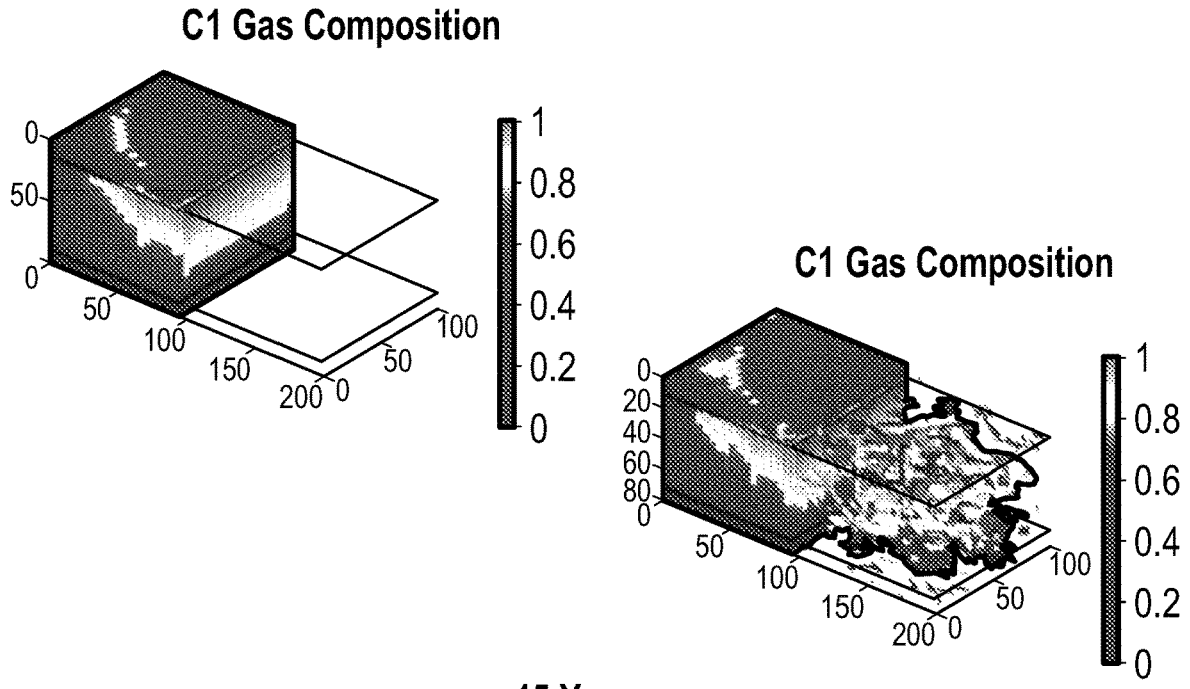
Figure 15C:
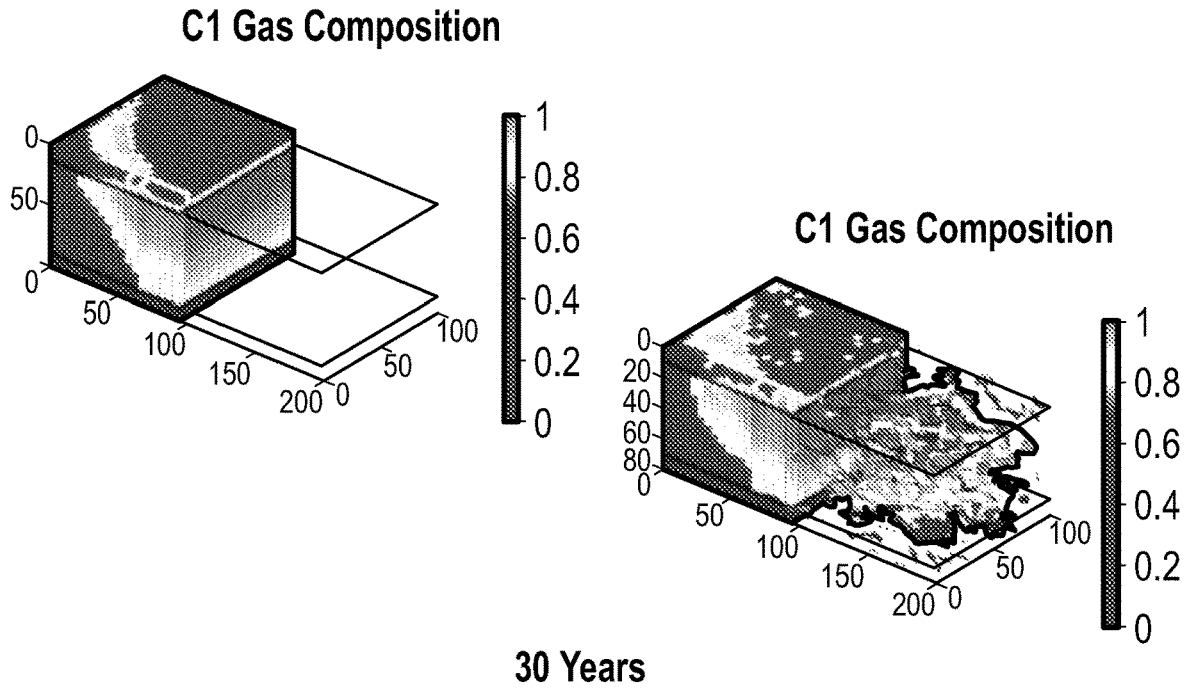
Figure 15D:
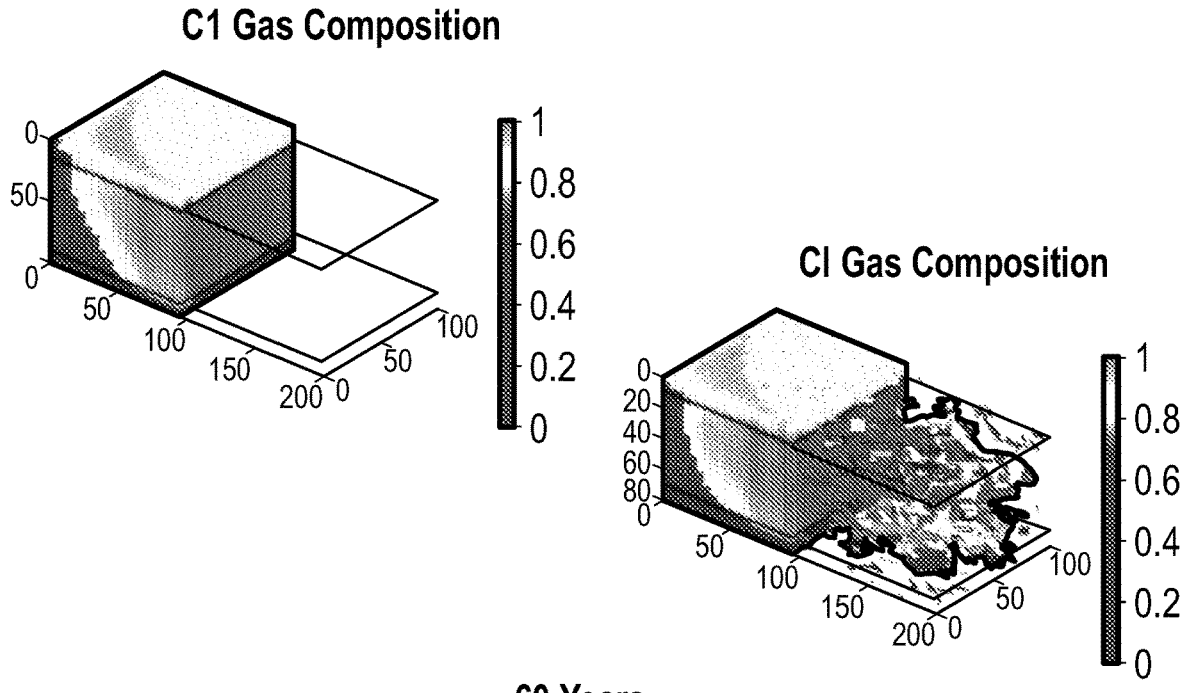

To further show the robustness of the SDEOR method of the present disclosure in the presence of natural fractures ranging from 0 to 1024 and at different times in the life of the reservoir (at 8, 15, 30, and 60 years), we provide a plot of the SDEOR recovery factor in FIG. 14. The nearly horizontal nature of this plot in the near and long term buttresses the conclusion that the recovery does not depreciate appreciably regardless of the presence or amount of natural fractures in the reservoir. The triangles 1400 plotted on the y axes correspond to the base case with no natural fractures, which technically corresponds to a case with zero fracture intensity. The horizontal lines 1402 in FIG. 14 show that the EOR recovery factor stays almost constant regardless of the fracture intensity, but increases over time as expected. The triangles 1400 on the y-axis indicate the corresponding recovery factor for a case with no fractures (zero fracture intensity). The percolation threshold is shown as the interval between the two lines 1404.

FIGS. 15A to 15D show the time evolution of the injected methane gas profile after 8, 15, 30, and 60 years in a reservoir with no natural fractures (base case) and another with 1024 fractures. As time advances, the injected methane composition migrates towards the bottom producer, while some of this gas also moves to the top of the reservoir due to buoyancy. These profiles of FIGS. 15A to 15D show how the methane gas composition evolves for a base case without natural fractures (left column) and for a case with 1024 conductive fractures (right column).

Table 4 summarizes the performance results of the SDEOR technology by comparing its recovery factor with those from primary production. We also provide the change in recovery factor (relative to primary recovery), as well as the IOR ratio, which can be as high as 8.58 after 60 years of production. To show the game-changing potential of the SDEOR technology in comparison to the application of CGEOR in use today, the next section provides a comparison of both technologies using the same reservoir model.

TABLE 4

SDEOR performance summary under different flooding periods in a reservoir with 1024 conductive NFs.

| Gas Flooding Period (years) | Primary Oil RF | SD-EOR Oil RF (1024 NFs) | Increased Oil RF (5) | IOR Ratio |
|---|---|---|---|---|
| 8 | 5.48 | 13.75 | +8.27 | 2.37 |
| 15 | 5.48 | 22.15 | +16.67 | 3.79 |
| 30 | 5.48 | 40.95 | +35.47 | 6.94 |
| 60 | 5.48 | 50.14 | +44.66 | 8.58 |

Performance Comparison Between CGEOR and SDEOR Technology

Figure 16:
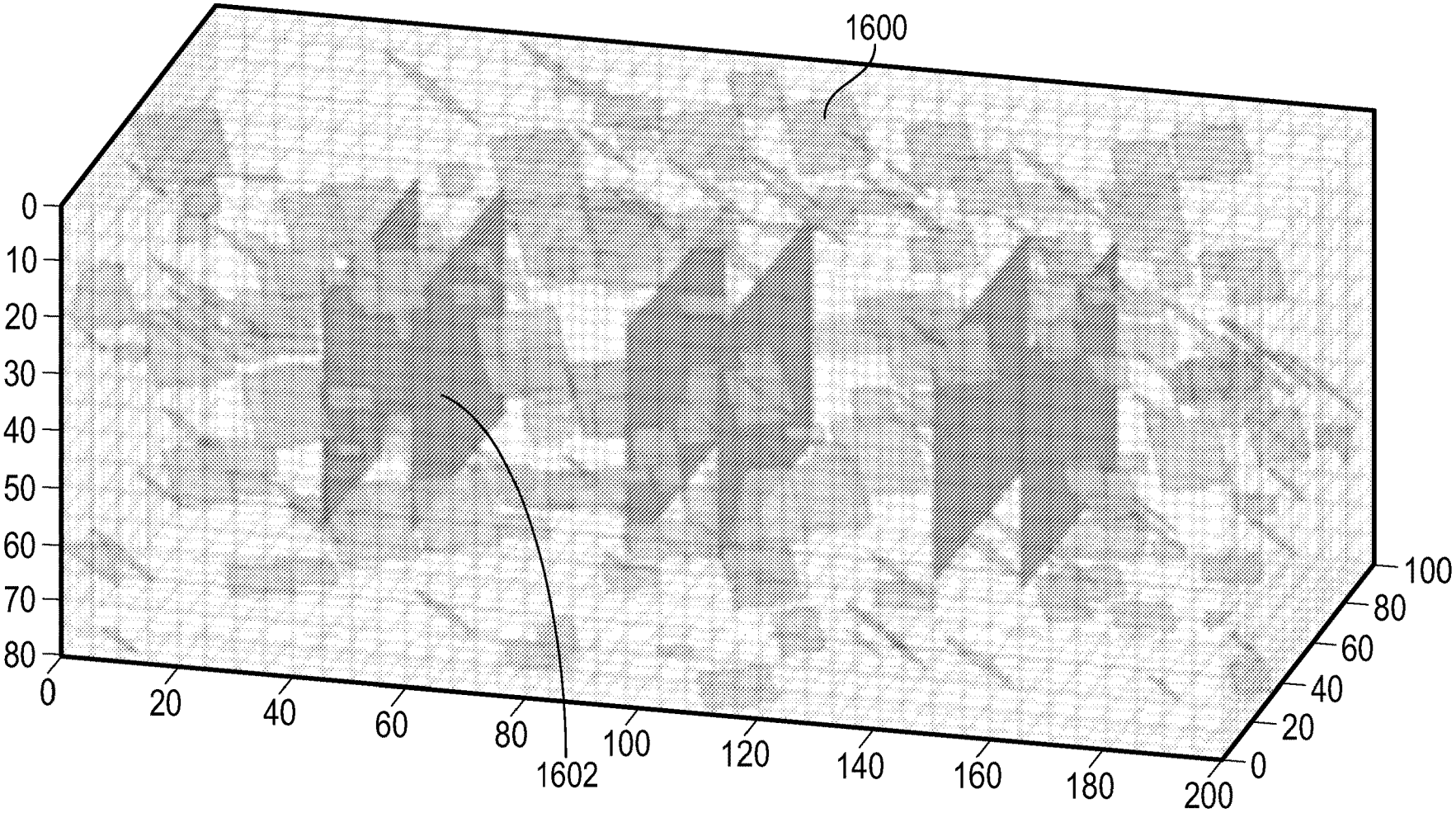
FIG. 16 shows a graph of the simulation domain for the CGEOR method, according to an embodiment of the present disclosure.

What follows compares the production performance of the SDEOR technology and the CGEOR method used in multistage hydraulically fractured (MSHF) horizontal wells. The compositional fluid parameters and binary interaction coefficients used in both SDEOR and CGEOR models are provided in Tables B-1 and B-2. To make a meaningful comparison between these two EOR technologies, the total surface area of all the fractures in the CGEOR model shown in FIG. 16 is equal to the area of one slot-drilled fracture shown in FIG. 3. The image of FIG. 16 shows the simulation domain for the CGEOR method. The natural fractures are shown as planes 1600, while the hydraulic fractures are shown as planes 1602. The completion parameters for the slot-drilled fracture are presented in Table 2, while those for the MSHF wells are summarized in Table 5. Unlike the previous SDEOR simulation results presented in previous sections, this case was simulated at the same injection and flowing bottomhole pressures for the CGEOR case (in Table 5). Although methane gas is injected in both methods, SDEOR involves continuous gas injection, whereas in CGEOR, there is simulated injection, soaking, and production for 25, 5, and 70 days, respectively. As reported in Jacobs et al. (2019), this approach of minimizing the duration of injection and soaking is typically optimal in CGEOR. Accordingly, an optimal CGEOR operation schedule is employed for the simulation used in the comparison.

TABLE 5

Input parameters for CGEOR in MSHF completion

| Parameters | SI Unit | Field Unit |
|---|---|---|
| Injection pressure, $P_i$ | 4.6195e+7 Pa | 6,700 psia |
| Wellbore flowing pressure, $P_{wf}$ | 1.7237e+7 Pa | 2,500 psia |
| Fracture half-length, $x_f$ | 30 m | 98.4252 ft |
| Fracture width, $w_f$ | 0.003 m | 0.00984 ft |
| Cluster spacing | 15 m | 49.21 ft |
| Fracture spacing | 37.5 m | 123.03 ft |
| Fracture permeability, $k_f$ | 9.87e−13 $m^2$ | 1e3 md |
| Fracture porosity, $\varphi_{frac}$ | 0.5 | 0.5 |
| Well radius, $r_w$ | 0.1 m | 0.32 ft |
| Injection period (Jacobs 2019) | 25 days | 25 days |
| Soaking period | 5 days | 5 days |
| Production period | 70 days | 70 days |
| Cycle duration | 100 days | 100 days |

Figure 17:
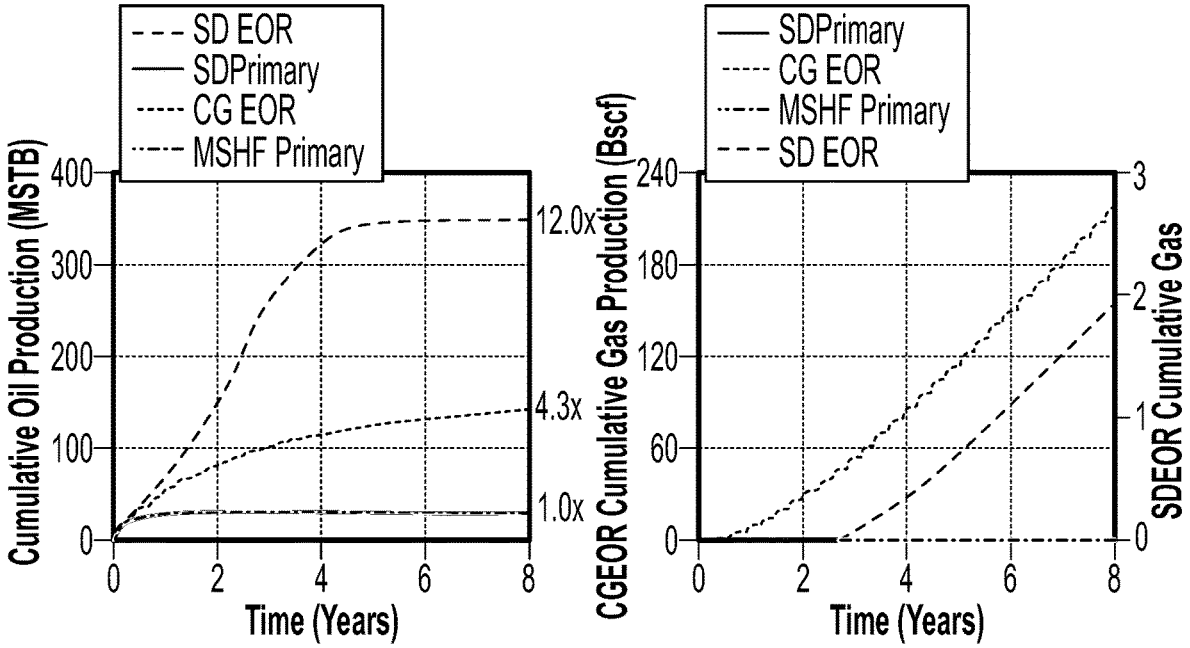
FIG. 17 shows graphs of SDEOR and CGEOR cumulative oil production, according to an embodiment of the present disclosure.

FIG. 17 shows that the primary production from both slot-drilled and hydraulically fractured wells are similar because both methods model the same total fracture surface area. The other plots in FIG. 17 show that the SDEOR method of the present disclosure yields much higher oil production and less gas than CGEOR. The increase oil production could yield a sharp increase in the revenue from unconventional oil reservoirs, while the reduced gas production will minimize the costs of handling the associated gas. The slope of the left image changes after 2.3 years because the gas breaks through as shown in the right image. Table 6 further quantifies the magnitude of the increase in recovery from the SDEOR in comparison to the CGEOR technology. The results show that over the first eight years of production, the proposed SDEOR technology of the present disclosure yields 2.7 times more oil than the CGEOR method and 12 times more oil than primary oil production. This drastic increase in the EUR from SDEOR in comparison to CGEOR could be attributed to the role gravity plays in stabilizing the gas front in fractured unconventional reservoirs, as well as the fact that CGEOR only produces oil for a fraction of the life of the well and is either shut-in or injecting gas at other times.

TABLE 6

Performance comparison between SDEOR and CGEOR after 8 years for a simple fluid mixture.

| Recovery Mechanism | Oil RF (%) | EUR (Mstb) | IOR Ratio |
|---|---|---|---|
| Primary | 6 | 30 | N/A |
| CGEOR | 26 | 131 | 4.3 |
| SDEOR | 70 | 352 | 12 |

Figure 18:
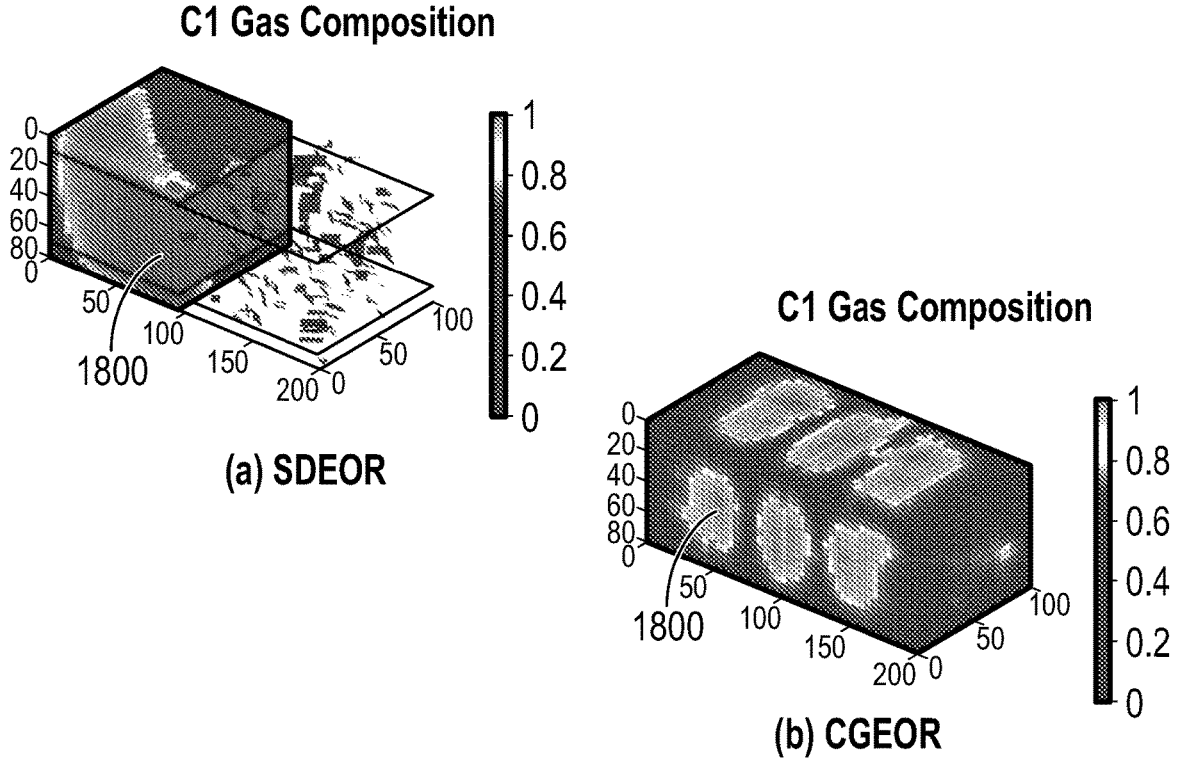
FIG. 18 shows profiles of methane gas profile, according to an embodiment of the present disclosure.
Figure 19:
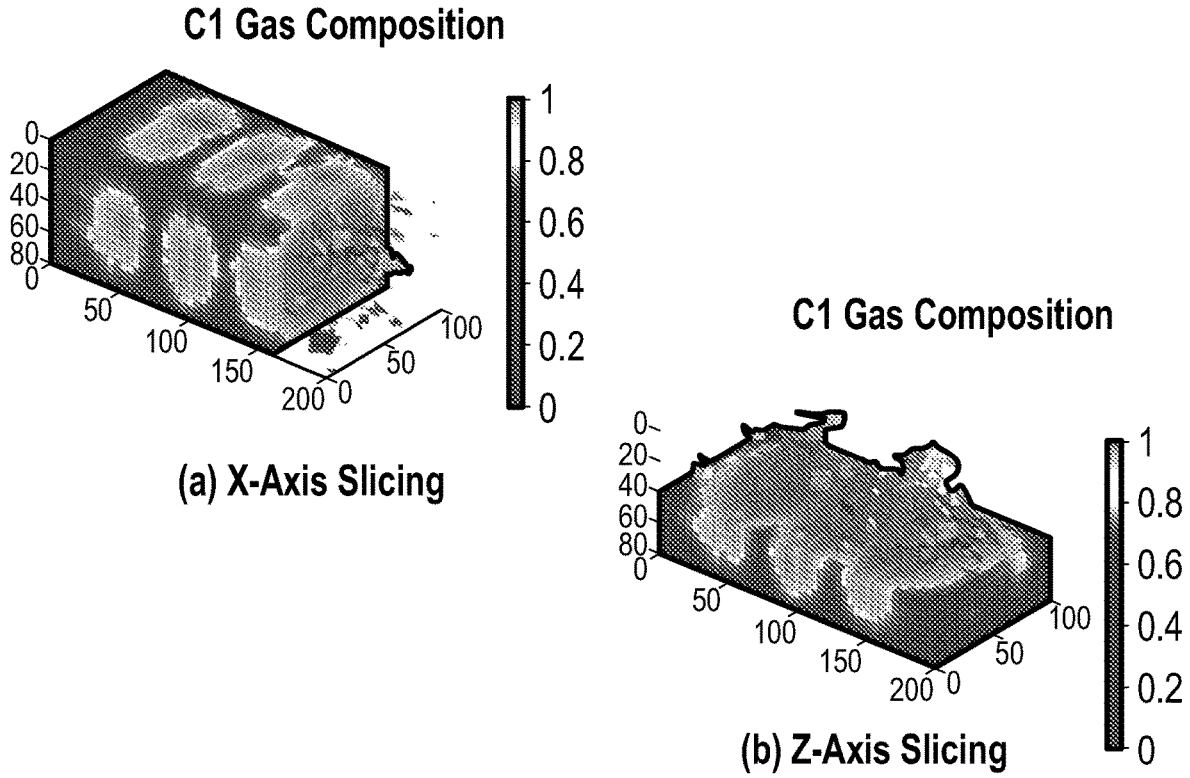
FIG. 19 shows profiles of methane mole-fraction, according to an embodiment of the present disclosure.

FIG. 18 presents the methane gas profile after 8 years of simulation for both EOR techniques. The left image shows that the injected gas efficiently displaces the oil towards the slot-drilled fracture at the bottom of the reservoir. The lighter gray cells 1800 delineate the portions of the reservoir that have been swept by the injected gas. The methane gas profile on the right in FIG. 18 shows that some of the injected gas gets to the boundaries of the domain after 8 years of simulated production. FIG. 19 presents slices of the domain in the x- and z-directions, and it shows that the injected gas travels horizontally in the reservoir as expected. The concentration of methane gas near the fracture surfaces results in high and low relative permeabilities to gas and oil, respectively. This consequently leads to a reduced flow of oil and an increased flow of gas towards the hydraulically fractured well. This is a fundamental limitation of the CGEOR method, which significantly curtails oil production later in the life of the well. The use of a pair of slot-drilled fractures in the SDEOR technology helps avoid this limitation, resulting in a continued increase in cumulative oil production, as shown in FIG. 17. Conversely, in CGEOR, the cumulative oil production flattens out because more gas is produced instead of oil as the huff-n-puff process continues.

In FIG. 17, the results show that SDEOR yields 2.7 times more oil than CGEOR, and half as much of associated gas production. The primary recovery from the slot-drilled and MSHF wells match because the total fracture area is the same in both cases. In FIG. 18, the image shows the methane gas profile after 8 years of simulated SDEOR while right image shows the corresponding methane profile from the CGEOR method.

In FIG. 19, the left image shows the profile for the methane mole-fraction, with the last 8 cells in the x-direction taken out, while the right image cuts out half of the matrix cells above the middle of the reservoir. It shows that the methane gas saturates the pore volume in the vicinity of the hydraulic fracture clusters, leading to the limited performance of the CGEOR method.

Evaluation of the Recovery Mechanisms in SDEOR

In this section, a discussion of the role of different recovery mechanisms in the SDEOR technology of the present disclosure using the reservoir and fluid input parameters in Tables 2, A-1, and A-2, respectively. An understanding of the physical mechanisms that control the performance of the SDEOR process could facilitate the design of an efficient field implementation of this technology. Three recovery mechanisms are discussed herein:

1. Pressure-driven recovery
2. Gravity drainage
3. Oil viscosity reduction

The Role of the Pressure Difference Between the Injector and Producer.

Figure 20:
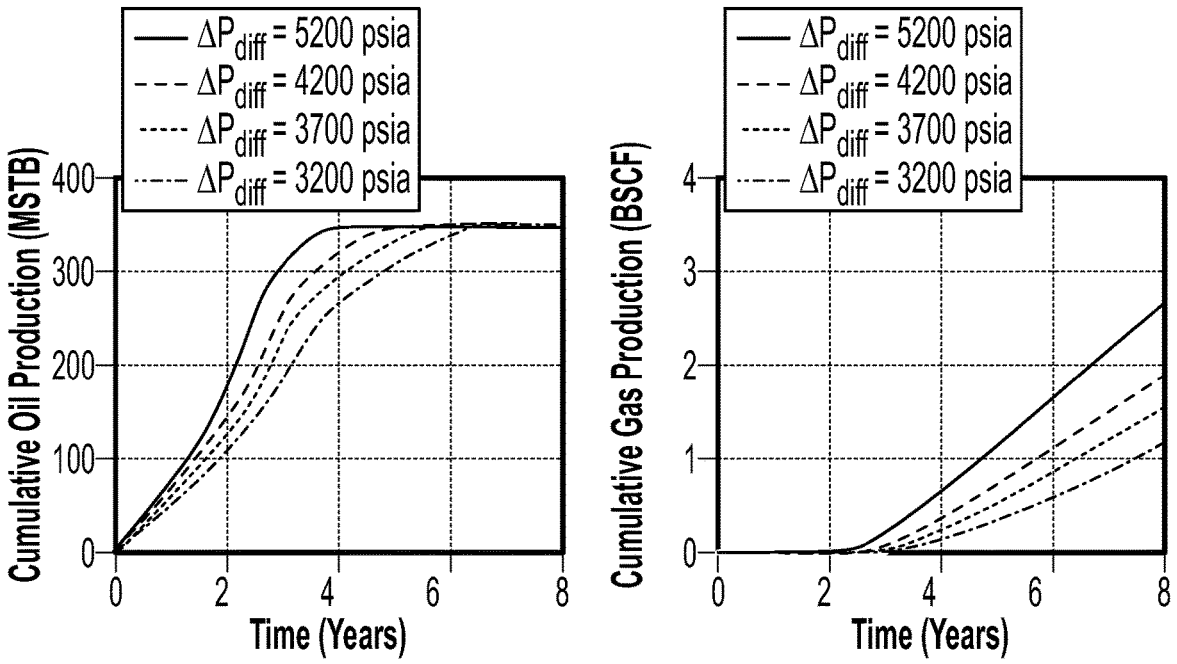
FIG. 20 shows graphs of cumulative oil production, according to an embodiment of the present disclosure.

A study of the effect of the pressure difference between the injector and producer ($\Delta P_{diff}$) on the oil recovery from the SDEOR method of the present disclosure follows. FIG. 20 shows four simulation cases at a fixed flowing bottom hole pressure of 2,500 psia but at injection pressures ($P_{inj}$) ranging from 5,700 to 7,700 psi. This yielded the four injection pressures shown in FIG. 20. The cumulative oil production plots in FIG. 20 show that although more oil is produced earlier in the well life at higher injection pressures, the cumulative oil production converges to the same value. As expected, the case with the lower injection pressure yields lower cumulative gas production, which may be important in controlling the amount of associated gas produced from the proposed technology. FIG. 20 shows performance plots that show the role of the pressure difference between the injector and producer in the SDEOR technology. FIG. 20 presents the plots of cumulative oil and gas production.

It is worth noting that while the pressure difference in the SDEOR technology acts continuously between the injector and producer, in CGEOR, the effect of a pressure increase is only felt during the injection and soaking period. This may contribute to the lower oil production observed from the simulations of the CGEOR method.

The Role of Gravity Drainage.

Figure 21:
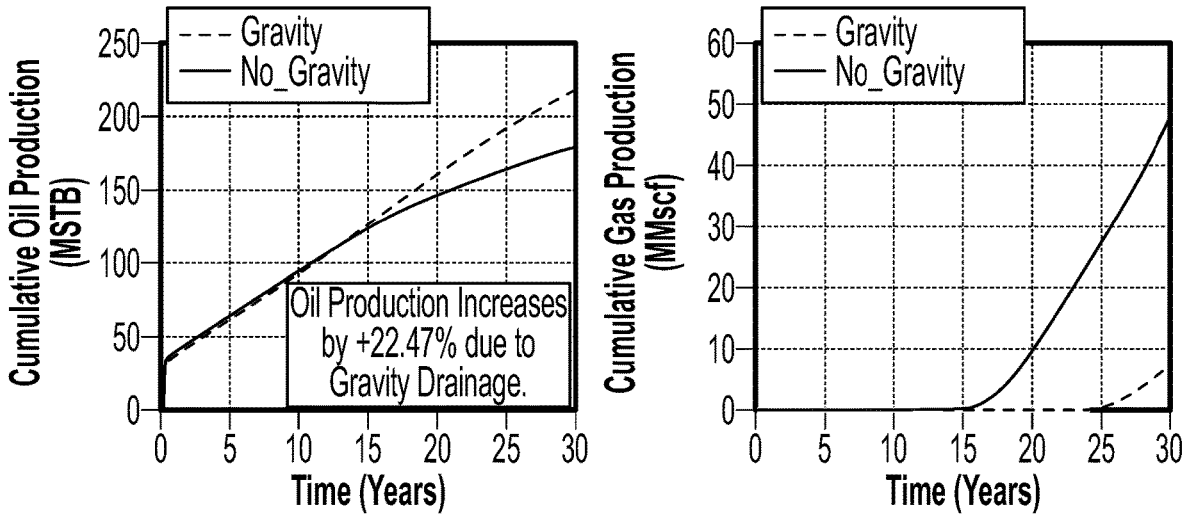
FIG. 21 shows performance plots, according to an embodiment of the present disclosure.
Figure 22A:
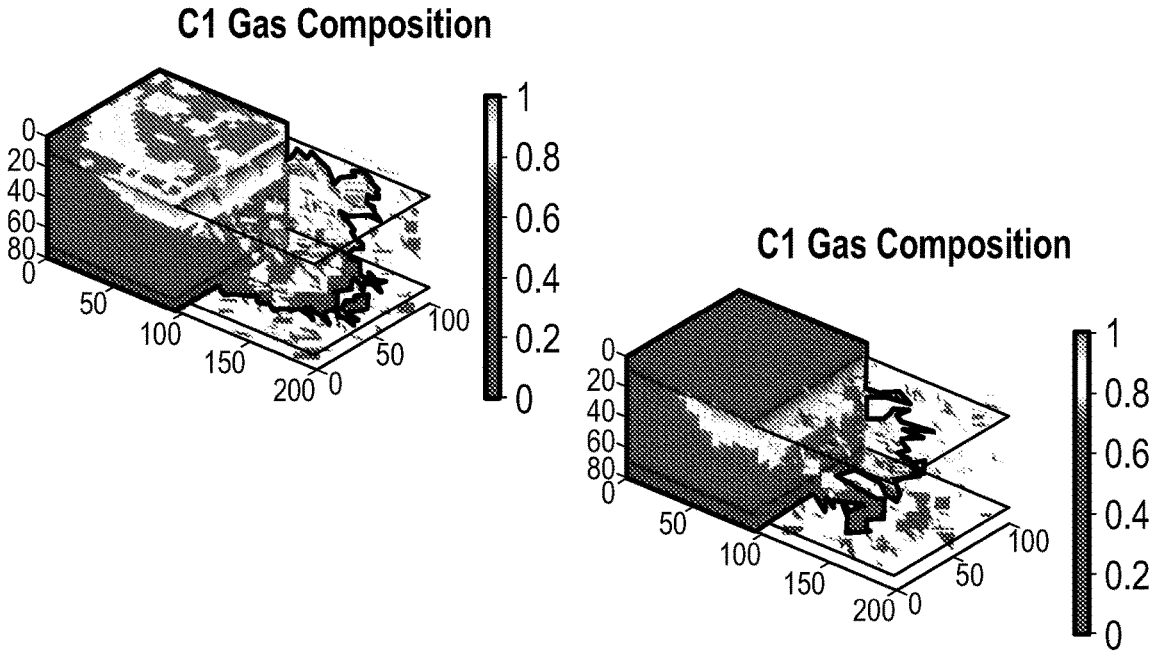
FIGS. 22A to 22C show profiles of methane gas mole fractions, according to an embodiment of the present disclosure.
Figure 22B:
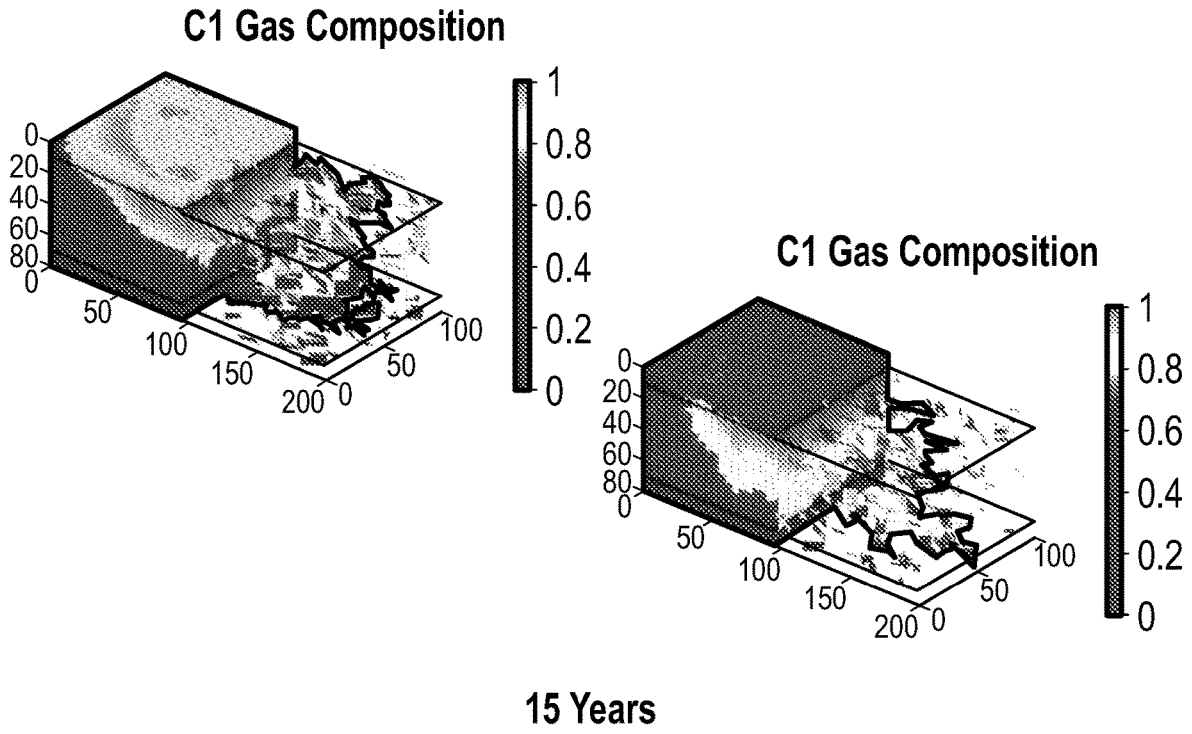
Figure 22C:
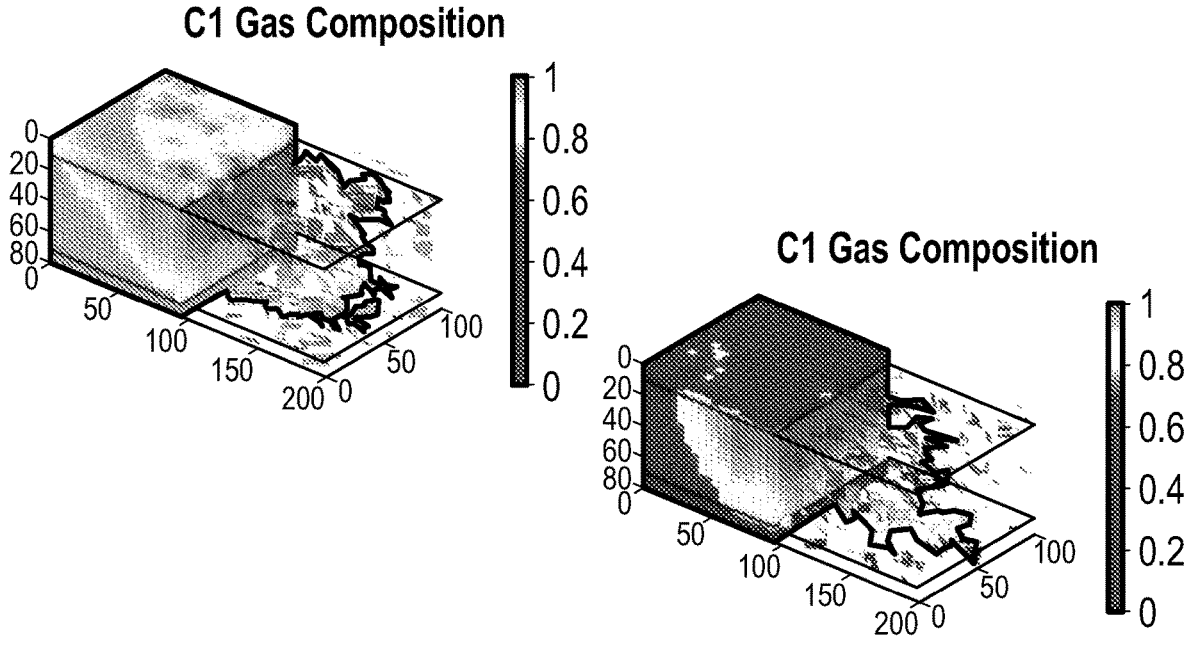

The role of gravity drainage in the SDEOR technology may be evaluated by simply turning gravity off and on in the simulation, and comparing the corresponding oil production from both cases. The simulation shows that gravity results in more oil recovery at higher matrix permeability values and in systems with dense networks of high-conductivity fractures. Considering that shale-oil reservoirs are typically naturally fractured and with low matrix permeabilities, the results for a shale reservoir with a matrix permeability of 50 μD and 512 natural fractures (which is above the percolation threshold) is employed. The simulation results given in FIG. 21 shows that gravity accounts for ~20% of the oil production after 30 years of simulated production. This effect could be even more significant if the simulation is run for a longer duration, or if more and larger sub-vertical fractures are simulated. FIG. 21 shows performance plots for the cases with and without gravity demonstrates that gravity plays a significant role in the SDEOR technology. FIGS. 22A to 22C show the profile for the mole fraction of methane gas ($C_1$) after 30 years when gravity is turned on (left images) and when it is turned off (right images). A comparison of the methane-gas composition profiles after 15 and 30 years indicates that gravity helps stabilize the injected gas front and delays the breakthrough of the gas at the producer, as confirmed by the cumulative gas production presented in FIG. 20, right plot. These results indicate that the role of gravity in the SDEOR technology of the present disclosure may benefit shale plays like the Bakken, which are known to have low matrix permeabilities and complex network of fractures. In such systems, the CGEOR method has not been successful, as discussed in Kuuskraa et al. (2020). This could be attributed to the predominantly horizontal flow expected during CGEOR through nearly vertical fractures. However, in the vertical flow expected in SDEOR, gravity appears to curtail early gas production through the high-conductivity fracture flow paths by the buoyancy of the injected gas. FIGS. 22A to 22C also show that the gas rises to the top of the reservoir when gravity is turned on, but does not otherwise. In FIGS. 22A to 22C, left and right images show the profile of methane gas mole fraction with and without gravity, respectively. Left images show that gravity helps delay the breakthrough of the injected methane gas in comparison to the case where gravity is ignored.

The Role of Oil Viscosity Reduction

Figure 23:
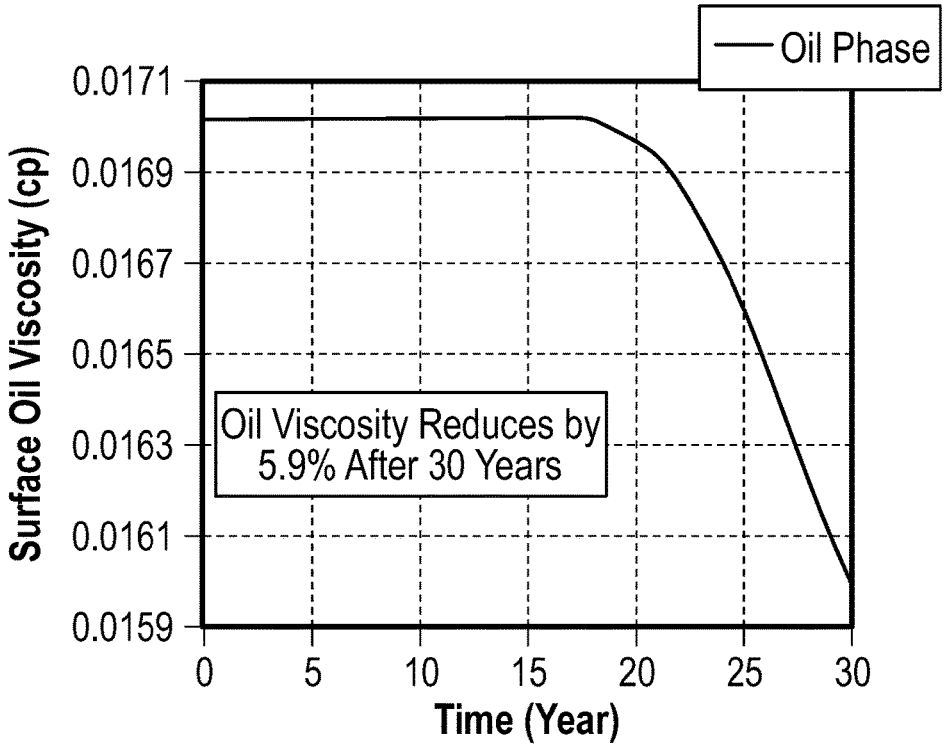
FIG. 23 shows a graph of surface oil viscosity, according to an embodiment of the present disclosure.

To evaluate the role of oil viscosity in the SDEOR technology of the present disclosure, the SDEOR technology is simulated by injecting at a constant $q_{inj}$ of 10 Mscf/D and a $p_{wf}$ of 2,500 psia for 30 years. The surface oil viscosity is computed as shown in FIG. 23, using the Lohrenz-Bray-Clark (LBC) compositional viscosity model (Lohrenz et al., 1964). The simulated viscosity of the oil produced at the surface is observed to decrease from an initial value of 0.017 cp to 0.0158 cp (−7.6% change) after 30 years. We also observe from FIGS. 24A and 24B that the viscosity of the oil left in the reservoir decreases during gas injection. This is because the injected methane gas appears to mix with the oil phase, making it less viscous. Oil phase mobility $$\frac{K_O}{\mu_O}$$

increases as its viscosity decreases, and this makes it flow more easily towards the bottom producer in the SDEOR technology. Although the decrease in the oil-phase viscosity is rather small because the commercial shale oil plays are usually volatile oils, higher viscosity mixtures have been shown to yield more significant viscosity changes during miscible gas injection (Hao et al., 2020; Zou et al., 2017).

Figure 24A:
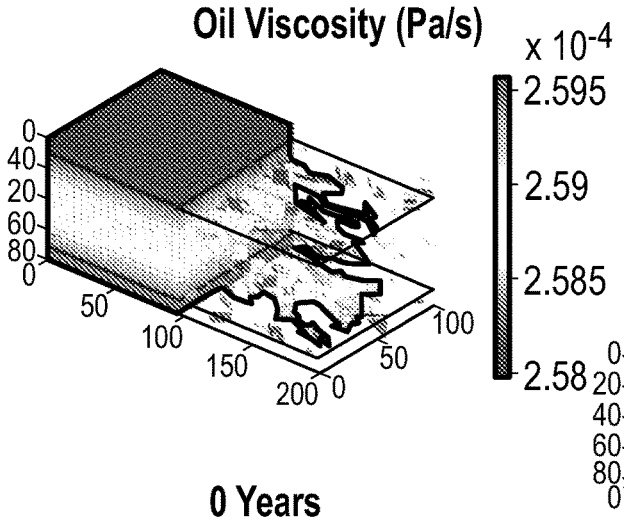
FIGS. 24A and 24B show simulations of in-situ oil phase viscosity, according to an embodiment of the present disclosure.
Figure 24B:
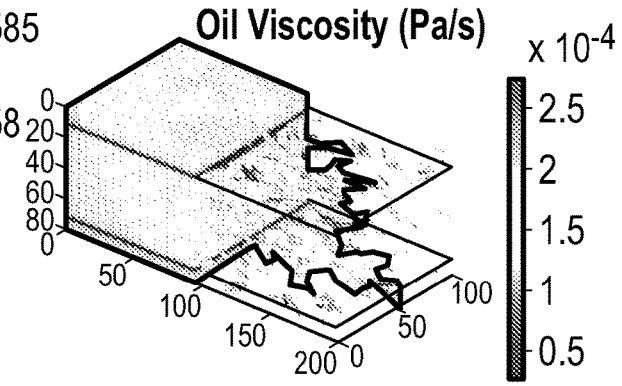

FIG. 23 shows a plot of surface oil viscosity shows that the oil gets less viscous as the injected methane gas mixes with the oil in the reservoir. FIGS. 24A and 24B shows images show in-situ oil phase viscosity at the beginning (left) and after 30 years (right) of simulating the SDEOR technology. In-situ oil viscosity decreases as injected gas continuously mixes with the oil in the reservoir.

SDEOR Application to Eagle Ford and Bakken Shale Plays

In this section, a numerical evaluation of the application of SDEOR in comparison to CGEOR in actual shale plays is discussed. To ensure that the CGEOR cases simulated are not curtailed by sub-optimal operating conditions (in comparison to SDEOR) the simulation for CGEOR includes the cyclic injection of methane gas under efficient operating conditions as follows:

1. Use optimum field injection, soaking, and production durations of 60, 14, and 180 days (2, 0.5, and 6 months), respectively (Kuuskraa et al., 2020).
2. Operate at $P_{wf}$ above $P_b$ to prevent the vaporization of the oil and ensure optimum CGEOR recovery factor (Sun et al., 2019).
3. Start CGEOR after the cumulative oil production from primary recovery flattens out.

The next two subsections show the results from the simulation of the Eagle Ford and Bakken shale formations. In both cases, primary production is simulated for 3 years, after which, both CGEOR and SDEOR are modeled for 8 more years.

Figure 25:
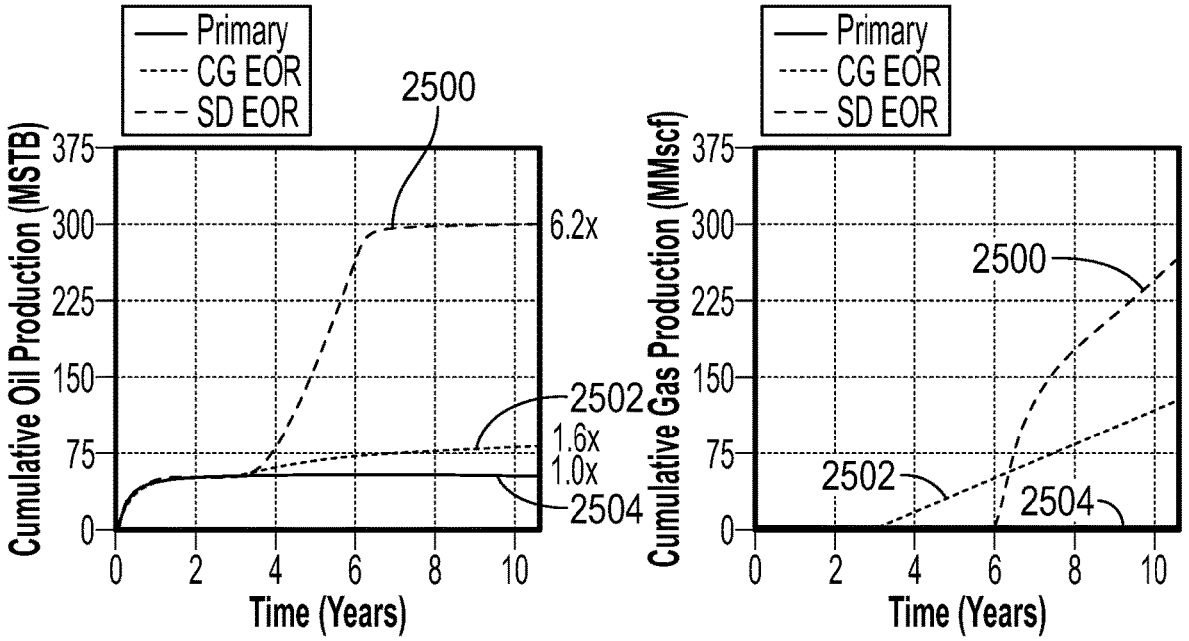
FIG. 25 shows performance plots of cumulative oil and cumulative gas production, according to an embodiment of the present disclosure.

Eagle Ford Shale: To model a volatile oil Eagle Ford shale reservoir, the fluid composition data presented in Tables B-3 and B-4 were used. Most of the reservoir input parameters used are given in Table 2, but to model a representative Eagle Ford shale reservoir, we use $P_i$, $P_{wf}$, and $q_{inj}$ values of 7,000 psia, 2,500 (above $P_b$=1,560 psia), 400 Mscf/D, and 1 μD, respectively, for both SDEOR and CGEOR cases. We do not simulate any natural fracture in this case because Raterman et al. (2018) did not observe any natural fractures from their extensive sampling of an SRV by drilling multiple lateral wellbores through a region around a stimulated Eagle Ford shale well. FIG. 25 compares the production performance of the SDEOR technology of the present disclosure to the CGEOR method. It shows that SDEOR produces 3.8 times more oil than CGEOR after 11 years of simulated production.

The flattening of the slope of the SDEOR cumulative oil production 2500 corresponds to the time the injected gas breaks through into the bottom producer after 6 years of production. This is confirmed in the right plot in FIG. 25, which shows that the gas production from SDEOR is negligible until it breaks through when most of the oil is already recovered. This observation indicates that the production of associated gas is typically negligible while most of the oil is being recovered during SDEOR, which will minimize the costs associated with gas handling in the surface facilities. As explained in the previous section, the reduction in gas production until gas breaks through is because of the role of gravity in stabilizing the gas front in SDEOR from fractured reservoirs.

Performance plots of FIG. 25 show a comparison of the cumulative oil (Left) and gas (Right) production from primary production (line 2504), CGEOR (line 2502), and SDEOR (line 2500) from a representative Eagle Ford shale oil well. The results show that SDEOR yields 3.8 times more oil than CGEOR.

The drastic increase in oil recovery from SDEOR in comparison to CGEOR even in shale reservoirs with little or no fractures shows the applicability in such shale plays. The next subsection discusses shale plays such as the Bakken shale (which has lots of complex fractures), where CGEOR has not been successful at increasing the recovery significantly.

Figure 26:
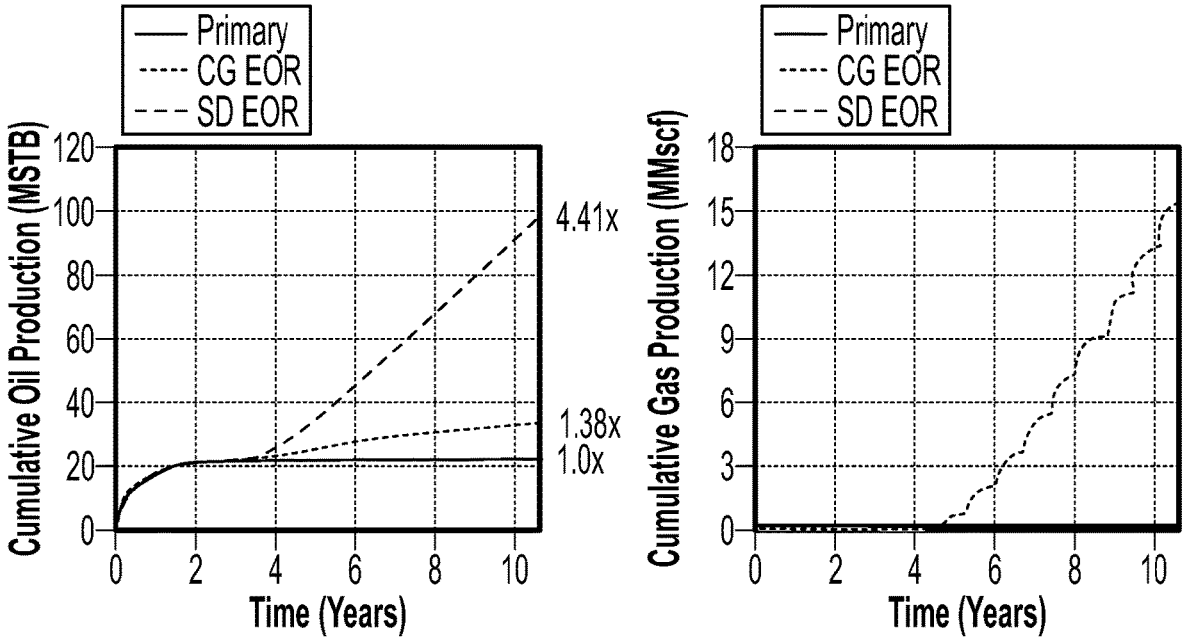
FIG. 26 shows performance plots of cumulative oil and cumulative gas production, according to an embodiment of the present disclosure.

Bakken Shale: To model a volatile oil Bakken shale reservoir, the fluid composition data presented in Tables B-5 and B-6 was used. Most of the reservoir input parameters used are given in Table 2, but to model a representative Bakken shale reservoir, we use $P_i$, $P_{wf}$, and $q_{inj}$ values of 6,700 psia, 3,000 (above $P_b$=1,640 psia), 60 Mscf/D, and 10 μD, respectively, for both SDEOR and CGEOR cases. We simulate 150 sub-vertical natural fracture planes with 1.5 md-ft conductivity, dip ranging from 60° to 90° (with a mean of) 80°, and dip direction between N50° W and S40° E, as interpreted from the formation micro-imager (FMI) logs (Sturm and Gomez, 2009). FIG. 26 compares the production performance of the SDEOR technology of the present disclosure to the CGEOR method. It shows that SDEOR produces 3.2 times more oil than CGEOR after 11 years of simulated production. Additionally CGEOR yields a considerable amount of associated gas (cumulative gas production of 15.2 MMscf), whereas the SDEOR technology of the present disclosure does not yield any gas production during the 11 years of production because the injected gas is yet to break through at the bottom producer. This result points to the flexibility in designing the SDEOR technology to optimize the duration of oil production before gas breakthrough, by modifying the injection rates or pressure based on the permeability and thickness of the shale formation.

Performance plots of FIG. 26 show a comparison of the cumulative oil (Left) and gas (Right) production from primary production, CGEOR, and SDEOR from a representative Bakken shale oil well. The results show that SDEOR yields 3.2 times more oil than CGEOR.

Table 7 summarizes the results of the simulated recoveries from both the Eagle Ford and Bakken shale plays using SDEOR and CGEOR. The IOR ratios for the CGEOR method lies within the published range for the Eagle Ford (1.34-1.62) and Bakken (1.11-1.41) shale plays (Kuuskraa et al., 2020). The consistently superior recovery from the proposed SDEOR technology of the present disclosure (at least three times higher recovery than the CGEOR method in both shale plays) indicates its potential to be a game changer in the recovery of oil from shale-oil reservoirs.

TABLE 7

Incremental oil recovery in shale formations from SDEOR and CGEOR

| Shale Formation | Recovery Mechanism | Oil RF (%) | EUR (Mstb) | IOR Ratio |
|---|---|---|---|---|
| Eagle Ford Shale | Primary | 10.7 | 49.2 | N/A |
| | CGEOR | 17.1 | 77.9 | 1.6 |
| | SDEOR | 66.0 | 302.8 | 6.2 |
| Bakken Shale | Primary | 5.0 | 24.1 | N/A |
| | CGEOR | 6.8 | 33.2 | 1.38 |
| | SDEOR | 21.8 | 106.2 | 4.41 |

The next subsections discuss the application of the SDEOR technology in the Bakken shale, where CGEOR field pilots have been reported to be unsuccessful and operationally challenging because the injected gas disperses quickly into the natural fracture network without soaking in effectively into the oil-charged matrix (Kuuskraa et al., 2020). The goal is to study the performance of the SDEOR technology in Bakken shale-oil reservoirs under the following unfavorable EOR conditions (Pospisil et al., 2020):

1. The presence of natural fracture networks at low and high conductivities.
2. Operating at $P_{wf}$ (1,000 psia) below both Pb (1,640 psia) and the minimum miscibility pressure (MMP) for different solvents used (such as $CH_4$, $N_2$, Flue Gas, and $CO_2$).

Study of SDEOR Performance in Bakken Shales with Different Fracture Conductivities.

Figure 27:
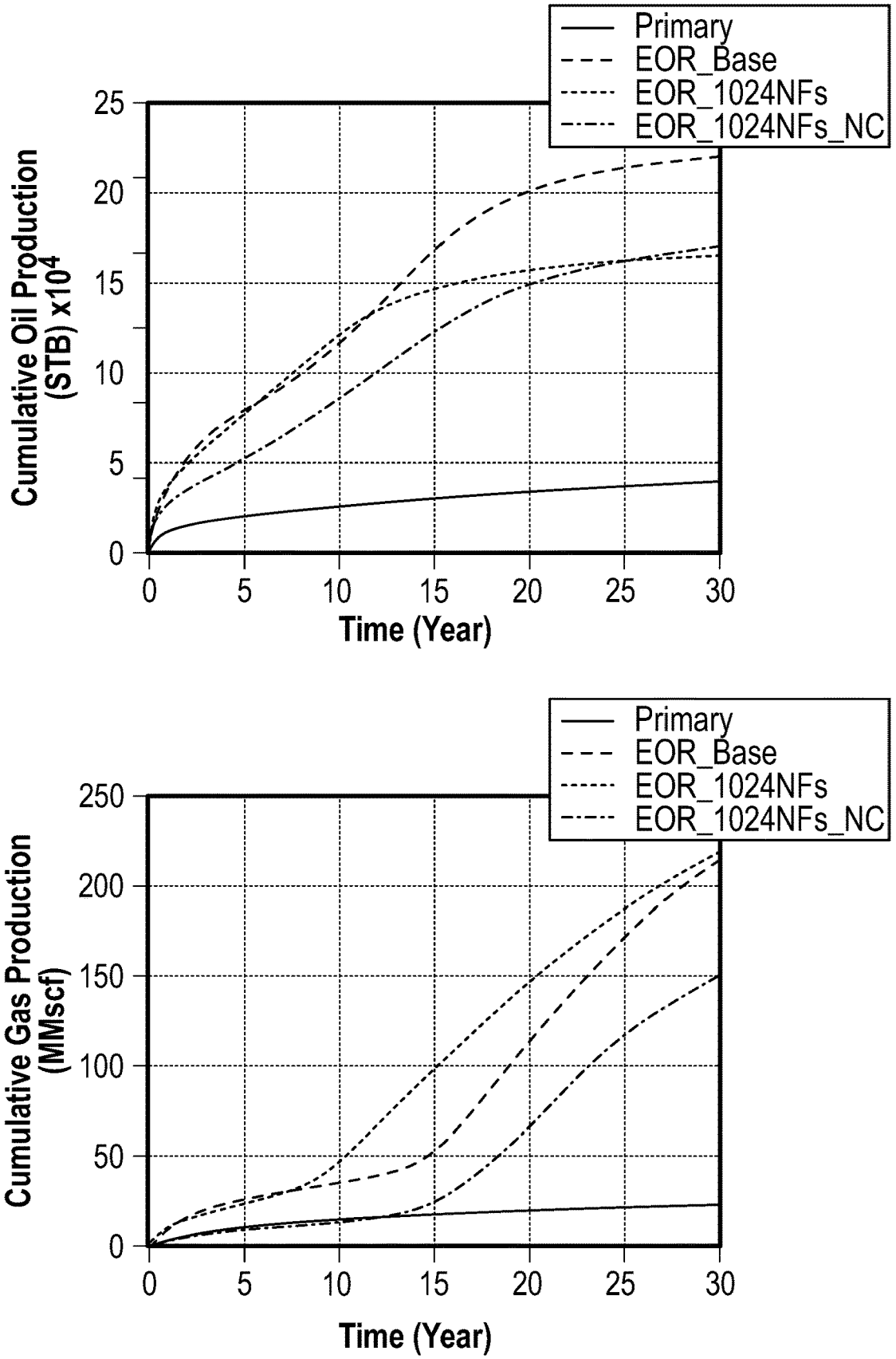
FIG. 27 shows performance plots of cumulative oil and cumulative gas production, according to an embodiment of the present disclosure.
Figure 28A:
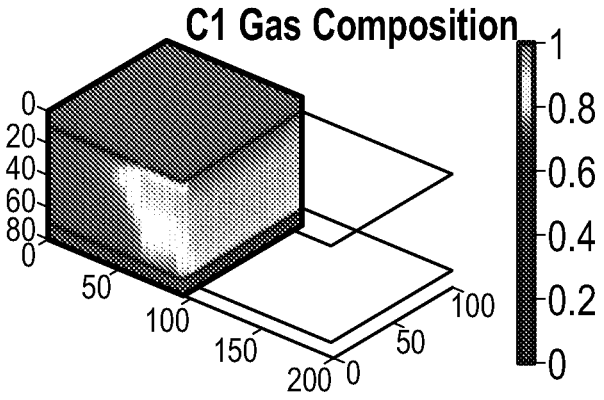
FIGS. 28A to 28C show methane gas composition profiles, according to an embodiment of the present disclosure.
Figure 28B:
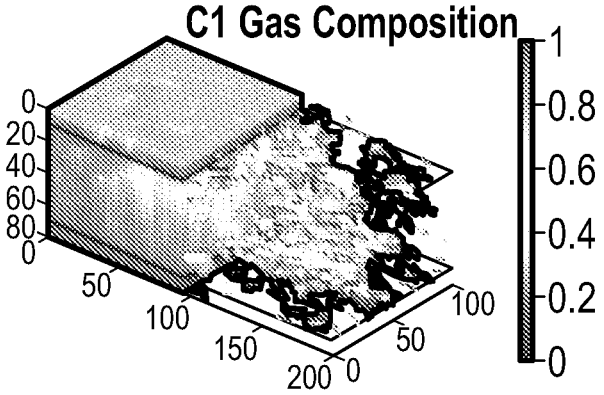
Figure 28C:
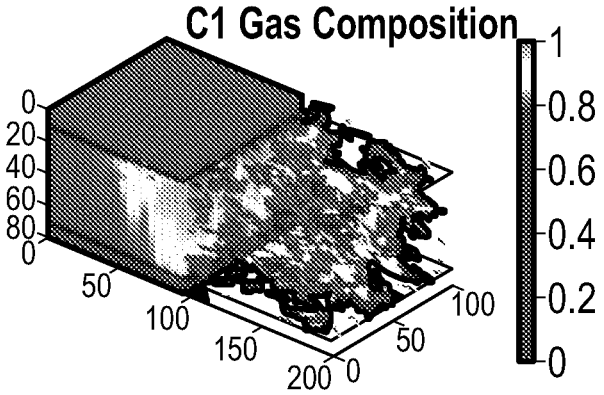

The injection of methane into a Bakken shale oil reservoir at a constant rate of 20 Mscf/D for 30 years was simulated. To quantify the improve in recovery via SDEOR, primary production without gas injection was also simulated. The SDEOR cases studied include a base case without natural fractures, one with 1024 conductive natural fractures, and another with 1024 non-conductive (NC) natural fractures. As many as 1024 natural fractures were used to ensure that the fracture network connectivity exceeds the percolation threshold. FIG. 27 presents the cumulative oil and gas production plots for these three cases, as well as the reference case under primary recovery. These results show that the proposed SDEOR technology increases the oil recovery by a factor of at least four in all three cases studied. FIGS. 28A to 28C show the profile for methane-gas composition for these three SDEOR cases. It shows that the inclusion of the stochastic fracture networks in the reservoir domain slightly decreases the sweeping efficiency as seen in the slight distortion of the more stable gas front in the case with no fractures (FIG. 28A). Nonetheless, the proposed SDEOR technology still yields over four times more oil in the Bakken shale regardless of the presence of a large number of conductive or non-conductive/sealing fractures. These results confirm the applicability of this technology in unfractured shale-oil reservoirs like the Eagle Ford shale play (Raterman et al., 2018) and in densely fractured reservoirs like the Bakken shale play (Kuuskraa et al., 2020).

Results shown in FIG. 27 indicate the robustness of the SDEOR method of the present disclosure as it produces at least four times more oil than primary recovery regardless of the number of sealing or conductive fractures in the reservoir. FIG. 27 shows a methane gas composition profile after 30 years of simulated SDEOR for (a) a base case without natural fractures, (b) a case with 1024 conductive fractures, and (c) a case with 1024 non-conductive fractures. Adding natural fractures beyond the percolation threshold slightly distorts the gas front.

Study of SDEOR Performance with Different Injectants.

Figure 29:
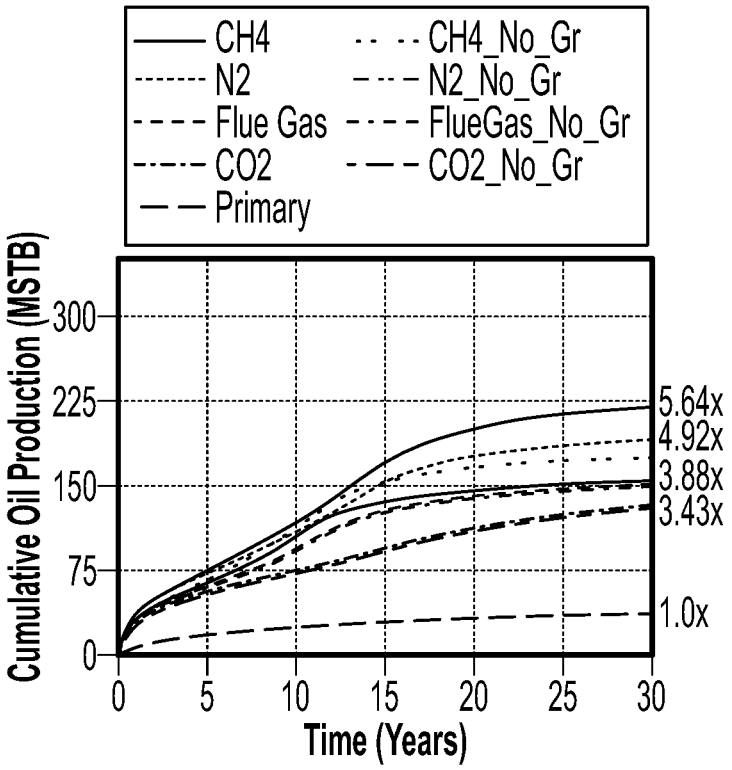
FIG. 29 shows performance plots of cumulative oil and cumulative gas production, according to an embodiment of the present disclosure.
Figure 29:
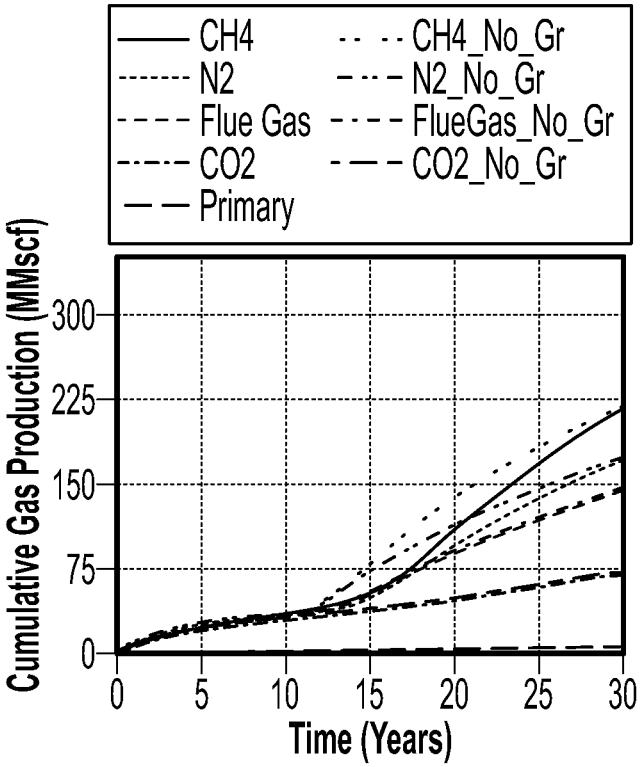

The injection of different gases ($CH_4$, $N_2$, flue gas, and $CO_2$) into the Bakken shale using the SDEOR technology of the present disclosure was simulated. FIG. 29 shows a comparison of the cumulative oil (Left) and gas (Right) production when these different gases are injected, while Table 8 summarizes these results and provides the molecular weight of each of the injected gases. The dotted lines in FIG. 29 correspond to the results when gravity is turned off, while the solid lines of the same color are the results for the corresponding case with gravity turned on. The difference between the cases with and without gravity are more significant for the lighter gases (methane and Nitrogen) than the heavier gases. The comparison of the results of the different injectants (with gravity) also indicates that the recovery increases as the molecular weight of the injected gas decreases. This could be attributed to the increased role of gravity when lighter gases are injected because the density difference between injected gas and the original reservoir fluid (buoyancy effects) is higher. Performance plots of FIG. 29 show that methane gas injection recovers more oil when compared with the injection of the other heavier gases.

As shown in the rightmost column in Table 8, although gases were simulated at the same value of injection rate, the corresponding injection pressure for case is different. This is expected in accordance with the Peacemann well model, in which the injection rate is inversely proportional to the viscosity but directly proportional to the pressure difference between the cell and the injection pressures. Therefore, as the gas viscosity increases for the denser gases, the pressure difference will increase, resulting in lower injection pressures at a fixed value of cell pressure. This explains the lower values of delta $P_{diff}$ for denser gases because the delta $P_{diff}$ is equal to the $P_{ini}$ minus the $P_{wf}$, and $P_{wf}$ is fixed.

TABLE 8

Results of SDEOR with different gas injectants

| Solvent Method | Molecular Weight (kg/kg · mol) | Oil RF (%) | Increased Oil RF (%) | IOR Ratio | $\Delta P_{diff}$ (psia) |
|---|---|---|---|---|---|
| $CH_4$ | 16.04 | 37.70 | 29.45 | 5.64 | 950 |
| $N_2$ | 28.01 | 32.85 | 24.6 | 4.92 | 890 |
| Flue Gas (25% $CO_2$ + 75% $N_2$) | 32.01 | 31.79 | 23.54 | 3.88 | 850 |
| $CO_2$ | 44.01 | 29.40 | 21.15 | 3.43 | 770 |

Accordingly, as appreciated from the foregoing disclosure, the method and system of the present disclosure provides EOR technology for unconventional reservoirs based on gas injection into a horizontal slot-drilled fracture near the top of the reservoir and oil production from another slot-drilled fracture near the bottom. The method of the present disclosure may outperform the cyclic gas EOR (CGEOR) method by a factor of at least three. The increase in recovery may be due to: (1) the continuous injection and production in the SDEOR technology prevents and/or curtails the effect of a significant reduction in relative oil permeability because of the increasing gas saturation near the well during the cyclic gas injection in CGEOR. (2) the SDEOR technology allows continuous production for 100% of the well life, where as in CGEOR, production is halted during the injection and soaking periods. (3) the SDEOR technology is designed to take advantage of gravity in stabilizing the flow through the fracture network unlike CGEOR, which involves a preferential flow through the poorly known fracture network.

The simulation results presented show that the method of the present disclosure may yield much higher oil recoveries regardless of the presence/absence of natural fractures of high, low or intermediate conductivity. The simulation of SDEOR in the Bakken shale (which has not been successfully enhanced using CGEOR) shows an IOR of at least four when simulating the injection of four different gases ($CH_4$, $N_2$, flue gas, and $CO_2$).

Figure 30:
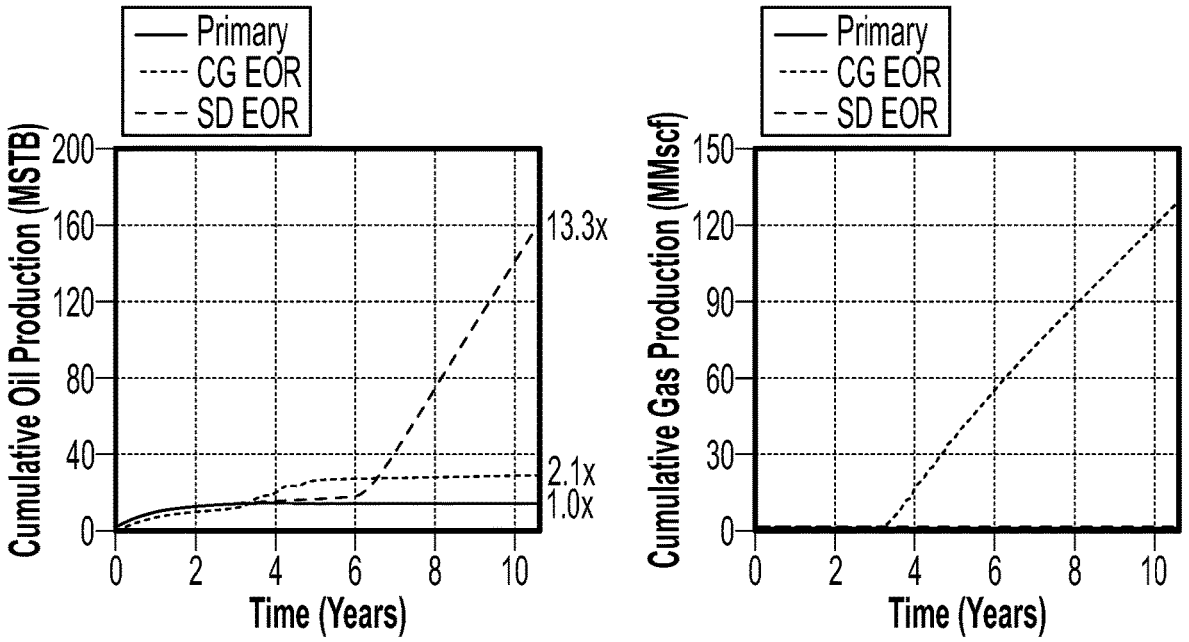
FIG. 30 shows performance plots of cumulative oil and cumulative gas production, according to an embodiment of the present disclosure.
Figure 31:
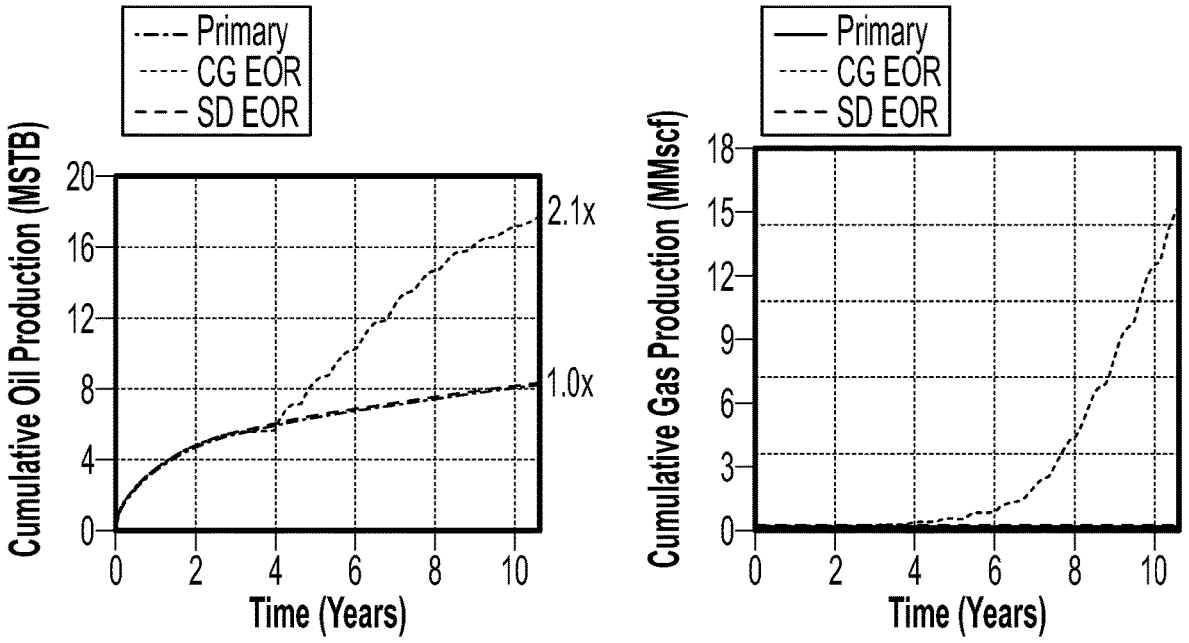
FIG. 31 shows performance plots of cumulative oil and cumulative gas production, according to an embodiment of the present disclosure.
Figure 32:
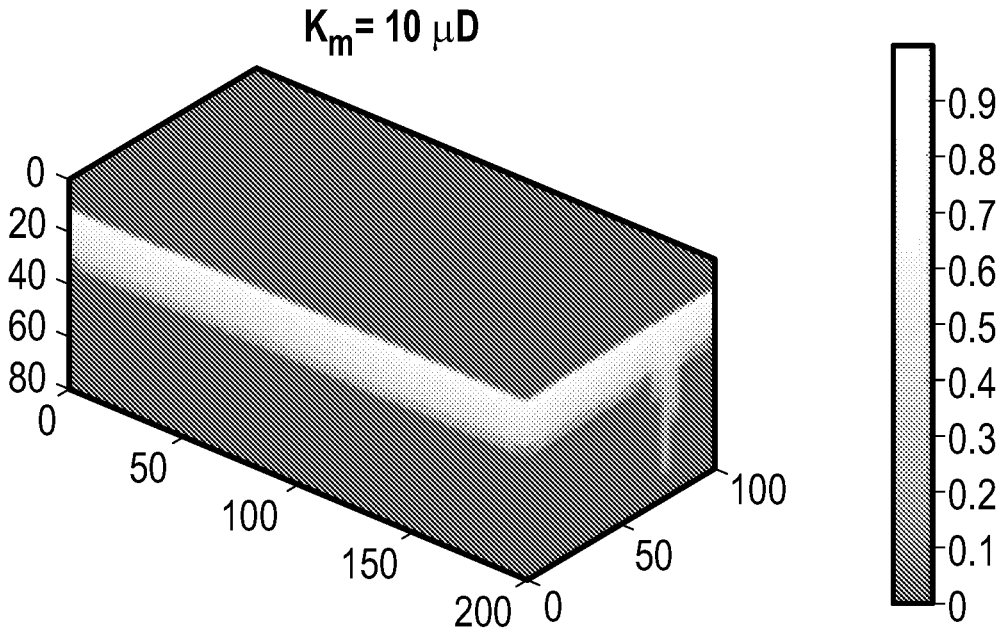
FIG. 32 shows gas saturation profiles, according to an embodiment of the present disclosure.
Figure 32:
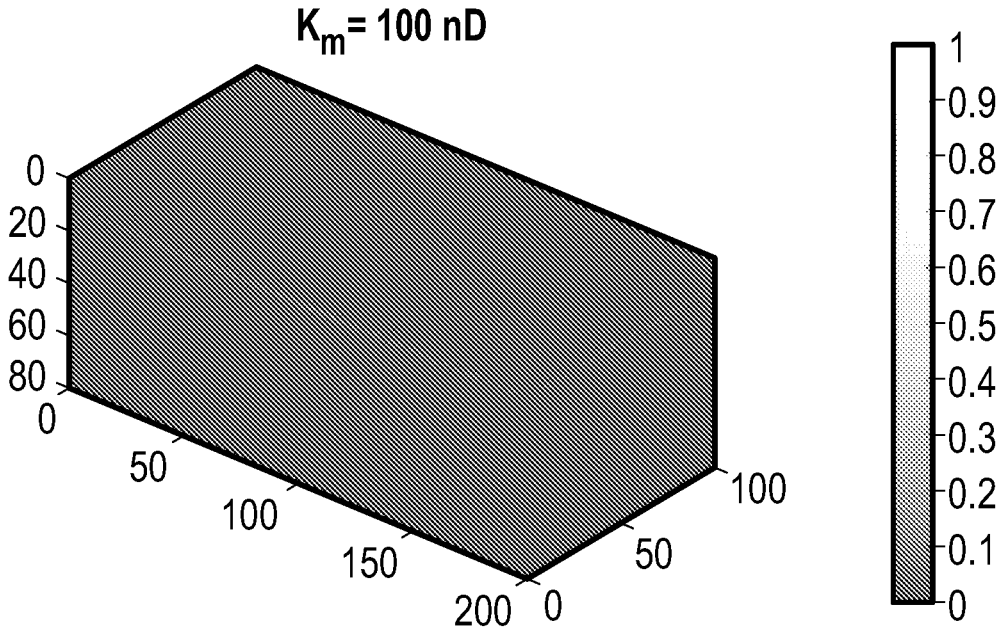

FIGS. 30 and 31 illustrate the results obtained when the Eagleford and Bakken cases presented in FIGS. 25 and 26 are simulated at much lower values of matrix permeability. FIGS. 30 and 31 present the simulation results for a case with a large vertical natural fracture between the pair of slot-drilled natural fractures. All of these cases are included to evaluate the performance of the SDEOR in extreme cases. Following these figures is a discussion of how the surface oil and gas rates are computed from the corresponding subsurface rates.

Eagle Ford Shale Simulation Results at 100 nD

FIG. 30 illustrates the simulation results for the Eagle Ford shale case with a permeability of 100 nD instead of 1 μD, as described with respect to FIG. 25. The goal of the simulation of FIG. 30 is to evaluate the relative performance of the Slot-drill EOR technology at a much lower matrix permeability value. The simulation results shown in FIG. 30 indicate that the SDEOR technology of the present disclosure significantly outperforms the CGEOR method. Here, the ratio of SDEOR to CGEOR is much higher than in FIG. 25 because the injected gas is yet to break through in the SDEOR at this lower value of matrix permeability. In this case the recovery factor for CGEOR is 6.8% while that for SDEOR is 38%.

Bakken Shale Simulation Results at 100 nD

FIG. 31 illustrates the simulation results for the Bakken shale case with a permeability of 100 nD instead of 10 μD, as described with respect to FIG. 26. The goal of the simulation of FIG. 31 is to evaluate the relative performance of the Slot-drill EOR technology at a matrix permeability that is two orders of magnitude lower than published values for the middle Bakken shale. The simulation results shown in FIG. 31 indicate that the SDEOR technology does not result in any appreciable increase in production relative to the primary production in this case, while the CGEOR yields an IOR of 2.1. A comparison of the gas injection rates, pressure and saturation profiles from FIG. 30 reveal that SDEOR appears to underperform in comparison to CGEOR when the gas injection volumes are very small and the permeability is very low. FIG. 31 compares the gas saturation profile from the SDEOR case in FIG. 31 to its corresponding case in FIG. 26 (where permeability was 10 μD). This comparison indicates that the reason SDEOR underperforms at very low gas injection rates and permeabilities is because the small volume of injected gas is unable to sweep any significant amount of oil when the permeability is very low. Although the CGEOR still results in an IOR of 2.1 in this case, its recovery factor is still very low (4.4%) and may not be commercial. Nevertheless, it can recover more oil than the primary case because the repeated injection, soaking, and production from the same well helps produce more oil in the vicinity of the fracture surface. With each cycle of the CGEOR process, the oil near the fracture surfaces gets lighter and less viscous, making it more mobile.

Simulation of a Vertical Natural Fracture Between the Pair of SD Fractures

Figure 33A:
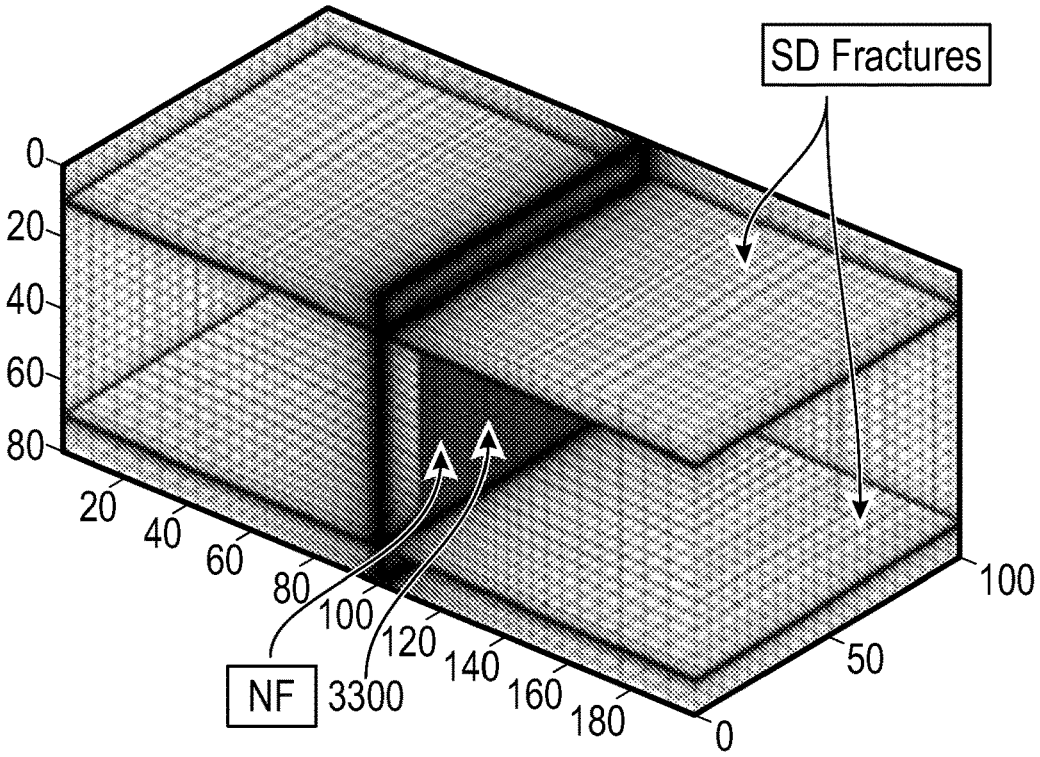
FIG. 33A shows a simulation domain for a case with large vertical natural fracture between the pair of slot-drilled fractures, according to an embodiment of the present disclosure.
Figure 33B:
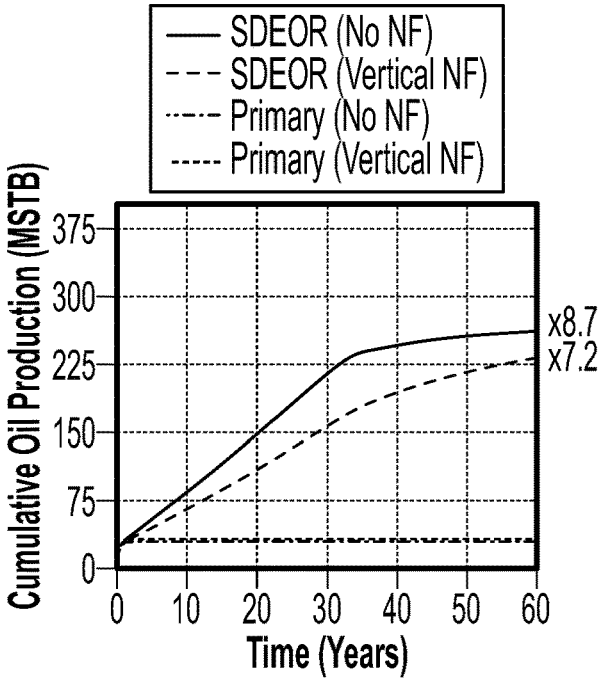
FIGS. 33B and 33C show performance plots of cumulative oil production and cumulative gas production for the simulation of FIG. 33A, according to an embodiment of the present disclosure.
Figure 33C:
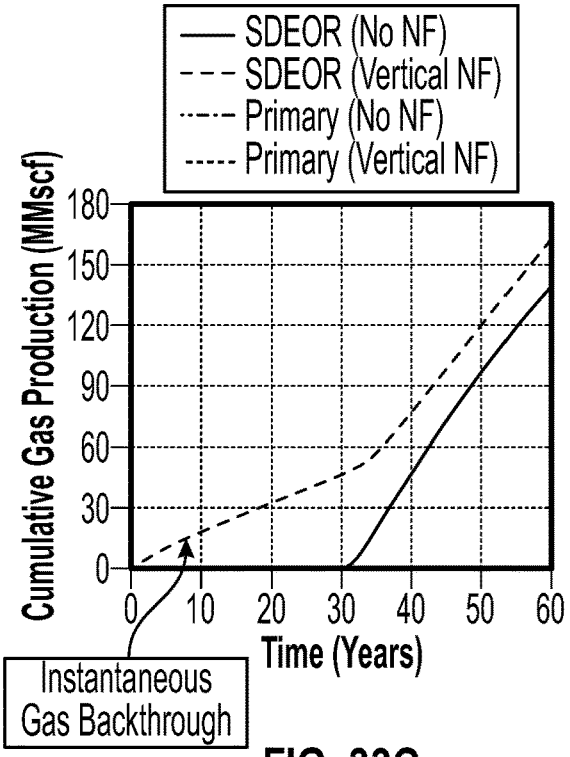

FIGS. 33A to 33C illustrates the results of a scenario where a large vertical natural fracture is artificially placed between the pair of slot-drill fractures. The idea is to evaluate the performance of the SDEOR technology in a case where a large natural fracture could bridge the two slot-drilled fractures. The results, which are presented in FIGS. 33A to 33C indicate that the injected gas breaks through from the first day of production, but the role of gravity in the proposed SDEOR approach still results in a significant recovery that is almost as much as that for the case without the vertical fracture (presented as the base case in FIG. 13). FIG. 33A shows the simulation domain for a case with a large vertical natural fracture (shown at 3300) between the pair of slot-drilled fractures. The simulation results shown in FIGS. 33B and 33C show that although the injected gas breaks through from the first day of production in the case with the vertical fracture, the cumulative oil production is still of comparable to that from a case with no natural fractures due to the role of gravity in the proposed SDEOR technology.

Calculation of Surface Gas and Oil Rates

The reservoir simulator computes the mass flow rates of each hydrocarbon component at reservoir conditions. Considering that the simulator was implemented in SI units, these quantities are computed in units of kg/s. To obtain the surface oil and gas rates, the surface phase densities were divided by the corresponding densities at reservoir conditions to obtain the oil and gas formation volume factors. These are then used to convert the subsurface gas and oil rates into the corresponding surface rates. In reality, a well model will be needed to account for the flow regimes and change in pressure due to frictional losses along the wellbore and in the surface facilities. However, the simple approach used is considered adequate for the purpose of comparing the performance of the SDEOR to the CGEOR method.

To obtain slightly more representative surface oil and gas rates without accounting for the pressure drops and flow regimes in the wellbore and surface facilities, the mass rate of each hydrocarbon component was divided by the corresponding molecular mass to obtain the rates in mol/s. These rates were divided by the total mass rate in mol/s to obtain the overall mole fraction, $z_i$. The fluid mixture with overall mole fraction, $z_i$ was then flashed to standard conditions of 14.7 psia and 60° F. to obtain the liquid fraction, L and phase mole fractions, $x_i$ and $y_i$. We used the definitions $x_i=n^i_L/n_L$ and $L=n_L/n$ to obtain an expression for the surface flow rate of each hydrocarbon component in the oil phase as:

$$q^i_L=Lqx_i,$$

where $q^i_L$ is in units of mol/s and q is the total subsurface flow rate in units of mol/s. The surface flow rate of each hydrocarbon component in the gas phase is obtained in a similar manner:

$$q^i_G = Vqy_i,$$

where V is the vapor fraction (V=1−L) and $q^i_G$ is in units of mol/s. The total oil and gas rates are obtained by summing the flow rate of each component over the corresponding phase. To convert these rates from mol/s to the surface oil and gas rates in stb/d and scf/d, we divide these rates by the corresponding phase molar densities at surface conditions and use the appropriate conversion factors between stb, scf, and $m^3$.

Figure 34:
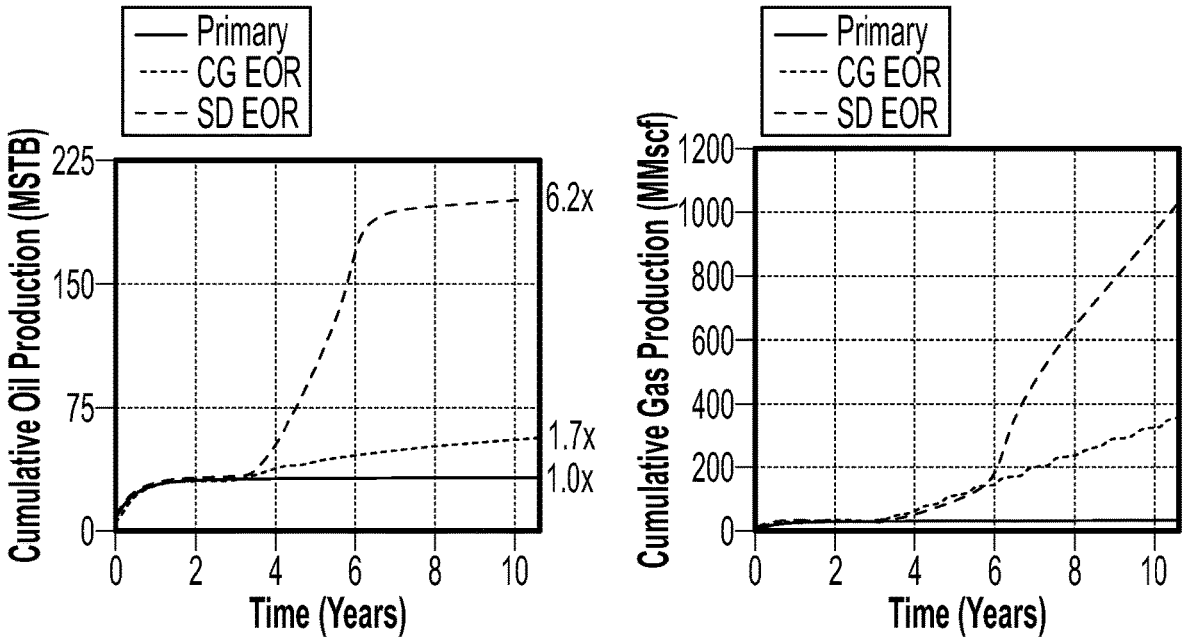
FIG. 34 shows performance plots of cumulative oil and cumulative gas production, according to an embodiment of the present disclosure.
Figure 35:
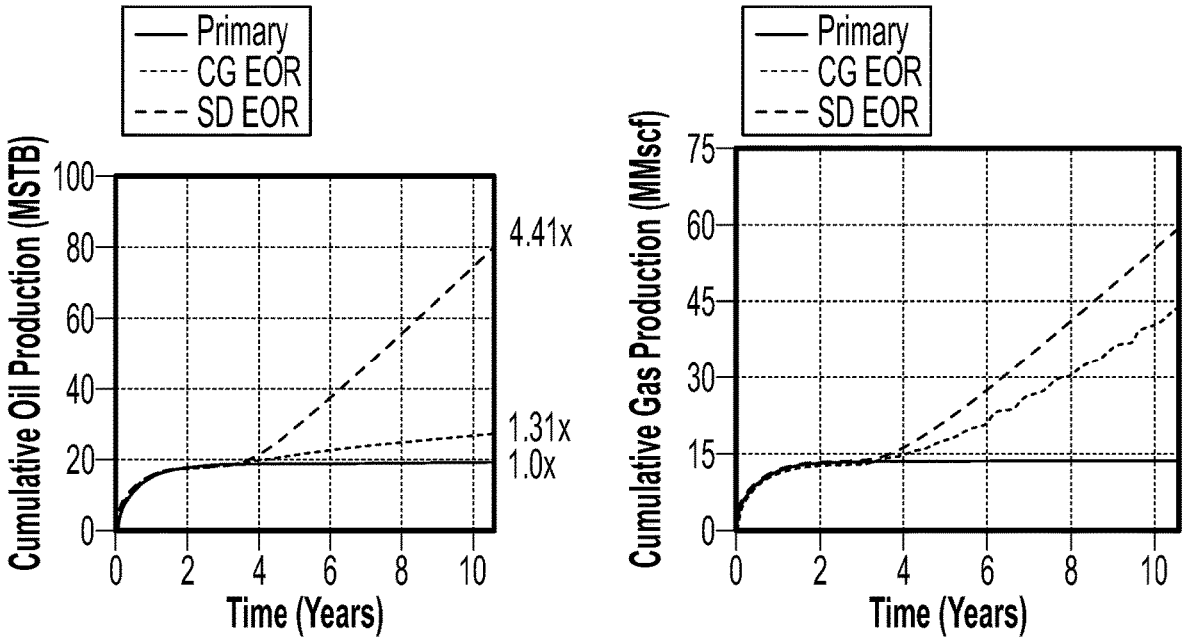
FIG. 35 shows performance plots of cumulative oil and cumulative gas production, according to an embodiment of the present disclosure.

Using the second approach (described in the previous paragraph) for the Eagleford and Bakken shale cases presented in FIGS. 25 and 26, the corresponding results are shown in FIGS. 34 and 35, respectively. Comparing FIG. 25 to FIG. 34 and FIG. 26 to FIG. 35 shows that the IOR ratios are essentially unaffected by the approach used to convert from subsurface oil to surface oil rates. The subsurface flow rates and state variables in the simulator are identical in both approaches, the only difference is that the second approach is able to account for the dissolved gas that comes out of the oil that could exist in the single phase at reservoir conditions. As mentioned at the beginning of this section, both approaches neglect the flow regimes and pressure losses as the produced fluid flows through the well and surface facilities. However, either of these approaches is considered adequate for the purpose of comparing the performance of the SDEOR to the CGEOR method. So, we used the faster and simpler approach, which is built into the reservoir simulator used in this work.

Validation of Simulation Model Against a Commercial Simulator

Figure 36:
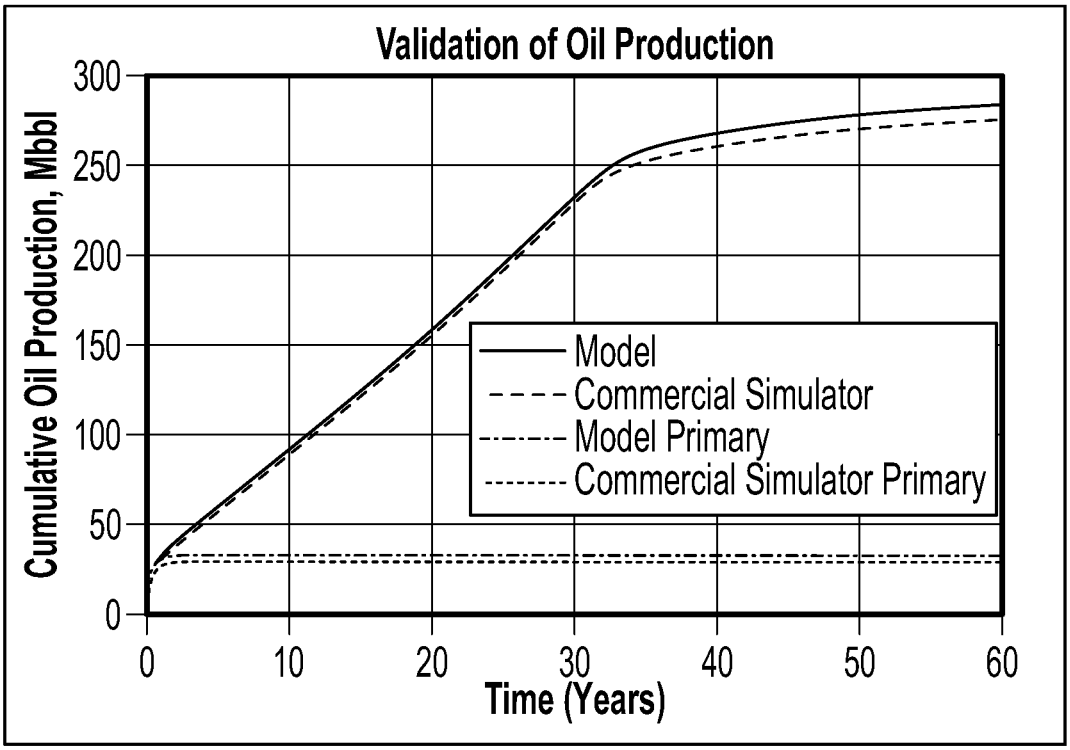
FIG. 36 shows performance plots of cumulative oil and cumulative gas production, according to an embodiment of the present disclosure.
Figure 36:
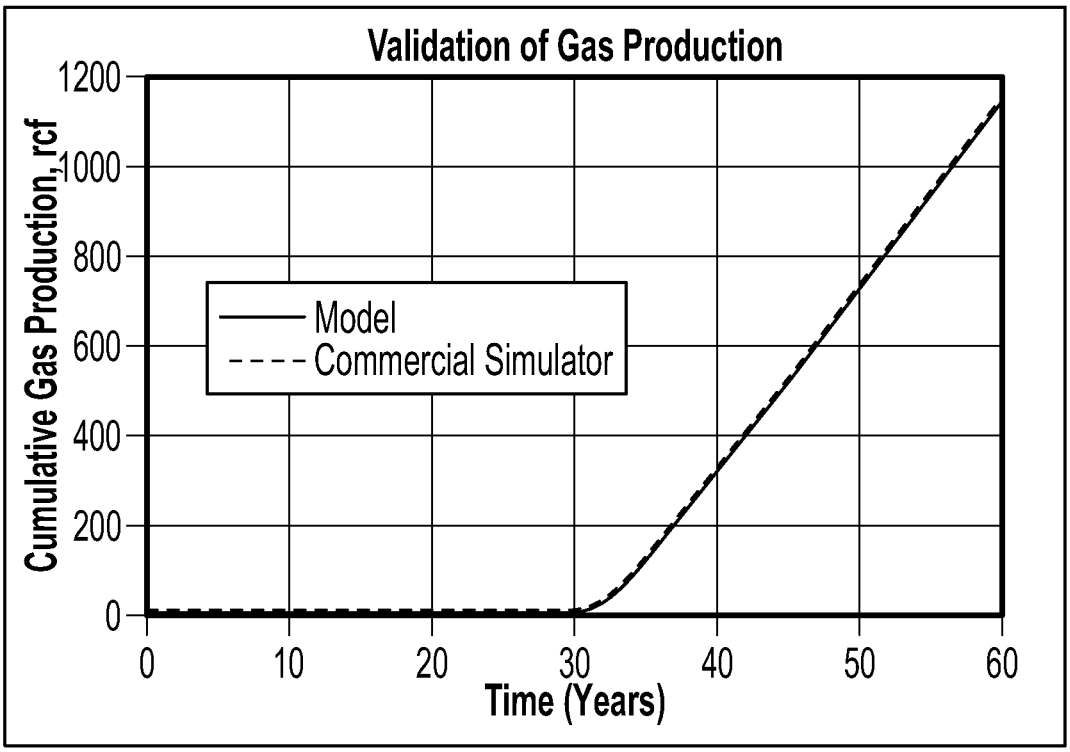
Figure 37:
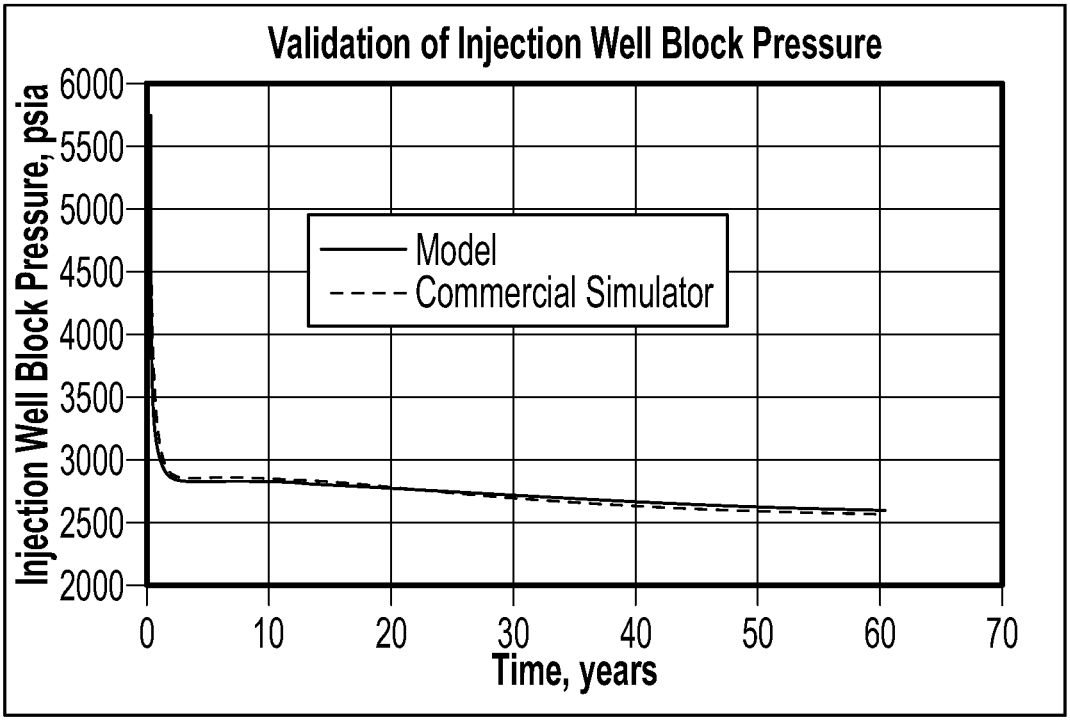
FIG. 37 illustrates pressure plots for an injection well and a producer well, according to an embodiment of the present disclosure.
Figure 37:
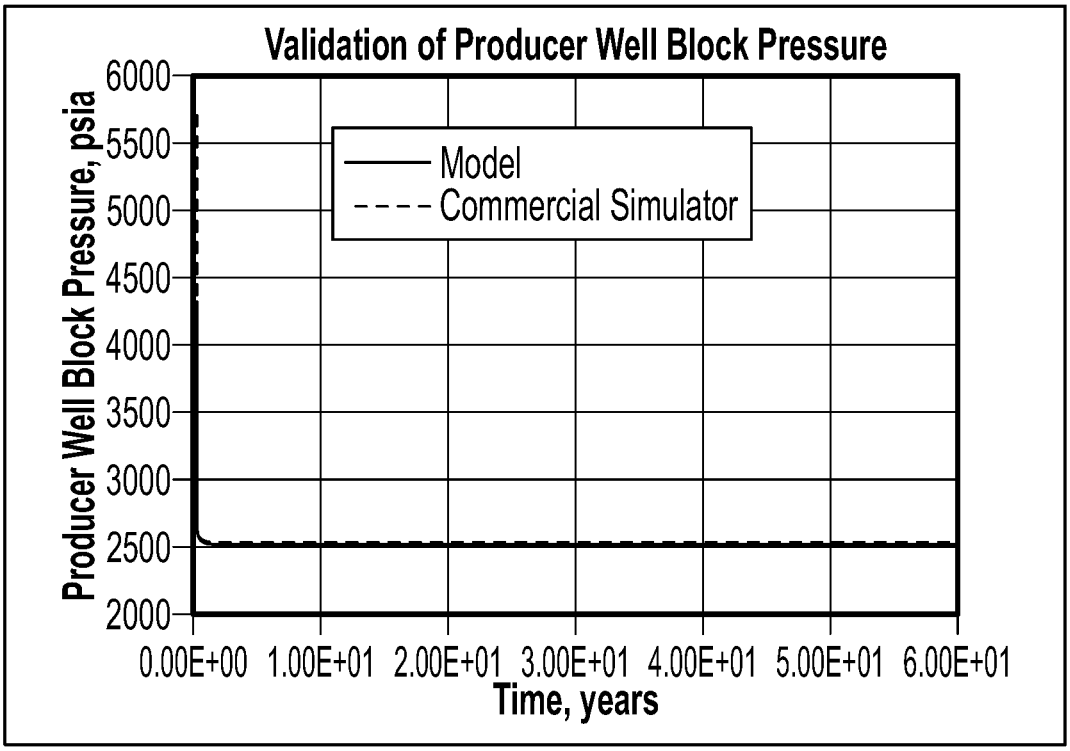

Considering that the capability of modeling natural fractures individually with EDFM is unavailable in the commercial simulator used to validate our results, we are only able to simulate the cases without natural fractures. FIGS. 36 and 37 show the comparison of our simulation results, which were performed using the open-source MATLAB Reservoir Simulation Toolbox and a commercial compositional simulator. The validation results show a good match between the simulation results and the commercial simulator. In FIG. 36, the left plot shows that our simulated cumulative oil production matches those from a commercial simulator for both the primary and slot-drill EOR cases without natural fractures. The right plot shows a corresponding comparison for gas production. No primary gas production results are shown because there was no gas in the reservoir at reservoir conditions. In FIG. 37, the left and right plots show that the injection and producer well block pressures match the results from the commercial simulator used for validation.

Sensitivity of SDEOR Production to Fracture Conductivity

The SD fracture parameters in Table 2 are conservative based on the expected aperture and permeability from the slot-drill technology. For instance, in the slot drill technology patent by Carter (2011), the fracture aperture (WSD) ranges from 9.5 to 76.2 mm. Using the cubic law ($w_{SD}^2/12$) to estimate fracture permeability yields permeability ($k_{SD}$) values between 7.6E6 and 4.9E8 Darcy. Even if this permeability is scaled by a porosity of 10%, it is still over four orders of magnitude higher than the permeability of 10 D. It is also worth noting that the fracture permeability and aperture described herein are consistent with the parameters shown in Table 1 Odunowo et al., (2014). Their values for SD fracture permeability ($k_{SD}$), SD fracture porosity ($\phi_{SD}$), and SD fracture aperture ($w_{SD}$) are 100 D, 0.33, and 12.7 mm, respectively, whereas our corresponding values are 10 D, 0.33, and 10 mm.

Figure 39:
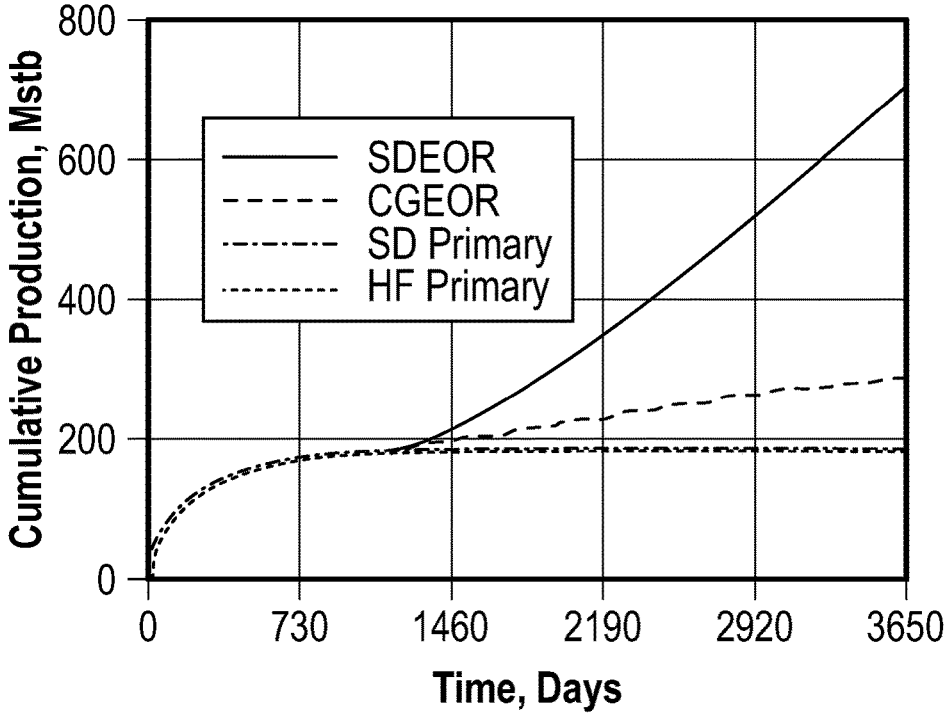
FIG. 39 shows a performance plot of cumulative oil production, according to an embodiment of the present disclosure.

FIG. 39 shows the sensitivity of the SDEOR to fracture conductivity ($w_{SD}*k_{SD}$). Using the parameters in our paper, the fracture conductivity is 328 md-ft. So, this is referred to as the base case in FIG. 39. To understand when fracture conductivity impacts the production performance, it is important to compute the dimensionless fracture conductivity ($F_{CD}$) as follows:

$$F_{CD} = \frac{w_{SD} * k_{SD}}{x_{SD} * k_m},$$

where $k_m$ and $X_{SD}$ are matrix permeability (0.01 mD), and SD fracture half-length (328 ft), respectively. Table 9 summarizes the FCD values corresponding to each case presented in FIG. 38.

TABLE 9

Summary of the conductivity and dimensionless conductivity values used

| SD Fracture Conductivity (md-ft) | $F_{CD}$ | Type of Conductivity |
|---|---|---|
| 33 | 10 | Finite (<=10) |
| 328 (Base Case) | 100 | Infinite |
| 3280 | 1000 | Infinite |
| 32800 | 10000 | Infinite |

Figure 38:
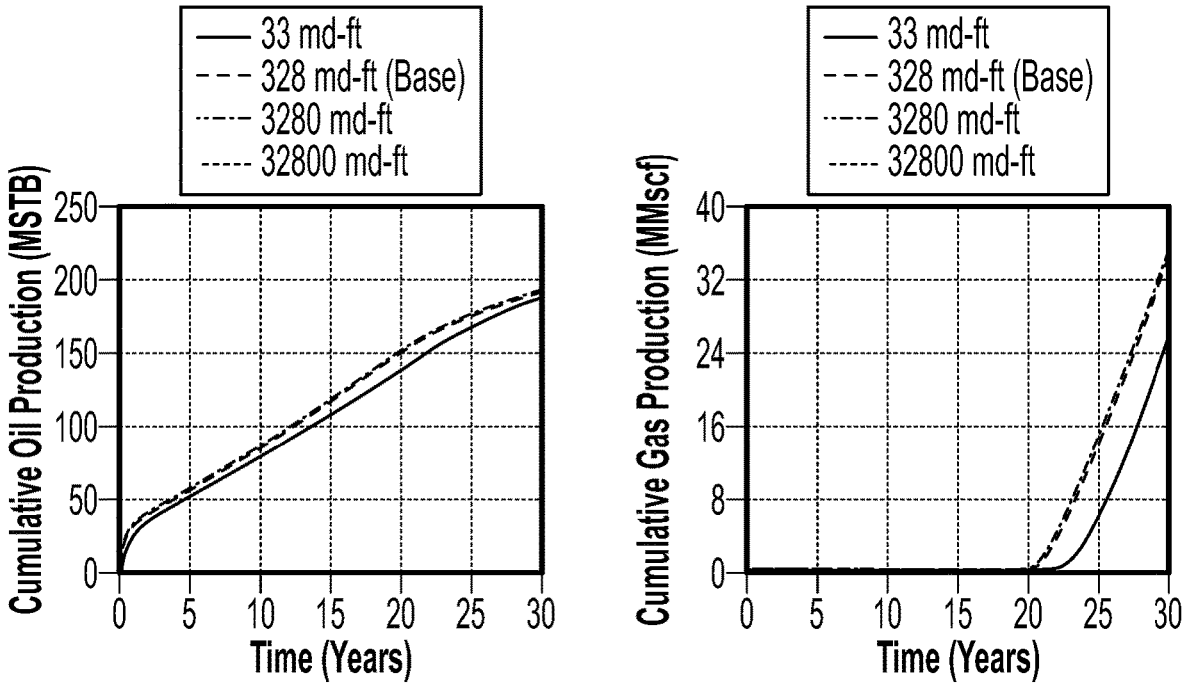
FIG. 38 shows performance plots of cumulative oil and cumulative gas production, according to an embodiment of the present disclosure.

As shown, at a dimensionless fracture conductivity of over 50, the fracture is said to be of "infinite conductivity", where there is no pressure drop in the fracture, and the flow regime is linear (Wattenbarger et al., 1998). So, based on the literature on the slot drill technology, the fractures created using this technology will be of infinite conductivity because our conservative fracture aperture and permeability yield a dimensionless fracture conductivity of 100. To show how the production will decline when the fracture conductivity is finite, we show a case with a dimensionless fracture conductivity of 10. FIG. 38 shows that the cumulative production remains unchanged at infinite fracture conductivity, which is expected from slot-drilled fractures. However, if a finite conductivity slot-drilled fracture (with $F_{CD}$=10) is created, the expected ultimate recovery of oil is only 1.6% less than the other infinite conductivity cases shown in FIG. 38. It is worth noting that we expect higher fracture conductivity values from slot-drilled fractures than from hydraulic fracturing because the former requires tensioned cables that are typically on the scale of a centimeter in thickness. In contrast, the fracture aperture from hydraulic fracturing is less controlled and uncertain.

Accordingly, based on the foregoing disclosure the present disclosure provides a method of using mechanically-created horizontal fractures to enhance oil recovery from ultra-low permeability reservoirs. The method of the present disclosure improves oil recovery in tight/shale oil and gas reservoirs by injecting fluids through fractures which are mechanically cut into these ultra-low matrix permeability resources using the slot-drill technology. This slot-drill technology has the unique flexibility of precisely cutting the fractures at a desired, predetermined location and with a predetermined geometry. The method of the present disclosure involves drilling two wells, each having a horizontal slot-drill fracture, as previously described. One of the wells will serve as an injector, while the other well serves as the producer, depending on the reservoir fluid and the density of the chemicals/fluids to be injected. For example, in shale/tight oil reservoirs, gas (light hydrocarbon gases, CO2, nitrogen, etc.) can be injected from the slot-drilled well at the top, while the oil is produced from the slot-drilled well at the bottom. In another example, when injecting an EOR fluid with a higher density than the reservoir fluid, this will be injected into the horizontal slot-drilled well at the bottom, while the fluid will be produced from the slot-drilled well at the top. Therefore, determination of which of the slot-drill wells to produce or inject from depends on the density of the reservoir fluid in comparison to the density of the injection fluid. If the reservoir fluid is denser than the injection fluid, the top well will be the injector while the bottom well will be the producer. If the reservoir fluid is less dense than the injection fluid, the top well will be the producer, while the bottom well will be the injector.

The mechanical approach to cut the fractures, as described previously herein, is a more environmentally friendly alternative to the current hydraulic fracturing approach, which uses millions of gallons of water per well. A substantial portion of the injected water in hydraulic fracturing is produced and could contaminate the environment if not properly treated and disposed. This has led to the search for waterless fracturing technologies. Furthermore, the system and method of the present disclosure applies to the production of fluids from (or injection of fluids into) very tight rocks. Therefore, the system and method of the present disclosure is a game-changer in the production of steam or hot water from ultra-tight enhanced geothermal reservoirs, which typically require fracturing. The system and method of the present disclosure also applies to CO2 sequestration and hydrogen storage in tight rocks.

Currently, CGEOR is the best EOR method available for shale-oil reservoirs today. It is also the only approach demonstrated to work in the field. However, simulation models show that CGEOR only recovers, at most, 1.7 times of the oil typically recovered during primary recovery. Based on the upper limit of 9% for primary recovery from shale-oil reservoirs, over 80% of the initial oil in shale oil reservoirs are left behind in the subsurface even after CGEOR. Numerical simulations of CGEOR and SDEOR in Eagle Ford and Bakken shale plays indicate that the recovery from CGEOR is curtailed because of two main reasons. First, the relative oil permeability decreases near the hydraulically fractured well during successive gas injection, soaking, and production cycles. Secondly, the well cannot produce during the injection and soaking periods in CGEOR. On the contrary, the SDEOR of the present disclosure involves continuously producing oil and injecting gas from another well.

FIG. 39 compares the SDEOR technology of the present disclosure to CGEOR and primary recovery from multiply fractured horizontal wells. They show that the technology of the present disclosure yields approximately three times more oil than CGEOR and four times more oil than primary oil production from unconventional oil reservoirs. This drastic increase in recovery over the only alternative in the industry positions SDEOR as a potentially disruptive shale EOR technology.

The method of the present disclosure allows:

1. The precise control and certainty of the fracture location gives control and predictability of the drainage mechanism involved.
2. This predictability allows optimization of the EOR process with dramatical reduction in the level of uncertainty, when compared with EOR in hydraulically-fractured reservoirs, which are very vulnerable to fracture hits, uncertainties in location of injection fractures, etc. This uncertainty can easily result in a direct hydraulic communication between the injecting fractures and producing fractures, leading to EOR failure.
3. The flexibility to cut these slot-drill fractures in any direction allows production of the hydrocarbon to take advantage of gravity drainage. On the contrary, in hydraulic fractures, the fractures typically open against the minimum horizontal stress (in normal and strike-slip faulting regimes), rendering it unlikely and/or impossible to create horizontal fractures with hydraulic fracturing.
4. The ability to cut these slot-drill fractures in any reservoir, regardless of brittleness makes the method of the present disclosure applicable to shale resources that are currently not producible with hydraulic fractures because ductile shales (One example being the Floyd shale) are not very amenable to hydraulic fracturing.

Nomenclature $A_{if\perp x}$=area of fracture projections along each dimension, $L^2$, $m^2$
$A_{ij}^{p}$=projection area, $L^2$, $m^2$
$A^{nnc}$=area of a non-neighboring connection, $L^2$, $m^2$
$d^{nnc}$=non-neighboring connection distance, L, m
$k_f$=fracture permeability, $L^2$, $m^2$
$k_m$=matrix permeability, $L^2$, $m^2$
$k^{nnc}$=permeability of a non-neighboring connection, $L^2$, $m^2$
$K_i$=vapor-liquid equilibrium constant for component i
R=residual, $M^{-1}L^{-3}$, $kg^{-1}m^{-3}$
$S^{\alpha}$=saturation of phase, $\alpha$
$T_i$=half transmissibility, $L^3$, $m^3$
$T^{nnc}$=transmissibility factor for a NNC, $L^3$, $m^2$
$q^{\alpha}$=Volumetric flow rate of phase $\alpha$, $L^3/T$, $m^3/s$
$\vec{x}_e$=The grid block sizes in the X, Y, and Z directions, L, m
$\vec{x}$=X, Y, and Z coordinates, L, m
$x_i$=mole-fraction of component, i in the liquid phase
$X_i^{\alpha}$=mass-fraction of component, i in phase, $\alpha$
$Y_i$=mass-fraction of component, i in the gas phase
$y_i$=mole-fraction of component, i in the gas phase
$Z_i$=overall mass-fraction of component, i
$\phi$=porosity
$\rho$=density, $M/L^3$, $kg/m^3$
t=time, T, s Subscripts f=fracture
m=matrix
M–M=interaction between two different host matrix cells
pM-F=interaction a projection matrix and a fracture cell
i,j=Cell indices
if=interaction between matrix cell, i and fracture cell, f
$\alpha$=fluid phase Superscripts k+1=current time step
nnc=Non neighbouring connections Governing Equations for Compositional Reservoir Simulation Without accounting for the presence of natural fractures, the governing equations for the mass conservation of each hydrocarbon component, i, in the liquid (l) and vapor (v) phases is shown in Equation 1.

$$\frac{\partial}{\partial i}\left(\phi\left[\rho^l S^l X_i^l + \rho^v S^v X_i^g\right]\right) + \nabla\cdot\left(\rho^l X_i^l \vec{v}^l + \rho^v X_i^g \vec{v}^v\right) - \left(\rho^l X_i^l q^l + \rho^v X_i^g q^v\right)/V = 0. \quad \text{(A-1)}$$

Similarly, the mass conservation equation for water (w) in the aqueous phase is shown as Equation 2.

$$\frac{\partial}{\partial t}(\phi\rho^w S^w) + \nabla\cdot\left(\rho^w \vec{v}^w\right) - \rho^w q^w/V = 0, \quad \text{(A-2)}$$

where $\varphi$, $\rho^\alpha$, $S^\alpha$, and $q^\alpha$ represent the matrix porosity, mass density, saturation, and volumetric withdrawal/injection rate of phase $\alpha$, respectively. The symbols $X^l$ and $X^g$ represent the mass fractions of component i in the liquid and vapor phases, while $v_1$ and $v_v$ are the Darcy velocities for the liquid and vapor hydrocarbon phases, respectively. Note that the division of the source/sink term in Equations [1] and [2] by bulk volume, V is needed for dimensional consistency.

We obtain the phase velocities in Equations [1] and [2] from Darcy's equation as shown in Equation 3.

$$\vec{v}^\alpha = -K\frac{k^\alpha(S)}{\mu^\alpha}(\nabla\rho^\alpha - \rho^\alpha g\nabla z), \quad \text{(A-3)}$$

where $\mu^\alpha$ and K represent the phase viscosity and absolute matrix permeability, respectively. In the natural variables composition approach (Coats, 1979), which is used in this work, the primary variables are pressure, vapor and liquid composition of all but the last component, and water saturation (p, $x^1_1$, $x^g_1$ . . . , $x^1_{n-1}$, $x^g_{n-1}$, and $S_w$), respectively. The auxiliary thermodynamic equations and constraints needed for compositional simulation are summarized as follows in Equations [4] to [8].

$$f_i^g(p, T, y_1, \ldots, y_n) - f_i^l(p, T, x_1, \ldots, x_n) = 0, \text{ for } i \in 1, \ldots, n_c, \quad \text{(A-4)}$$

$$z_i - Lx_i - (1-L)y_i = 0, \text{ for } i \in 1, \ldots, n_c, \quad \text{(A-5)}$$

$$\sum_{i=1}^{n_c} x_i = 1, \text{ for } i \in 1, \ldots, n_c, \quad \text{(A-6)}$$

$$\sum_{i=1}^{n_l} y_i = 1, \text{ for } i \in 1, \ldots, n_c, \quad \text{(A-7)}$$

$$S^w + S^l + S^v = 1.0. \quad \text{(A-8)}$$

In these equations, $f^g_i$ and $f^l_i$ are the fugacities of each component in the gas and liquid phases, respectively. Equation [4] ensures that the fugacity of each component in the vapor phase is equal to that of the same component in the liquid phase (which is required at chemical equilibrium), Equation [5] ensures that the sum of the number of moles of each component in the liquid and gas phases is equal to its corresponding overall composition, while Equations [6], [7], and [8] ensure that all mole fractions and saturations sum up to one.

The Peng-Robinson equation of state (Peng and Robinson, 1976) is used to compute the fugacities and phase compressibility factors ($Z^g$ and $Z^l$). Firoozabadi (2015) provides more details on the equation of state, flash procedure, and the equations to compute the fugacities and compressibility factors. To solve the continuous equations in [1] and [2] numerically, a temporal discretization is performed using the backward Euler scheme as shown in Equations 9 and 10.

$$\frac{1}{\Delta t}\left[\left(\phi\rho^l S^l X_i^l + \phi\rho^v S^v X_i^g\right)^{n+1} - \left(\phi\rho^l S^l X_i^l + \phi\rho^v S^v X_i^g\right)^n\right] + \nabla\cdot\left(\rho^l X_i^l \vec{v}^l + \rho^v X_i^g \vec{v}^v\right) - \left(\rho^l X_i^l q^l + \rho^v X_i^g q^v\right)/V = R_i, \quad \text{(A-9)}$$

$$\frac{1}{\Delta t}\left[(\phi\rho^w S^w)^{n+1} - (\phi\rho^w S^w)^n\right] + \nabla\cdot\left(\rho^w \vec{v}^w\right) - \rho^w q^w/V = R^w. \quad \text{(A-10)}$$

In the above equations, n+1 represents the current time step, while n represents the previous time step. Note that all other terms without these superscripts are evaluated at the current time step. We then proceed to discretize the flux terms in space using the Finite Volume Method (FVM) with two-point flux approximation (TPFA). The TPFA method involves integrating Equations [9] and over a control volume, after which the divergence theorem is applied. In this work, we use the discrete divergence (div) and gradient (grad) operators, which are discussed in the MATLAB reservoir simulation book (Lie, 2019) and implemented as functions in the MATLAB reservoir simulation toolbox (MRST). The resulting discretized form of Equations [9] and can be written as shown in Equations [11] to [15].

$$\frac{V}{\Delta t}\left[\left(\phi\rho^l S^l X_i^l + \phi\rho^v S^v X_i^g\right)^{n+1} - \left(\phi\rho^l S^l X_i^l + \phi\rho^v S^v X_i^g\right)^n\right] + div\left(\rho^l X_i^l \vec{v}^l + \rho^v X_i^g \vec{v}^v\right)^{n+1} - \left(\rho^l X_i^l q^l + \rho^v X_i^g q^v\right)^{n+1} = R_i^{n+1}, \quad \text{(A-11)}$$

$$\frac{V}{\Delta i}\left[(\phi\rho^w S^w)^{n+1} - (\phi\rho^w S^w)^n\right] + div\left(\rho^w \vec{v}^w\right)^{n+1} - (\rho^w q^w)^{n+1} = R_w^{n+1}, \quad \text{(A-12)}$$

$$\vec{v}^\alpha = -T_{ik}\lambda_\alpha^{n+1}\left[grad\left(p_\alpha^{n+1}\right) - \rho_\alpha^{n+1} g grad(z)\right], \quad \text{(A-13)}$$

$$T_{ik} = \left[T_{i,k}^{-1} + T_{k,i}^{-1}\right]^{-1}, \quad \text{(A-14)}$$

$$T_{i,k} = A_{i,k}K_i\frac{\vec{c}_{i,k}\cdot\vec{n}_{i,k}}{|\vec{c}_{i,k}|^2}. \quad \text{(A-15)}$$

Here, V and $A_{i,k}$ refer to the cell volumes and face areas, respectively. The symbol, $n_{i,k}$ is the unit normal in the direction from the centroid of cell, i towards the face between cells i and k, while $c_{i,k}$ is the vector from the cell centroid to the face centroid. Additionally, $T_{ik}$ is face transmissibility, while $T_{i,k}$ is the contribution of a cell to the face transmissibility. This transmissibility ($T_{i,k}$) is referred to as a half-transmissibility because a pair of cells contributes to the transmissibility of each face in the TPFA formulation. Note that the temporal and spatial discretizations of the continuous partial differential equations lead to a mass imbalance, which is represented by the residual (R) in Equations [9] through [12]. The Newton-Raphson method involves applying the Taylor expansion to the residual at the current time step and current Newtonian iteration to obtain Equation [16]:

$$\frac{\partial R^{k+1}}{\partial X}\Delta X = -R^{k+1}(X), \quad \text{(A-16)}$$

where X denotes the primary variables. The matrix that contains the partial derivatives of the residuals with respect to each of these primary variables $$\left(\frac{\partial R^{k+1}}{\partial X}\right)$$

is referred to as the Jacobian matrix. The setup of this matrix is facilitated using automatic differentiation in MRST, and more details on the solution of the system of equations for compositional flow are provided in Moyner et al. (2017). Considering that most shale/tight oil reservoirs are naturally-fractured to some extent, this work will involve simulating the SDEOR method of the present disclosure in such reservoirs with or without natural fractures. The next section explains how the discretized governing equations are modified to model natural fractures accurately and efficiently.

Compositional Fluid Data

Tables B-1 and B-2 provide the compositional fluid data and binary interaction constants used in the simulations that involve a simple three-component hydrocarbon fluid. Tables B-5 and B-6 provide the corresponding data for a representative Bakken shale-oil reservoir, while Tables B-3 and B-4 provide compositional data inputs for a representative Eagle Ford shale-oil reservoir.

TABLE B-1

Compositional data for SDEOR synthetic oil fluid.

| Components | Mole Fraction Fraction | Critical Pressure (atm) | Critical Temperature (K) | Critical Volume (L/mol) | Molar Weight (g/gMol) | Acentric Factor |
|---|---|---|---|---|---|---|
| $C_1$ | 0.25 | 45.39 | 190.6 | 0.099 | 16.04 | 0.0114 |
| $CO_2$ | 0.25 | 72.80 | 304.12 | 0.094 | 44.01 | 0.2239 |
| $C_{10}$ | 0.50 | 20.75 | 617.70 | 0.601 | 142.28 | 0.4884 |

TABLE B-2

Binary interaction coefficients for SDEOR synthetic oil fluid.

| Component | $C_1$ | $CO_2$ | $C_{10}$ |
|---|---|---|---|
| $C_1$ | 0 | 0.045 | 0.1050 |
| $CO_2$ | 0.045 | 0 | 0.1150 |
| $C_{10}$ | 0.1050 | 0.1150 | 0 |

TABLE B-3

Compositional data for Eagle Ford shale formation, culled from Yu et al. (2019)

| Components | Mole Fraction Fraction | Critical Pressure (atm) | Critical Temperature (K) | Critical Volume (L/mol) | Molar Weight (g/gMol) | Acentric Factor | Parachor Coefficient |
|---|---|---|---|---|---|---|---|
| $CO_2$ | 0.01183 | 72.80 | 304.20 | 0.0940 | 44.01 | 0.225 | 78.01 |
| $N_2$ | 0.00161 | 33.50 | 126.20 | 0.0895 | 28.01 | 0.040 | 41.0 |
| $C_1$ | 0.11541 | 45.40 | 190.6 | 0.0990 | 16.04 | 0.008 | 77.0 |
| $C_2$-$C_5$ | 0.26438 | 36.5 | 274.74 | 0.2293 | 52.02 | 0.1723 | 171.07 |
| $C_5$-$C_{10}$ | 0.38089 | 25.08 | 438.68 | 0.3943 | 103.01 | 0.2839 | 297.42 |
| $C_{11}$+ | 0.22588 | 17.55 | 740.29 | 0.8870 | 267.15 | 0.6716 | 661.45 |

TABLE B-4

Binary interaction coefficients for Eagle Ford shale formation, culled from Yu et al. (2019)

| Component | $CO_2$ | $N_2$ | $C_1$ | $C_2$-$C_5$ | $C_6$-$C_{10}$ | $C_{11}$+ |
|---|---|---|---|---|---|---|
| $CO_2$ | 0 | 0.02 | 0.1030 | 0.1299 | 0.15 | 0.15 |
| $N_2$ | 0.02 | 0 | 0.031 | 0.082 | 0.12 | 0.12 |
| $C_1$ | 0.1030 | 0.031 | 0 | 0.0174 | 0.0462 | 0.111 |
| $C_2$-$C_5$ | 0.1299 | 0.082 | 0.0174 | 0 | 0.0073 | 0.0444 |
| $C_6$-$C_{10}$ | 0.15 | 0.12 | 0.0462 | 0.0073 | 0 | 0.0162 |
| $C_{11}$+ | 0.15 | 0.12 | 0.111 | 0.04444 | 0.0162 | 0 |

TABLE B-5

Compositional data for Bakken light oil shale formation, culled from (Yu et al., 2015)

| Components | Mole Fraction Fraction | Critical Pressure (atm) | Critical Temperature (K) | Critical Volume (L/mol) | Molar Weight (g/gMol) | Acentric Factor | Parachor Coefficient |
|---|---|---|---|---|---|---|---|
| $CO_2$ | 0.0002 | 72.80 | 304.20 | 0.0940 | 44.01 | 0.225 | 78.0 |
| $N_2$ | 0.0004 | 33.50 | 126.20 | 0.0895 | 28.01 | 0.040 | 41.0 |

TABLE B-5-continued

Compositional data for Bakken light oil shale formation, culled from (Yu et al., 2015)

| Components | Mole Fraction Fraction | Critical Pressure (atm) | Critical Temperature (K) | Critical Volume (L/mol) | Molar Weight (g/gMol) | Acentric Factor | Parachor Coefficient |
|---|---|---|---|---|---|---|---|
| $C_1$ | 0.25 | 45.40 | 190.6 | 0.0990 | 16.04 | 0.008 | 77 |
| $C_2$-$C_4$ | 0.22 | 42.54 | 363.30 | 0.1970 | 42.82 | 0.143 | 145.2 |
| $C_5$-$C_7$ | 0.20 | 33.76 | 511.56 | 0.3338 | 83.74 | 0.247 | 250 |
| $C_8$-$C_9$ | 0.13 | 30.91 | 579.34 | 0.4062 | 105.91 | 0.286 | 0.099 |
| $C_{10}$+ | 0.1994 | 21.58 | 788.74 | 0.9208 | 200.00 | 0.686 | 0.099 |

TABLE B-6

Binary interaction coefficients for Bakken light oil shale formation, culled from Yu et al. (2015).

| Component | $CO_2$ | $N_2$ | $C_1$ | $C_2$-$C_4$ | $C_5$-$C_7$ | $C_8$-$C_9$ | $C_{10}$+ |
|---|---|---|---|---|---|---|---|
| $CO_2$ | 0 | 0.02 | 0.1030 | 0.1327 | 0.1413 | 0.15 | 0.15 |
| $N_2$ | 0.02 | 0 | 0.013 | 0.0784 | 0.1113 | 0.12 | 0.12 |
| $C_1$ | 0.1030 | 0.013 | 0 | 0.0078 | 0.0242 | 0.0324 | 0.0779 |
| $C_2$-$C_4$ | 0.1327 | 0.0784 | 0.0078 | 0 | 0.0046 | 0.0087 | 0.0384 |
| $C_5$-$C_7$ | 0.1413 | 0.1113 | 0.0242 | 0.0046 | 0 | 0.0006 | 0.0169 |
| $C_8$-$C_9$ | 0.15 | 0.12 | 0.0324 | 0.0087 | 0.0006 | 0 | 0.0111 |
| $C_{10}$+ | 0.15 | 0.12 | 0.0779 | 0.0384 | 0.0169 | 0.0111 | 0 |

A method for slot-drill enhanced oil recovery in a formation includes providing a wellbore in a reservoir of the formation, the reservoir having a top and a bottom; cutting a first horizontal slot-drill fracture at the top of the reservoir; cutting a second horizontal slot-drill fracture at the bottom of the reservoir, injecting a fluid into the reservoir via the first horizontal slot-drill fracture at the top of the reservoir; and producing oil from the second horizontal slot-drill fracture at the bottom of the reservoir, wherein the first horizontal slot-drill fracture is parallel to the second horizontal slot-drill fracture.

A method for improving hydrocarbon recovery in an ultra-low permeability reservoir includes injecting a fluid into a first wellbore: producing a hydrocarbon from a second wellbore, wherein the first wellbore and the second wellbore are connected at distal ends thereof with one or more horizontal slot-drilled fractures, and wherein the hydrocarbon is produced from the one or more horizontal slot-drilled fractures.

A method for slot-drill enhanced oil recovery in a formation includes providing a first wellbore having a first distal end and a second wellbore having a second distal end; cutting a horizontal slot-drill fracture in the formation between the first wellbore and the second wellbore: injecting a fluid into the first wellbore; and producing oil from the horizontal slot-drill fracture through the second wellbore, wherein the horizontal slot-drill fracture connects the first distal end of the second distal end.

The method of any preceding clause, wherein the first horizontal slot-drill fracture, the second horizontal slot-drill fracture, or both, comprises a plurality of horizontal fractures mechanically created by one or more tensioned, abrasive cables.

The method of any preceding clause, wherein the first horizontal slot-drill fracture, the second horizontal slot-drill fracture, or both, comprises one or more fractures mechanically cut in the formation at predetermined locations in the formation, wherein the predetermined locations are determined via a simulation.

The method of any preceding clause, wherein the reservoir is a tight oil reservoir, shale oil reservoir, gas reservoir, ultra-low permeability reservoir, or combinations thereof.

The method of any preceding clause, wherein the fluid is a light hydrocarbon gas, carbon dioxide, nitrogen, or combinations thereof.

The method of any preceding clause, wherein the first horizontal slot-drill fracture, the second horizontal slot-drill fracture, or both, comprise a plurality of horizontal slot-drill fractures, and wherein, the plurality of first horizontal slot-drill fractures are parallel with the plurality of second horizontal slot-drill fractures.

The method of any preceding clause, wherein oil recovery from the reservoir is three times an oil recovery from a conventional cyclic gas enhanced oil recovery.

The method of any preceding clause, wherein an improved oil recovery of the reservoir is 4.17 within 8 years of production.

The method of any preceding clause, wherein the wellbore comprises two wellbores, and wherein, the injecting occurs in a first wellbore of the two wellbores and the producing occurs in a second wellbore of the two wellbores.

The method of any preceding clause, wherein production of the hydrocarbon is two times greater than production of a hydrocarbon through a well with natural fractures.

The method of any preceding clause, wherein the fluid is injected from a top of the first well, while the hydrocarbon is produced from the one or more horizontal slot-drill fractures at a bottom of the second well.

The method of any preceding clause, wherein the fluid is injected from a bottom of the first well, while the hydrocarbon is produced from the one or more horizontal slot-drill fractures at a top of the second well.

The method of any preceding clause, wherein the method has an oil recovery factor of between 13 and 51.

The method of any preceding clause, wherein the method has an improved oil recovery ratio of between 2 and 9.

The method of any preceding clause, wherein the one or more horizontal slot-drilled fractures comprises at least two parallel horizontal slot-drill fractures.

The method of any preceding clause, wherein the horizontal slot-drill fracture includes at least two parallel horizontal slot-drill fractures.

The method of any preceding clause, wherein after the at least two parallel horizontal slot-drill fractures are created, the first well is plugged at a bottom and is only allowed to inject fluids at the top, and the second well remains open to flow produced oil from a bottom fracture of the at least two parallel horizontal slot-drill fractures.

The method of any preceding clause, wherein the reservoir is a tight oil reservoir, shale oil reservoir, gas reservoir, ultra-low permeability reservoir, or combinations thereof.

The method of any preceding clause, further comprising continuously producing and injecting.

The method of any preceding clause, further comprising continuously producing oil from the second wellbore and injecting the fluid into the first wellbore.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

What is claimed is:

1. A method for slot-drill enhanced oil recovery in a formation, the method comprising:

providing a wellbore in a reservoir of the formation, the reservoir having a top and a bottom;

cutting a first planar horizontal slot-drill fracture mechanically created by one or more tensioned, abrasive cables at the top of the reservoir;

cutting a second planar horizontal slot-drill fracture mechanically created by one or more tensioned, abrasive cables at the bottom of the reservoir parallel to and spaced from the first planar horizontal slot-drill fracture;

injecting a fluid into the reservoir via the first planar horizontal slot-drill fracture at the top of the reservoir; and producing oil from the second planar horizontal slot-drill fracture at the bottom of the reservoir, wherein the first planar horizontal slot-drill fracture is parallel to the second planar horizontal slot-drill fracture.

2. The method of claim 1, wherein the first planar horizontal slot-drill fracture, the second planar horizontal slot-drill fracture, or both, comprises one or more fractures mechanically cut in the formation at predetermined locations in the formation, wherein the predetermined locations are determined via a simulation.

3. The method of claim 1, wherein the reservoir is a tight oil reservoir, shale oil reservoir, gas reservoir, ultra-low permeability reservoir, or combinations thereof.

4. The method of claim 1, wherein the fluid is a light hydrocarbon gas, carbon dioxide, nitrogen, or combinations thereof.

5. The method of claim 1, wherein the first planar horizontal slot-drill fracture and the second planar horizontal slot-drill fracture each comprise a plurality of planar horizontal slot-drill fractures, and wherein, the plurality of first planar horizontal slot-drill fractures are parallel with the plurality of second planar horizontal slot-drill fractures.

6. The method of claim 1, wherein the wellbore comprises two wellbores, and wherein, the injecting occurs in a first wellbore of the two wellbores and the producing occurs in a second wellbore of the two wellbores.

7. The method of claim 1, further comprising continuously producing and injecting.

8. A method for improving hydrocarbon recovery in an ultra-low permeability reservoir, the method comprising:

injecting a fluid into a first wellbore, wherein the fluid is injected from a bottom of the first wellbore;

producing a hydrocarbon from a second wellbore, wherein the second wellbore is bored above the first wellbore;

wherein the first wellbore is connected at a first distal end with a first planar horizontal slot-drill fracture and the second wellbore is connected at a second distal end with a second planar horizontal slot-drill fracture parallel to and spaced from the first planar horizontal slot-drill fracture, and wherein the hydrocarbon is produced from the second planar horizontal slot-drill fracture at a top of the second wellbore.

9. The method of claim 8, wherein the fluid is injected from a top of the first wellbore, while the hydrocarbon is produced from the second planar horizontal slot-drill fractures at a bottom of the second wellbore.

10. The method of claim 8, wherein the first and/or the second planar horizontal slot-drill fractures comprises at least two parallel planar horizontal slot-drill fractures.

11. The method of claim 8, further comprising continuously producing the hydrocarbon from the second wellbore and injecting the fluid from the first wellbore.

12. A method for slot-drill enhanced oil recovery in a formation, the method comprising:

providing a first wellbore having a first distal end and a second wellbore having a second distal end;

cutting a planar horizontal slot-drill fracture in the formation between the first wellbore and the second wellbore, wherein the formation comprises an ultra-low permeability reservoir;

injecting a fluid into the first wellbore; and producing oil from the planar horizontal slot-drill fracture through the second wellbore, wherein the planar horizontal slot-drill fracture connects the first distal end and the second distal end.

13. The method of claim 12, further comprising cutting an additional planar horizontal slot-drill fracture parallel to and spaced below the planar horizontal slot-drill fracture, and wherein the first wellbore injects fluids at the planar horizontal slot-drill fracture, and the second wellbore remains open to flow produced oil from the additional planar horizontal slot-drill fracture.

14. The method of claim 12, further comprising continuously producing oil from the second wellbore and injecting the fluid into the first wellbore.

* * * * *